US009308735B2

(12) United States Patent
Nozawa et al.

(10) Patent No.: US 9,308,735 B2
(45) Date of Patent: Apr. 12, 2016

(54) CARTRIDGE

(71) Applicant: SEIKO EPSON CORPORATION, Tokyo (JP)

(72) Inventors: Izumi Nozawa, Nagano (JP); Atsushi Kobayashi, Nagano (JP); Tadahiro Mizutani, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/947,335

(22) Filed: Jul. 22, 2013

(65) Prior Publication Data

US 2014/0022317 A1 Jan. 23, 2014

(30) Foreign Application Priority Data

Jul. 23, 2012 (JP) ..... 2012-162233
Aug. 31, 2012 (JP) ..... 2012-190744

(51) Int. Cl.
*B41J 2/175* (2006.01)

(52) U.S. Cl.
CPC ..... *B41J 2/17553* (2013.01); *B41J 2/1752* (2013.01); *B41J 2/1753* (2013.01); *B41J 2/17503* (2013.01); *B41J 2/17513* (2013.01)

(58) Field of Classification Search
CPC ..... B41J 2/17506; B41J 2/17513; B41J 2/17553; B41J 2/17559; B41J 2/17566
USPC ..... 347/19, 85, 86; 220/4.12, 23.83
See application file for complete search history.

(56) References Cited

U.S. PATENT DOCUMENTS

| | | | | |
|---|---|---|---|---|
| 5,825,388 | A | 10/1998 | Sasaki | |
| 5,946,014 | A | 8/1999 | Shimomura et al. | |
| 5,980,032 | A | 11/1999 | Pawlowski, Jr. et al. | |
| 6,007,191 | A | 12/1999 | Fujii et al. | |
| 6,086,193 | A | 7/2000 | Shimada et al. | |
| 6,145,974 | A | 11/2000 | Shinada et al. | |
| 6,155,678 | A | 12/2000 | Komplin et al. | |
| 6,158,852 | A | 12/2000 | Sato et al. | |
| 6,196,671 | B1 * | 3/2001 | Breemes et al. | 347/86 |

(Continued)

FOREIGN PATENT DOCUMENTS

| | | |
|---|---|---|
| EP | 0655336 A1 | 5/1995 |
| EP | 0712727 A2 | 5/1996 |

(Continued)

OTHER PUBLICATIONS

Extended European Search Report for the related European Patent Application No. 13177574.4 dated Jan. 25, 2016.

*Primary Examiner* — Anh T. N. Vo
(74) *Attorney, Agent, or Firm* — Global IP Counselors, LLP

(57) ABSTRACT

A cartridge includes a printing material containing section, a plurality of printing material supply ports, and a branch communicating section. The printing material containing section is configured and arranged to contain a printing material. A detection region is configured as a part of the printing material containing section to detect the printing material in the printing material containing section. The plurality of printing material supply ports are configured and arranged to supply the printing material from the printing material containing section. The branch communicating section branches into the plurality of printing material supply ports respectively and communicates the detection region and the plurality of printing material supply ports to distribute the printing material to the plurality of printing material supply ports respectively.

14 Claims, 38 Drawing Sheets

(56) References Cited

U.S. PATENT DOCUMENTS

| | | | | |
|---|---|---|---|---|
| 6,203,148 | B1 | 3/2001 | Kishida | |
| 6,220,701 | B1 | 4/2001 | Umemura | |
| 6,250,750 | B1 | 6/2001 | Miyazawa et al. | |
| 6,254,226 | B1 | 7/2001 | Lengyel et al. | |
| 6,290,348 | B1 * | 9/2001 | Becker et al. | 347/87 |
| 6,332,481 | B1 | 12/2001 | Shinada et al. | |
| 6,364,473 | B1 | 4/2002 | Liu | |
| 6,390,613 | B1 | 5/2002 | Liu | |
| 6,474,796 | B1 | 11/2002 | Ishinaga | |
| 6,585,007 | B2 | 7/2003 | Kubokawa | |
| 6,623,104 | B1 | 9/2003 | Kotaki et al. | |
| 6,773,099 | B2 | 8/2004 | Inoue et al. | |
| 6,776,479 | B2 * | 8/2004 | Ardito et al. | 347/86 |
| 6,824,258 | B2 | 11/2004 | Yamamoto et al. | |
| 6,830,324 | B2 | 12/2004 | Ogura et al. | |
| 6,848,776 | B2 * | 2/2005 | Nishioka et al. | 347/86 |
| 6,854,835 | B2 | 2/2005 | Kobayashi et al. | |
| 6,976,753 | B2 | 12/2005 | Kuwabara et al. | |
| 7,104,640 | B2 | 9/2006 | Ogura et al. | |
| 7,165,835 | B2 | 1/2007 | Ota et al. | |
| 7,237,881 | B2 | 7/2007 | Hayasaki et al. | |
| 7,293,866 | B2 | 11/2007 | Miyazawa et al. | |
| 7,325,909 | B2 | 2/2008 | Yuen | |
| 7,393,088 | B2 | 7/2008 | Sasaki | |
| 7,445,323 | B2 | 11/2008 | Anderson, Jr. et al. | |
| 7,470,008 | B2 | 12/2008 | Yan | |
| 7,735,983 | B2 | 6/2010 | Pearson et al. | |
| 7,918,547 | B2 | 4/2011 | Hatasa et al. | |
| 7,938,523 | B2 | 5/2011 | Aldrich | |
| 7,954,662 | B2 | 6/2011 | Ogura et al. | |
| 8,142,000 | B2 | 3/2012 | Ishizawa et al. | |
| 8,177,342 | B2 | 5/2012 | Wanibe et al. | |
| 8,366,250 | B2 | 2/2013 | Wanibe et al. | |
| 8,366,251 | B2 | 2/2013 | Wanibe et al. | |
| 8,382,263 | B2 * | 2/2013 | Okajima | 347/85 |
| 8,684,505 | B2 | 4/2014 | Campbell-Brown et al. | |
| 9,050,813 | B2 | 6/2015 | Qing et al. | |
| 2001/0009431 | A1 | 7/2001 | Kobayashi et al. | |
| 2002/0104578 | A1 | 8/2002 | Kubokawa | |
| 2002/0139441 | A1 | 10/2002 | Schonfelder et al. | |
| 2003/0090553 | A1 | 5/2003 | Jung et al. | |
| 2004/0100540 | A1 | 5/2004 | Hatasa et al. | |
| 2005/0041076 | A1 | 2/2005 | Katayama | |
| 2005/0179750 | A1 | 8/2005 | Hayasaki et al. | |
| 2005/0185034 | A1 | 8/2005 | Anma et al. | |
| 2005/0219303 | A1 | 10/2005 | Matsumoto et al. | |
| 2005/0275699 | A1 | 12/2005 | Sasaki | |
| 2006/0132555 | A1 | 6/2006 | Uehara et al. | |
| 2006/0203045 | A1 | 9/2006 | Kobayashi et al. | |
| 2007/0024683 | A1 | 2/2007 | Yan | |
| 2007/0139492 | A1 | 6/2007 | Anderson, Jr. et al. | |
| 2007/0195141 | A1 | 8/2007 | Anma et al. | |
| 2007/0195144 | A1 | 8/2007 | McNestry | |
| 2008/0034712 | A1 | 2/2008 | Miyajima et al. | |
| 2008/0204529 | A1 | 8/2008 | Matsumoto et al. | |
| 2008/0230141 | A1 | 9/2008 | Hattori | |
| 2008/0231672 | A1 | 9/2008 | Mano | |
| 2008/0239037 | A1 | 10/2008 | Inoue et al. | |
| 2008/0284833 | A1 | 11/2008 | Uehara et al. | |
| 2009/0128609 | A1 | 5/2009 | Matsumoto et al. | |
| 2009/0244221 | A1 | 10/2009 | Shimizu | |
| 2009/0322832 | A1 | 12/2009 | Wanibe et al. | |
| 2009/0322838 | A1 | 12/2009 | Wanibe et al. | |
| 2009/0322839 | A1 | 12/2009 | Ishizawa et al. | |
| 2010/0073438 | A1 | 3/2010 | Wanibe et al. | |
| 2010/0208015 | A1 | 8/2010 | Matsumoto et al. | |
| 2010/0302291 | A1 | 12/2010 | Matsumoto et al. | |
| 2010/0309265 | A1 | 12/2010 | Matsumoto et al. | |
| 2010/0309266 | A1 | 12/2010 | Matsumoto et al. | |
| 2011/0037815 | A1 | 2/2011 | Anma et al. | |
| 2011/0169899 | A1 | 7/2011 | Nozawa et al. | |
| 2012/0127247 | A1 | 5/2012 | Anma et al. | |
| 2012/0133713 | A1 | 5/2012 | Camp | |
| 2013/0208044 | A1 | 8/2013 | Matsumoto et al. | |

FOREIGN PATENT DOCUMENTS

| | | | |
|---|---|---|---|
| EP | 0739740 | A1 | 10/1996 |
| EP | 0847861 | A2 | 6/1998 |
| EP | 1053881 | A1 | 5/2000 |
| EP | 1095777 | A2 | 10/2000 |
| EP | 1053876 | A2 | 11/2000 |
| EP | 1080918 | A1 | 3/2001 |
| EP | 1170135 | A1 | 1/2002 |
| EP | 1258361 | A1 | 11/2002 |
| EP | 1707380 | A2 | 10/2006 |
| EP | 2103435 | A2 | 9/2009 |
| EP | 2380744 | A2 | 10/2011 |
| EP | 2425981 | A2 | 3/2012 |
| GB | 2288148 | A | 10/1995 |
| JP | 06-106729 | A | 4/1994 |
| JP | 08-112915 | A | 5/1996 |
| JP | 10-095129 | A | 4/1998 |
| JP | 10-250091 | A | 9/1998 |
| JP | 2000-203053 | A | 7/2000 |
| JP | 2001-063085 | A | 3/2001 |
| JP | 2001-130022 | A | 5/2001 |
| JP | 2002-036590 | A | 2/2002 |
| JP | 2002-120376 | A | 4/2002 |
| JP | 2002-225306 | A | 8/2002 |
| JP | 2002-370370 | A | 12/2002 |
| JP | 2005-170027 | A | 6/2005 |
| JP | 2005-349786 | A | 12/2005 |
| JP | 2007-112150 | A | 5/2007 |
| JP | 2008-246896 | A | 10/2008 |
| JP | 2009-061785 | A | 3/2009 |
| JP | 2009-241608 | A | 10/2009 |
| JP | 2010-005957 | A | 1/2010 |
| JP | 2011-110712 | A | 6/2011 |
| JP | 2011-140189 | A | 7/2011 |
| JP | 2011-207066 | A | 10/2011 |
| JP | 2012-035489 | A | 2/2012 |
| JP | 2012-126100 | A | 7/2012 |
| JP | 2012-136039 | A | 7/2012 |
| WO | 98/55325 | A1 | 12/1998 |
| WO | 2008/056736 | A1 | 5/2008 |

* cited by examiner

F19–F19

F28–F28

F31–F31

CARTRIDGE

CROSS-REFERENCE TO RELATED APPLICATIONS

This application claims priority to Japanese Patent Application No. 2012-162233 filed on Jul. 23, 2012 and Japanese Patent Application No. 2012-190744 filed on Aug. 31, 2012. The entire disclosures of Japanese Patent Application Nos. 2012-162233 and 2012-190744 are hereby incorporated herein by reference.

BACKGROUND

1. Technical Field

The present invention relates to a cartridge of a printing material supply system.

2. Related Art

In a printing material supply system, a cartridge is mounted in a printing device, the cartridge supplies a printing material to the printing device, and the printing device executes printing using the printing material. Such a cartridge is provided with a printing material containing section and a printing material supply port, the printing material is contained in the printing material containing section, and the printing material is supplied with regard to the printing device through the printing material supply port. A cartridge provided with a plurality of printing material supply ports for supplying a printing material from a common printing material containing section respectively has been proposed in Unexamined Japanese Patent Application Publication No. 10-95129.

SUMMARY

In the cartridge of Unexamined Japanese Patent Application Publication No. 10-95129, each of the plurality of printing material supply ports is directly communicated with the common printing material containing section, and there is not sufficient consideration given to detection of the remaining amount of the printing material which can be supplied from each of the printing material supply ports. For example, in a case of detecting the remaining amount of the printing material which can be supplied from each of the printing material supply ports based on the condition of the printing material in a detection region provided in the printing material containing section, the correlation with respect to the condition of the printing material in the detection region is different between the remaining amount of the printing material which can be supplied from the printing material supply port communicated with the printing material containing section in a position relatively close to the detection region and the remaining amount of the printing material which can be supplied from the printing material supply port communicated with the printing material containing section in a position relatively far from the detection region. Therefore, the remaining amount of the printing material which can be supplied from each of the printing material supply ports cannot be detected accurately. Particularly, in a case where the printing material moves back and forth between the detection region side and the printing material supply port side in the printing material containing section due to oscillation or inclination of the cartridge, there are cases where the remaining amount of the printing material which can be supplied from each of the printing material supply ports is detected falsely. As a result, a technique which can improve accuracy in detection of the remaining amount of the printing material which can be supplied from each of the printing material supply ports has been desired in the cartridge provided with the plurality of printing material supply ports for supplying a printing material from the common printing material containing section respectively.

In addition to this, reductions in size, reduction in cost, reduction in the use of resources, facilitation of manufacturing, improvements in usability, and the like have been desired in cartridges. Here, the problems described above are not limited to printing material supply systems which supply a printing material from a cartridge to a printing device but are common to liquid supply systems which supply other liquids from a cartridge to a liquid consumption device.

The present invention has been made in order to at least partly solve the problems described above and can be achieved as the following aspects.

(1) According to an aspect of the present invention, a cartridge is proposed. The cartridge includes a printing material containing section which contains a printing material; a detection region which is configured as a part of the printing material containing section to detect the printing material in the printing material containing section; a plurality of printing material supply ports which supply the printing material from the printing material containing section; and a branch communicating section which branches a flow of the printing material into the plurality of printing material supply ports respectively, and communicates the detection region and the plurality of printing material supply ports to distribute the printing material to the plurality of printing material supply ports respectively. According to the cartridge of the aspect, the printing material is separated into the plurality of printing material supply ports respectively by the branch communicating section after the printing material passes through the detection region of the printing material containing section. It is thus possible to secure the correlation between the condition of the printing material in the detection region and the remaining amount of the printing material which can be supplied from each of the printing material supply ports. As a result, it is possible to improve accuracy in detection of the remaining amount of the printing material which can be supplied from each of the printing material supply ports depending on the condition of the printing material in the detection region.

(2) The cartridge of the aspect described above may further include a backflow preventing section which communicates the detection region and the branch communicating section, and prevents backflow of the printing material from the branch communicating section to the detection region. According to the cartridge of the aspect, it is possible to prevent false detection of the remaining amount of the printing material due to the printing material flowing back from the branch communicating section to the detection region.

(3) The cartridge of the aspect described above may further include a wall section on which the plurality of printing material supply ports are provided to protrude in a −Z axial direction, and a groove section which is provided between two printing material supply ports adjacent to each other among the plurality of printing material supply ports to be recessed to a +Z axial direction side with respect to the wall section, with the +Z axial direction being opposite to the −Z axial direction. The branch communicating section may include an upstream side reservoir chamber which reserves the printing material from the printing material containing section, a first flow path which is communicated with the upstream side reservoir chamber and is configured to distribute the printing material in the upstream side reservoir chamber to a first printing material supply port of the two printing material supply ports, a first downstream side reservoir chamber which is communicated with the first flow path and reserves the printing material from the first flow path, a first communicating hole which communicates the first downstream side reservoir chamber and the first printing material supply port and supplies the printing material in the first downstream side reservoir chamber to the first printing material supply port, a second flow path which is communicated with the upstream side reservoir chamber and is configured to distribute the printing material in the upstream side reservoir chamber to a second printing material supply port different from the first printing material supply port of the two printing material supply ports, a second downstream side reservoir chamber which is communicated with the second flow path and reserves the printing material from the second flow path, and a second communicating hole which communicates the second downstream side reservoir chamber and the second printing material supply port and supplies the printing material in the second downstream side reservoir chamber to the second printing material supply port. The first flow path, the first downstream side reservoir chamber, the first communicating hole, the second flow path, the second downstream side reservoir chamber, and the second communicating hole may be arranged in a plane symmetrical manner with respect to the groove section. According to the cartridge of the aspect, it is possible to match the state of ink flowing toward the first printing material supply port and the state of ink flowing toward the second printing material supply port. It is thus possible to supply ink from the first printing material supply port and the second printing material supply port on similar conditions.

(4) In the cartridge of the aspect described above, the first communicating hole and the second communicating hole may be plural, respectively. According to the cartridge of the aspect, even in a case where distribution of ink becomes impossible in a communicating hole, it is possible to secure distribution of ink by another communicating hole.

(5) In the cartridge of the aspect described above, the −Z axial direction is a gravity direction in which gravity is directed. Each of the first downstream side reservoir chamber and the second downstream side reservoir chamber may include an upper wall surface which defines the +Z axial direction and a lower wall surface which defines the −Z axial direction side. Each of the first communicating hole and the second communicating hole may include a downstream side communicating hole which is provided in the lower wall surface, and an upstream side communicating hole which is provided in the lower wall surface and is positioned on the upstream side reservoir chamber side with respect to the downstream side communicating hole. The upper wall surface on the groove section side may be inclined in the −Z axial direction, and the upstream side communicating hole may be positioned on the groove section side with respect to the downstream side communicating hole. There is a tendency that a relatively large amount of air is mixed into the ink in a position closer to the upstream side reservoir chamber in each of the first downstream side reservoir chamber and the second downstream side reservoir chamber, and such air easily remains on the opposite side of the groove section in the upper wall surface. According to the cartridge of the aspect, it is possible to prevent air from flowing into the upstream side communicating hole by securing the distance between air remaining in the upper wall surface and the upstream side communicating hole.

(6) In the cartridge of the aspect described above, the −Z axial direction is a gravity direction in which gravity is directed. Each of the first downstream side reservoir chamber and the second downstream side reservoir chamber may include a lower wall surface which defines the −Z axial direction side. Each of the first communicating hole and the second communicating hole may include a downstream side communicating hole which is provided in the lower wall surface, and an upstream side communicating hole which is provided in the lower wall surface and is positioned on the upstream side reservoir chamber side with respect to the downstream side communicating hole. The lower wall surface on the groove section side may be inclined in the +Z axial direction, and the downstream side communicating hole may be positioned away from the groove section with respect to the upstream side communicating hole. According to the cartridge of the aspect, it is possible to supply ink, which remains on the opposite side of the groove section in the lower wall surface of each of the first downstream side reservoir chamber and the second downstream side reservoir chamber, to each of the first printing material supply port and the second printing material supply port through the downstream side communicating hole.

(7) In the cartridge of the aspect described above, the first flow path may be communicated with the first downstream side reservoir chamber on the opposite side of the groove section, and the second flow path may be communicated with the second downstream side reservoir chamber on the opposite side of the groove section. Each of the first downstream side reservoir chamber and the second downstream side reservoir chamber may include a lower wall surface which defines the −Z axial direction side. Each of the first communicating hole and the second communicating hole may include a downstream side communicating hole which is provided in the lower wall surface, and an upstream side communicating hole which is provided in the lower wall surface and is positioned on the upstream side reservoir chamber side with respect to the downstream side communicating hole. The upstream side communicating hole may be positioned on the groove section side with respect to the downstream side communicating hole. According to the cartridge of the aspect, it is possible to prevent air from flowing into the upstream side communicating hole by securing the distribution distance of ink which flows from each of the first flow path and the second flow path to each of the upstream side communicating holes so as to gain time to remove air from the ink.

The plurality of constituent elements of each of the aspects of the present invention described above are not all essential and it is possible to appropriately perform modification, deletion, replacement with other new constituent elements, and deletion of a portion of limited content with regard to a portion of the plurality of constituent elements in order to solve a portion or all of the problems described above or to achieve a portion or all of the effects which are described in the specifications. In addition, an aspect which is independent of the present invention is possible by combining a portion or all of one technical aspect described above with a portion or all of the technical characteristics which are included in the other embodiments of the present invention described above in order to solve a portion or all of the problems described above or to achieve a portion or all of the effects which are described in the specifications.

For example, it is possible for one aspect of the present invention to be implemented as a device which is provided with one or more elements out of the four elements of the printing material containing section, the detection region, the plurality of printing material supply ports, and the branch communicating section. That is, the device of the present invention may or may not have the printing material containing section. In addition, the device of the present invention may or may not have the detection region. In addition, the device of the present invention may or may not have the plurality of printing material supply ports. In addition, the device of the present invention may or may not have the branch communicating section.

The printing material containing section may be configured, for example, as a printing material containing section which contains a printing material. The detection region may be configured, for example, as a part of the printing material containing section to detect the printing material in the printing material containing section. The plurality of printing material supply ports may be configured, for example, as a plurality of printing material supply ports which supply the printing material from the printing material containing section. The branch communicating section may be configured, for example, as a branch communicating section which branches from the detection region into the plurality of printing material supply ports and communicates the detection region and the plurality of printing material supply ports to distribute the printing material to the plurality of printing material supply ports.

It is possible to implement such a device, for example, as a cartridge and as a device other than the cartridge. According to such an aspect, it is possible to solve at least one of the various problems such as reductions in size, reduction in cost, reduction in the use of resources, facilitation of manufacturing, and improvements in usability of the device. It is possible for a portion, all or any of the technical characteristics of each of the aspects of the cartridge described above to be applied in such a device.

It is possible for the present invention to be implemented as various aspects other than the cartridge. For example, it is possible for the invention to be implemented as aspects such as a printing material supply system which is provided with a cartridge and a printing device, a printing device where a cartridge is mounted, a cartridge which supplies a liquid which is different from a printing material, and a method for supplying a liquid from a cartridge.

BRIEF DESCRIPTION OF THE DRAWINGS

Referring now to the attached drawings which form a part of this original disclosure.

DETAILED DESCRIPTION OF EXEMPLARY EMBODIMENTS

Index

A. First Embodiment
A-1. Overall Configuration of Printing Material Supply System
A-2. Configuration where Cartridge is mounted in Holder
A-3. Detailed Configuration of Cartridge
A-4. Detailed Configuration of Another Cartridge
A-5. Effects
A-6. Modified Example of First Embodiment
B. Second Embodiment
C. Third Embodiment
D. Fourth Embodiment
E. Modified Example
E-1. Modified Example of Outer Appearance of Cartridge
E-2. First Cartridge using Adaptor
E-3. Second Cartridge using Adaptor
E-4. Third Cartridge using Adaptor
E-5. Modified Example of Circuit Substrate and Terminal Formation
E-6. Modified Example of Holder
E-7. Modified Example of Internal Pressure Adjusting Mechanism and Negative Pressure Generating Member
F. Fifth Embodiment
G. Other Modified Examples

A. First Embodiment

A-1. Overall Configuration of Printing Material Supply System

Figure 1:
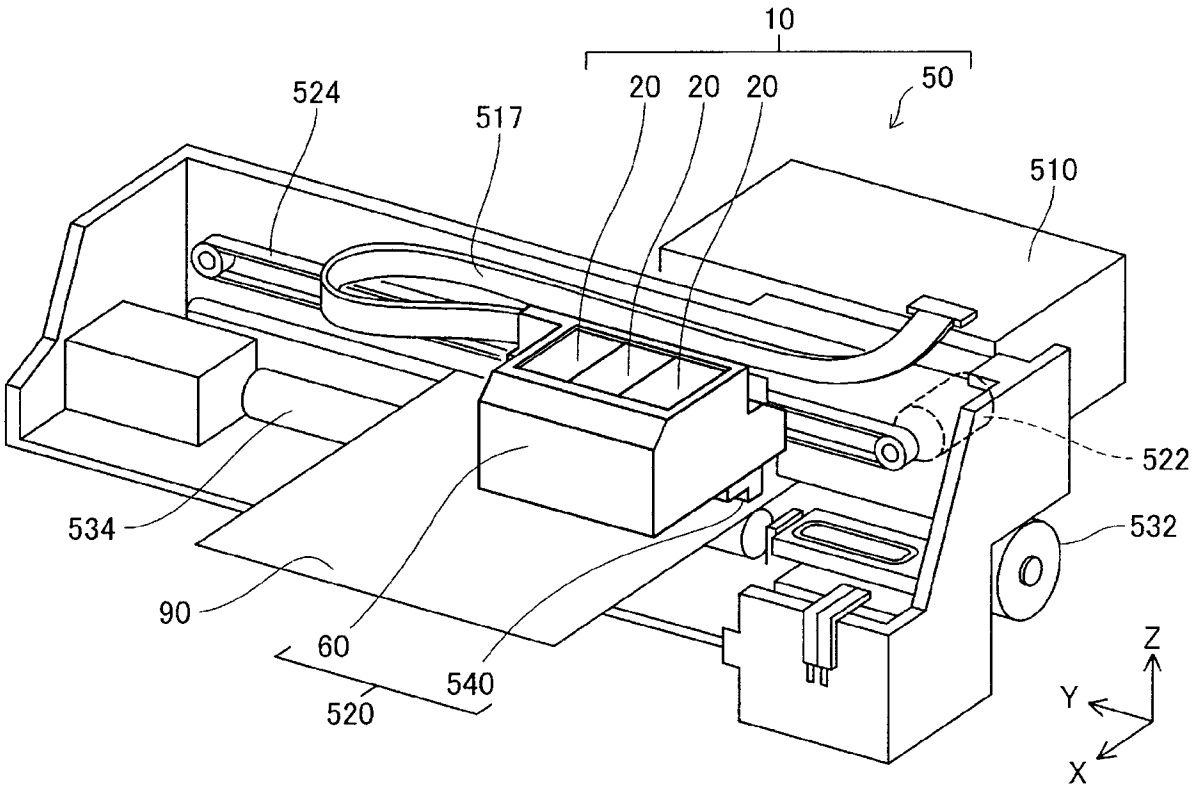
FIG. 1 is a perspective diagram illustrating a configuration of a printing material supply system.

FIG. 1 is a perspective diagram illustrating a configuration of a printing material supply system 10. X, Y, and Z axes are drawn to be orthogonal to each other in FIG. 1. The X, Y, and Z axes in FIG. 1 correspond to the X, Y, and Z axes in the other diagrams. In the present embodiment, the Z axial direction is the vertical direction.

The printing material supply system 10 is provided with a cartridge 20 and a printer (a printing device) 50. In the printing material supply system 10, the cartridge 20 is mounted to a holder (a cartridge mounting section) 60 of the printer 50, the cartridge 20 supplies ink (a printing material) to the printer 50, and printing is executed using the ink.

The cartridge 20 of the printing material supply system 10 is a device which has a function of containing ink and is also called an ink cartridge. The cartridge 20 is configured to be attached and detached by the user with regard to the holder 60 of the printer 50. The ink in the cartridge 20 is supplied to a head 540 of the printer 50 from a printing material supply port described later which is provided in the cartridge 20 via a printing material supply pipe described later which is provided in the holder 60. Detailed configurations of the cartridge 20 and the holder 60 will be described later.

In the present embodiment, the holder 60 in the printer 50 is configured so that it is possible for three of the cartridges 20 to be mounted. The number of the cartridges 20 which are mounted in the holder 60 is not limited to three, it is possible to arbitrarily change the number, and there may be three or less or there may be three or more.

In the present embodiment, the ink in the cartridge 20 is black ink. In other embodiments, the ink in the cartridge 20 may be inks of various colors other than black such as yellow, magenta, light magenta, cyan, or light cyan, or ink where a special glossy color (metallic gloss, white pearl, or the like) is added to these colors. In other embodiments, each of the inks for the plurality of cartridges 20 which are mounted in the holder 60 may each be different types.

The printer 50 of the printing material supply system 10 is an ink jet printer which is a device for printing using ink. In addition to the holder 60 which holds the cartridge 20, the printer 50 is provided with a control section 510, a carriage 520, and the head 540. The printer 50 has a configuration where the ink is supplied from the cartridge 20 which is mounted in the holder 60 to the head 540, and information such as text, a diagram, or an image is printed onto a printing medium 90 such as paper or a label by the ink being discharged from the head 540 with regard to the printing medium 90.

The control section 510 of the printer 50 controls each section of the printer 50. The carriage 520 of the printer 50 is configured to relatively move the head 540 with regard to the printing medium 90. The head 540 of the printer 50 receives supply of the ink from the cartridge 20 which is mounted in the holder 60 and discharges the ink to the printing medium 90. The control section 510 and the carriage 520 are electrically connected via a flexible cable 517 and the head 540 executes discharge of the ink based on a control signal from the control section 510.

In the present embodiment, the holder 60 is provided in the cartridge 520 and the cartridge 20 is mounted above the cartridge 520. Such a printer is referred to as an on-carriage printer. In other embodiments, the holder 60 may be provided in a portion which is different to the carriage 520 and the ink may be supplied from the cartridge 20 to the head 540 above the carriage 520 via a flexible tube. Such a type of printer is referred to as an off-carriage type.

In the present embodiment, the printer 50 is provided with a main scanning and feeding mechanism and a sub scanning and feeding mechanism for realizing printing with regard to the printing medium 90 by relatively moving the carriage 520 and the printing medium 90. The main scanning and feeding mechanism of the printer 50 is provided with a carriage motor 522 and a driving belt 524, and the carriage 520 is moved so as to reciprocate in the main scanning direction by motive force from the carriage motor 522 being transferred to the carriage 520 via the driving belt 524. The sub scanning and feeding mechanism of the printer 50 is provided with a transport motor 532 and a platen 534, and the printing medium 90 is transported in the sub scanning direction which is orthogonal to the main scanning direction by motive force from the transport motor 532 being transferred to the platen 534. The carriage motor 522 of the main scanning and feeding mechanism and the transport motor 532 of the sub scanning and feeding mechanism are operated based on control signals from the control section 510.

In the present embodiment, in the usage state of the printing material supply system 10, an axis along the sub scanning direction where the printing medium 90 is transported is set as the X axis, an axis along the main scanning direction where the carriage 520 is moved so as to reciprocate is set as the Y axis, and an axis along the direction of gravity is set as the Z axis. The X axis, the Y axis, and the Z axis are orthogonal to each other. Here, the usage state of the printing material supply system 10 is a state of the printing material supply system 10 which is arranged on a horizontal surface, and in the present embodiment, the horizontal surface is a surface which is parallel to the X axis and the Y axis.

In the present embodiment, the +X axial direction is toward the sub scanning direction and the opposite is the −X axial direction, and the +Z axial direction is from below to above in the direction of gravity and the opposite is the −Z axial direction. In the present embodiment, the +X axial direction side is the front surface of the printing material supply system 10. In the present embodiment, the +Y axial direction is toward the left side surface from the right side surface of the printing material supply system 10 and the opposite is the −Y axial direction. In the present embodiment, the alignment direction of the plurality of cartridges 20 which are mounted in the holder 60 is a direction along the Y axis.

A-2. Configuration where Cartridge is Mounted in Holder

Figure 2:
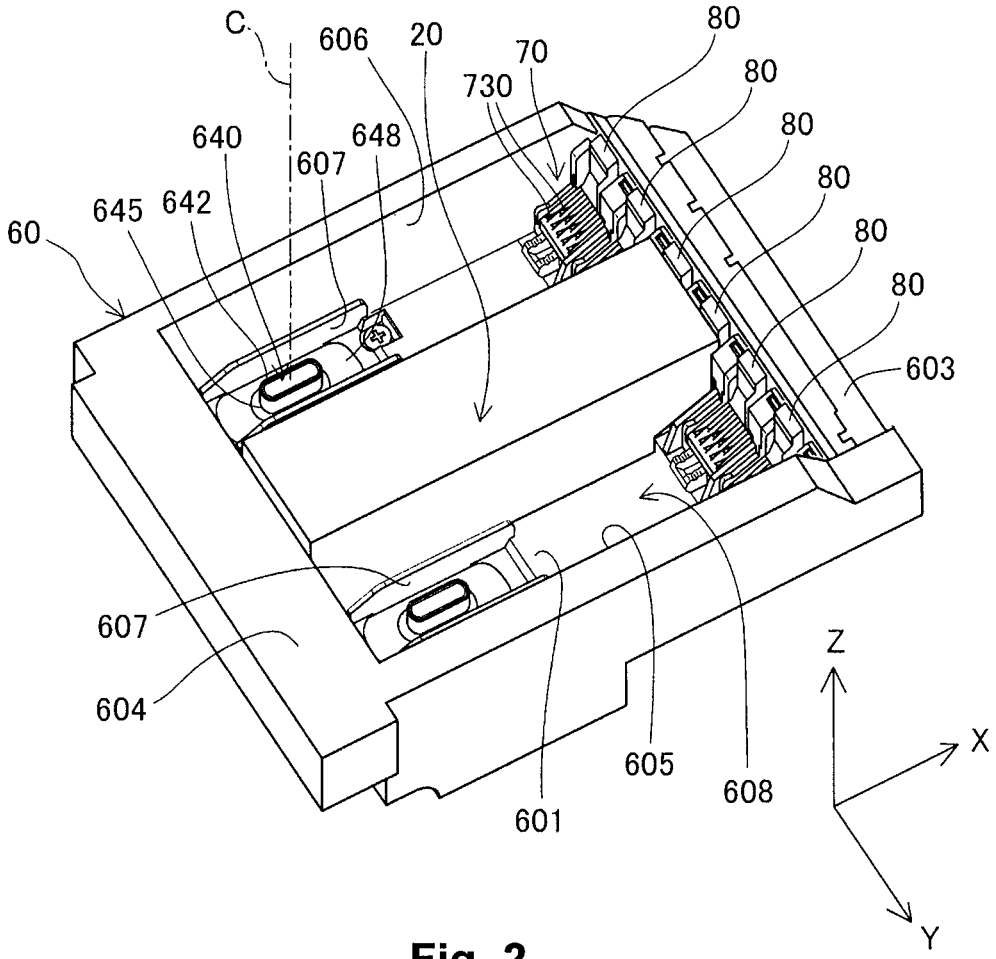
FIG. 2 is a perspective diagram illustrating a holder where a cartridge is mounted.
Figure 3:
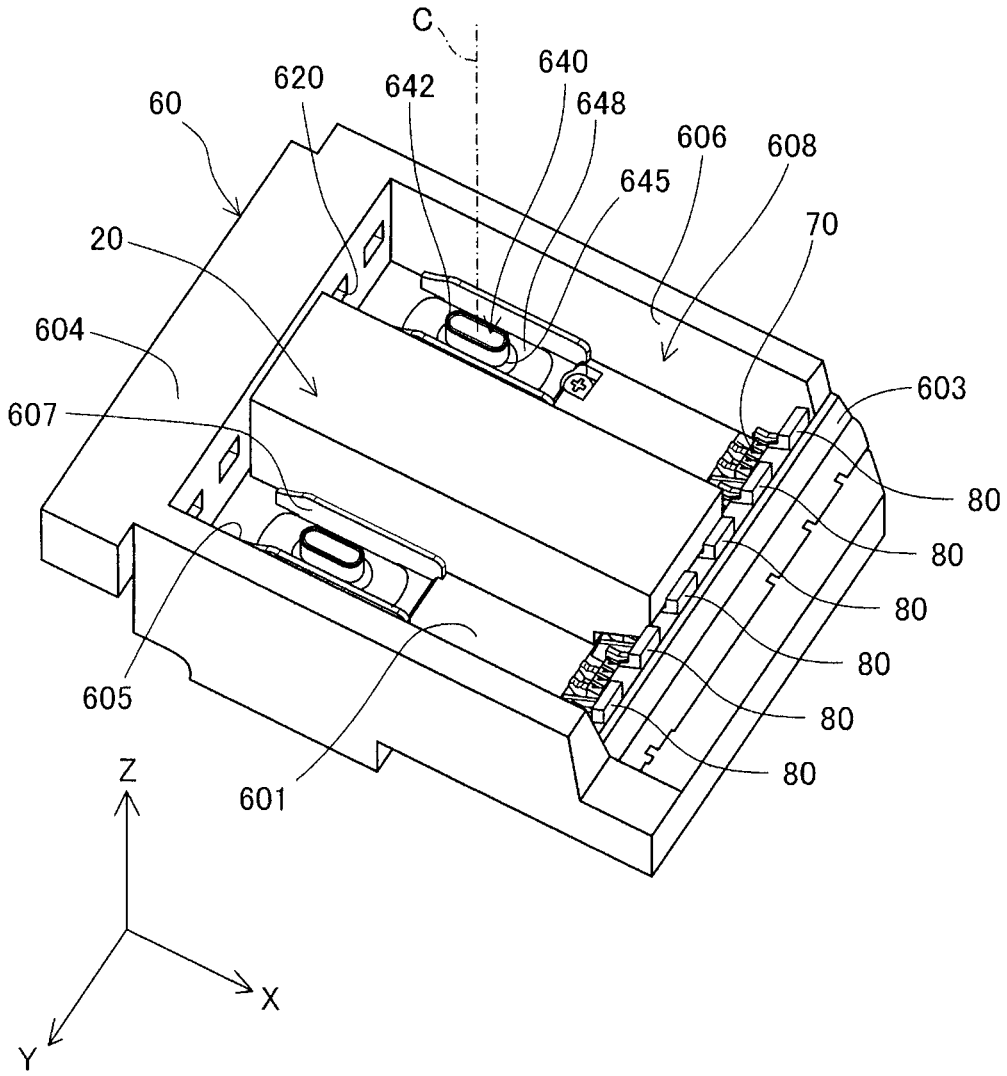
FIG. 3 is a perspective diagram illustrating a holder where a cartridge is mounted.
Figure 4:
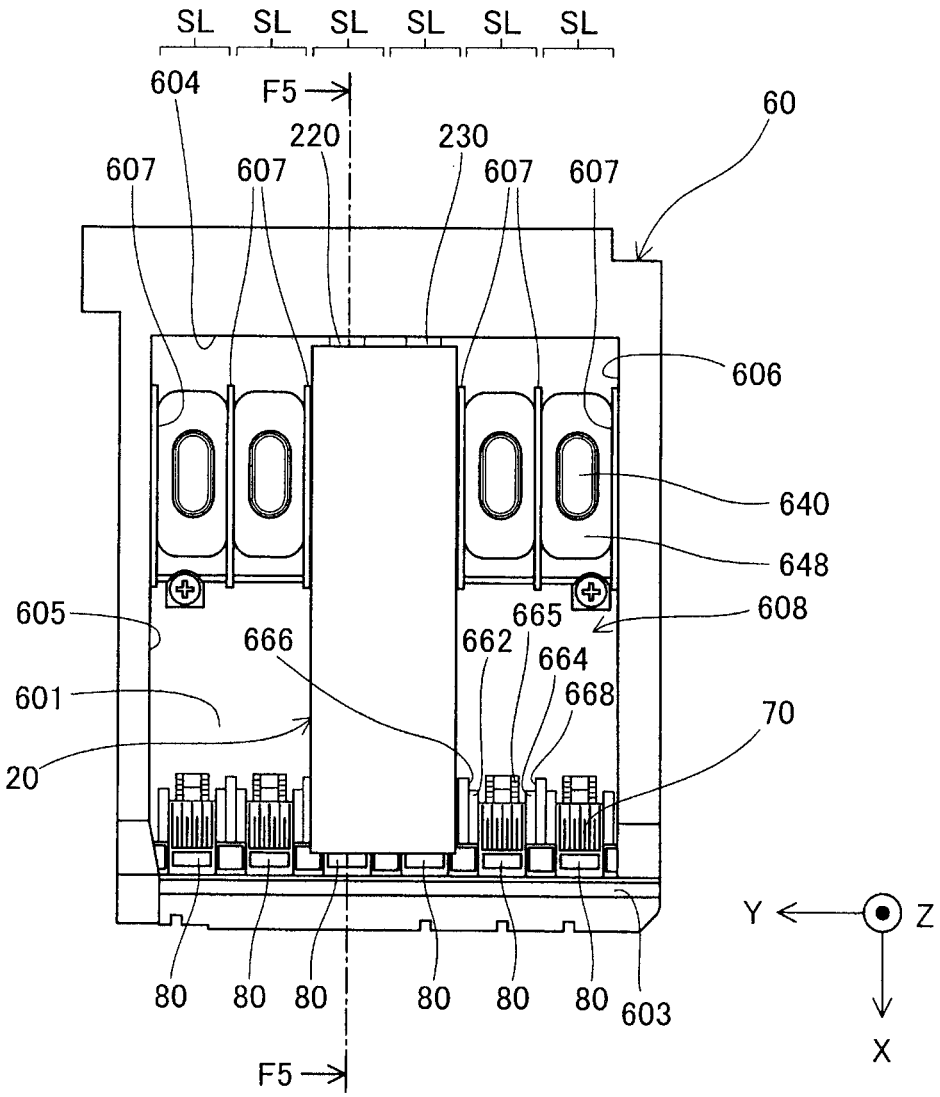
FIG. 4 is an upper surface diagram illustrating a holder where a cartridge is mounted.
Figure 5:
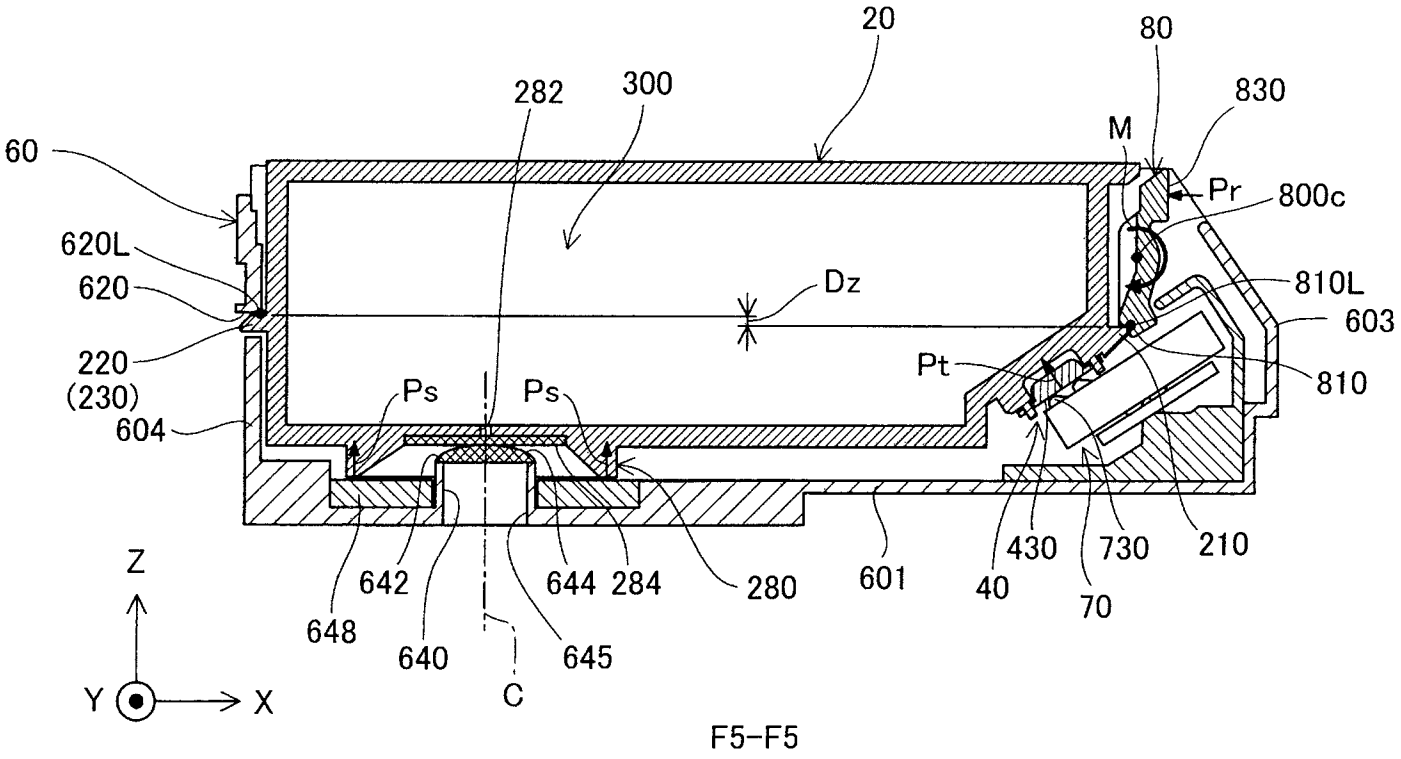
FIG. 5 is a cross-sectional diagram illustrating a holder, where a cartridge is mounted, cut along an arrow F5-F5 in FIG. 4.
Figure 6:
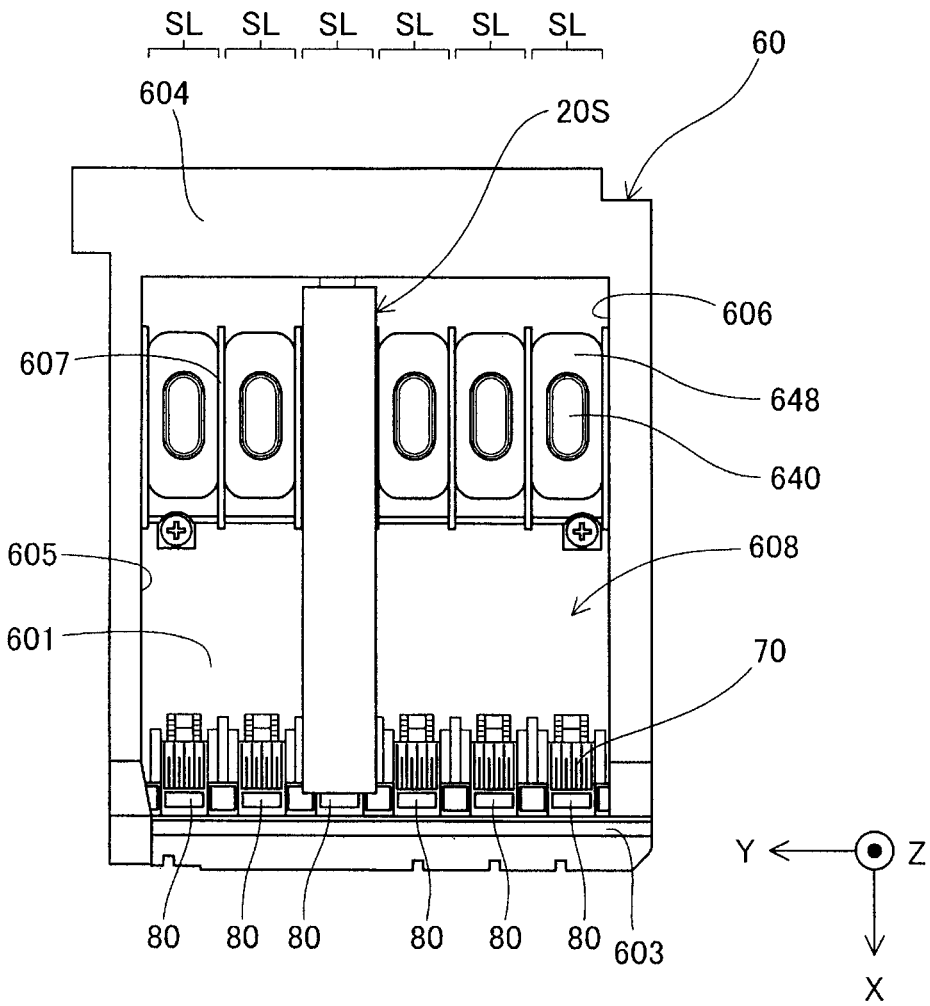
FIG. 6 is an upper surface diagram illustrating a holder where a different cartridge is mounted.

FIG. 2 and FIG. 3 are perspective diagrams illustrating the holder 60 where the cartridge 20 is mounted. FIG. 4 is an upper surface diagram illustrating the holder 60 where the cartridge 20 is mounted. FIG. 5 is a cross-sectional diagram illustrating the holder 60, where the cartridge 20 is mounted, cut along an arrow F5-F5 in FIG. 4. FIG. 6 is an upper surface diagram illustrating the holder 60 where a different cartridge 20S is mounted. A state is illustrated in FIG. 2 to FIG. 5 where one of the cartridges 20 is correctly mounted in a designed mounting position in the holder 60. A state is illustrated in FIG. 6 where one of the cartridges 20S is correctly mounted in a designed mounting position in the holder 60.

The holder 60 of the printer 50 has a wall section 601, a wall section 603, a wall section 604, a wall section 605, a wall section 606, and the five wall sections form a cartridge mounting space 608 which is a space for receiving the cartridge 20. The wall section 601 defines the −Z axial direction side of the cartridge mounting space 608. The wall section 603 defines the +X axial direction side of the cartridge mounting space 608. The wall section 604 defines the −X axial direction side of the cartridge mounting space 608. The wall section 605 defines the +Y axial direction side of the cartridge mounting space 608. The wall section 606 defines the −Y axial direction side of the cartridge mounting space 608.

The printer 50 is provided with a plurality of ink supply pipes (printing material supply pipes) 640 in the cartridge mounting space 608 of the holder 60. The plurality of ink supply pipes 640 are provided to extend toward the +Z axial direction from the wall section 601.

A partition plate 607 is provided to extend between the two of the ink supply pipes 640 which are adjacent to each other out of the plurality of ink supply pipes 640. In the present embodiment, in addition to between the two of the ink supply pipes 640 which are adjacent to each other, the partition plates 607 are provided at both ends of the lineup of the plurality of ink supply pipes 640 (that is, the +Y axial direction side and the −Y axial direction side). In the present embodiment, the partition plate 607 is a member with a plate shape parallel to the ZX plane which passes through the Z axis and the X axis. In the present embodiment, the partition plate 607 extends from the wall section 601 in the +Z axial direction. In the present embodiment, the partition plate 607 extends in the +Z axial direction side with respect to a tip end section 642 of the ink supply pipe 640. In the present embodiment, the length of the partition plate 607 along the X axis is larger than the length of the ink supply pipe 640 along the X axis.

As shown in FIG. 4 and FIG. 6, the cartridge mounting space 608 is divided into a plurality of slots SL for each of the ink supply pipes 640 by the partition sections 607. In the present embodiment, as shown in FIG. 4, it is possible to mount one of the cartridges 20 in two of the slots SL which are adjacent to each other. As shown in FIG. 6, other than the cartridge 20, the holder 60 is configured so that it is possible to mount the cartridge 20S where the width of the cartridge 20 in the Y axial direction has been substantially halved, and it is possible to mount one of the cartridges 20S in each of the slots SL. As shown in FIG. 2 to FIG. 5, in addition to the ink supply pipes 640, the printer 50 is provided with a terminal platform 70, a lever 80, a terminal platform side fastening section 810, a supply pipe side fastening section 620, and engaging sections 662, 664, 665, 666, and 668 in each of the slots SL in the holder 60.

As shown in FIG. 4 and FIG. 5, the cartridge 20 is provided with a circuit substrate 40, a substrate side fastening section 210, supply port side fastening sections 220 and 230, two ink supply ports (printing material supply ports) 280, an ink containing section (a printing material containing section) 300 to match with the two slots SL which are adjacent to each other in the holder 60. FIG. 5 schematically illustrates the ink containing section 300. The details of the ink containing section 300 will be described later.

In the present embodiment, an ink flow path 282 is formed to be linked in common with the ink containing section 300 in each of the two ink supply ports 280 of the cartridge 20 and it is possible for the ink to be supplied from the ink containing section 300 to the outside of the cartridge 20 via the ink flow path 282. In the present embodiment, a leakage preventing member 284, which prevents unintentional leakage of the ink from the ink flow path 282, is provided at an exit port side of the ink flow path 282 in each of the ink supply ports 280.

The ink supply pipe 640 of the printer 50 is configured so that it is possible for ink to be supplied from the ink containing section 300 of the cartridge 20 to the head 540 by being connected to the ink supply port 280 of the cartridge 20. The ink supply pipe 640 has the tip end section 642 which is connected to the cartridge side. A base end section 645 of the ink supply pipe 640 is provided at the wall section 601 which is the bottom surface of the holder 60. In the present embodiment, as shown in FIG. 5, a central axis C of the ink supply pipe 640 is parallel to the Z axis and a direction, which is from the base end section 645 of the ink supply pipe 640 toward the tip end section 642 along the central axis C, is the +Z axial direction.

In the present embodiment, a porous filter 644 which filters the ink from the cartridge 20 is provided in the tip end section 642 of the ink supply pipe 640. As the porous filter 644, for example, it is possible to use a stainless steel mesh, a stainless steel non-woven fabric, or the like. In other embodiments, the porous filter may be omitted from the tip end section 642 of the ink supply pipe 640.

In the present embodiment, an elastic member 648, which prevents leakage of the ink from the ink supply port 280 to the surroundings by tightly sealing the ink supply port 280 of the carriage 20, is provided in the surroundings of the ink supply pipe 640 as shown in FIG. 2 to FIG. 5. A pressing force Ps which includes components in the +Z axial direction is imparted from the elastic member 648 with regard to the ink supply port 280 in the cartridge 20 in a state of being mounted in the holder 60.

As shown in FIG. 5, the terminal platform 70 of the printer 50 is provided on the +X axial direction side with respect to the ink supply pipe 640. Device side terminals 730 are provided in the terminal platform 70 so as to be electrically connected to cartridge side terminals 430 which are provided in the circuit substrate 40 of the cartridge 20. A pressing force Pt which includes components in the +Z axial direction is imparted from the terminal platform 70 with regard to the circuit substrate 40 in the cartridge 20 in a state of being mounted in the holder 60.

The terminal platform side fastening section 810 in the printer 50 is provided in the wall section 603 of the holder 60 as a portion of the lever 80 and fastens to the substrate side fastening section 210 at a first fastening position 810L. The first fastening position 810L is positioned on the +Z axial direction side and the +X axial direction side with respect to a position where the circuit substrate 40 and the terminal platform 70 come into contact. The terminal platform side fastening section 810 limits movement of the cartridge 20 in the +Z axial direction by fastening to the substrate side fastening section 210.

The supply pipe side fastening section 620 in the printer 50 is provided in the wall section 604 of the holder 60 and is configured to fasten to the supply port side fastening sections 220 and 230 at a second fastening position 620L. The second fastening position 620L is positioned on the +Z axial direction side and the −X axial direction side with respect to the ink supply pipe 640. The supply pipe side fastening section 620 limits movement of the cartridge 20 in the +Z axial direction by fastening to the supply port side fastening sections 220 and 230.

Attaching and detaching of the cartridge 20 is performed while the cartridge 20 is rotated along a plane which is parallel to the Z axis and the X axis with the vicinity of the supply port side fastening section 220 and the supply pipe side fastening section 620 as a rotation pivot during attaching and detaching of the cartridge 20 with regard to the holder 60.

The lever 80 of the printer 50 has a rotation pivot 800*c* on the +Z axial direction side and the +X axial direction side with respect to the first fastening position 810L where the terminal platform side fastening section 810 is fastened to the substrate side fastening section 210. Therefore, a rotation moment M is generated in a direction shown in FIG. 5 in the lever 80 when the cartridge 20 attempts to move in the +Z axial direction. As a result, it is possible to prevent unintentional releasing of the fastening of the substrate side fastening section 210 due to the terminal platform side fastening section 810.

The lever 80 is configured such that fastening and releasing of the fastening to the substrate side fastening section 210 using the terminal platform side fastening section 810 is possible due to the rotation of the lever 80 which moves the terminal platform side fastening section 810 from the first fastening location 810L in the +X axial direction. In the present embodiment, an operation section 830, which is configured so that it is possible to receive an operation force Pr toward the −X axial direction due to the user, is formed in the lever 80 on the +Z axial direction side and the +X axial direction side with respect to the rotation pivot 800*c*. When the operation force Pr is imparted to the operation section 830 by the user, the fastening of the substrate side fastening section 210 using the terminal platform side fastening section 810 is released by the lever 80 being rotated so that the terminal platform side fastening section 810 moves from the first fastening location 810L in the +X axial direction. Consequently, it is possible for the cartridge 20 to be removed from the holder 60.

As shown in FIG. 5, in a state where the cartridge 20 is mounted in the holder 60, the first fastening position 810L is positioned on the −Z axial direction side with respect to the second fastening position 620L with a distance Dz. Therefore, the pressing forces Ps and Pt from the holder 60 with regard to the cartridge 20 act in a direction which strengthens the fastening of the substrate side fastening section 210 and the terminal platform side fastening section 810 (a direction which includes +X axial components and +Z axial components) due to a relationship of balancing the moment with the second fastening position 620L as the rotation pivot of the cartridge 20. Consequently, it is possible to stably maintain the cartridge 20 in the designed mounting position.

The engaging sections 662, 664, 665, 666, and 668 of the printer 50 engage with each section of the cartridge 20. Consequently, it is possible to prevent positional deviation of the circuit substrate 40 with regard to the holder 60 in the Y axial direction and it is possible for the cartridge side terminals 430 to come into contact with the device side terminals 730 in the correct position.

A-3. Detailed Configuration of Cartridge

Figure 7:
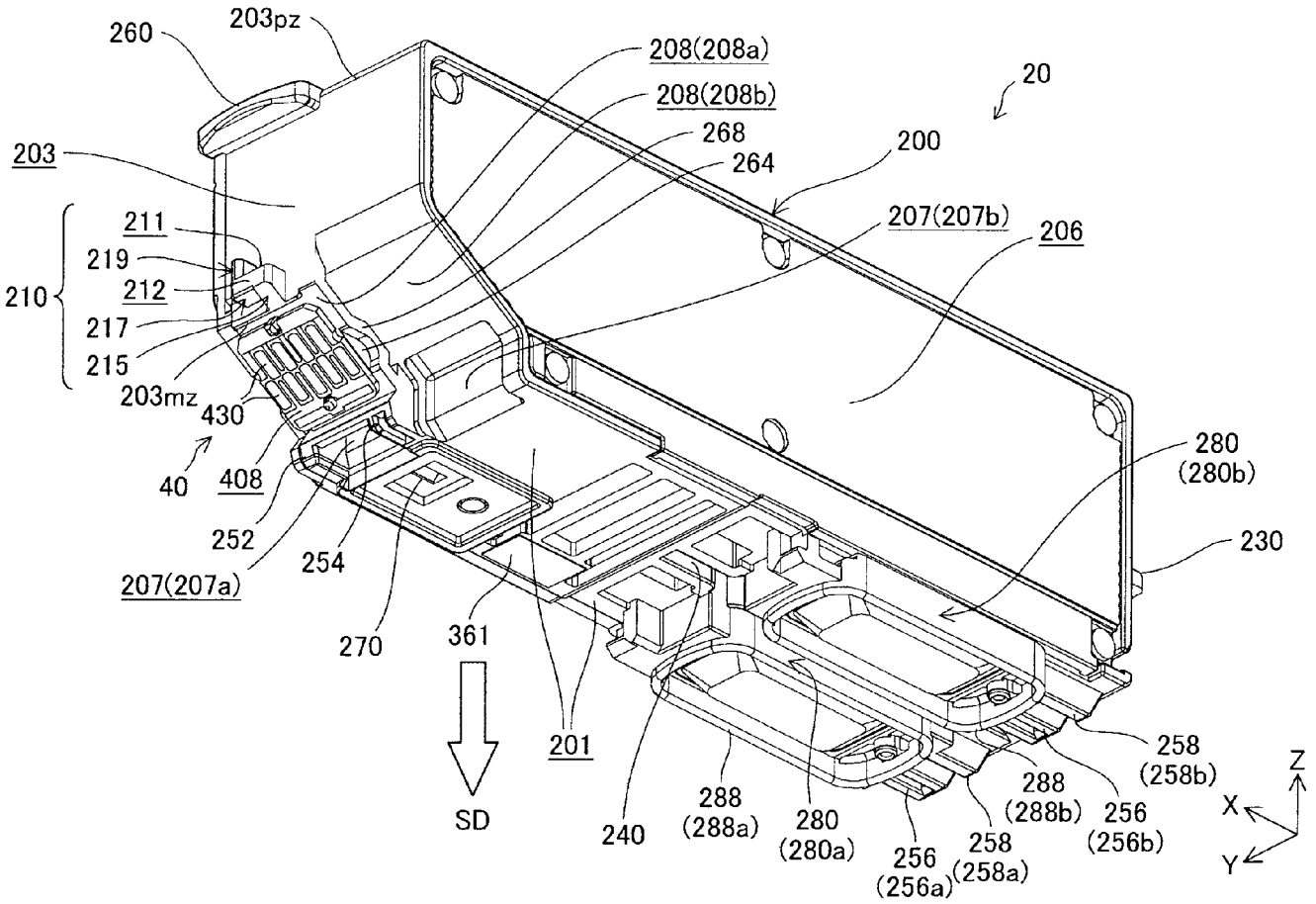
FIG. 7 is a perspective diagram illustrating a configuration of a cartridge.
Figure 8:
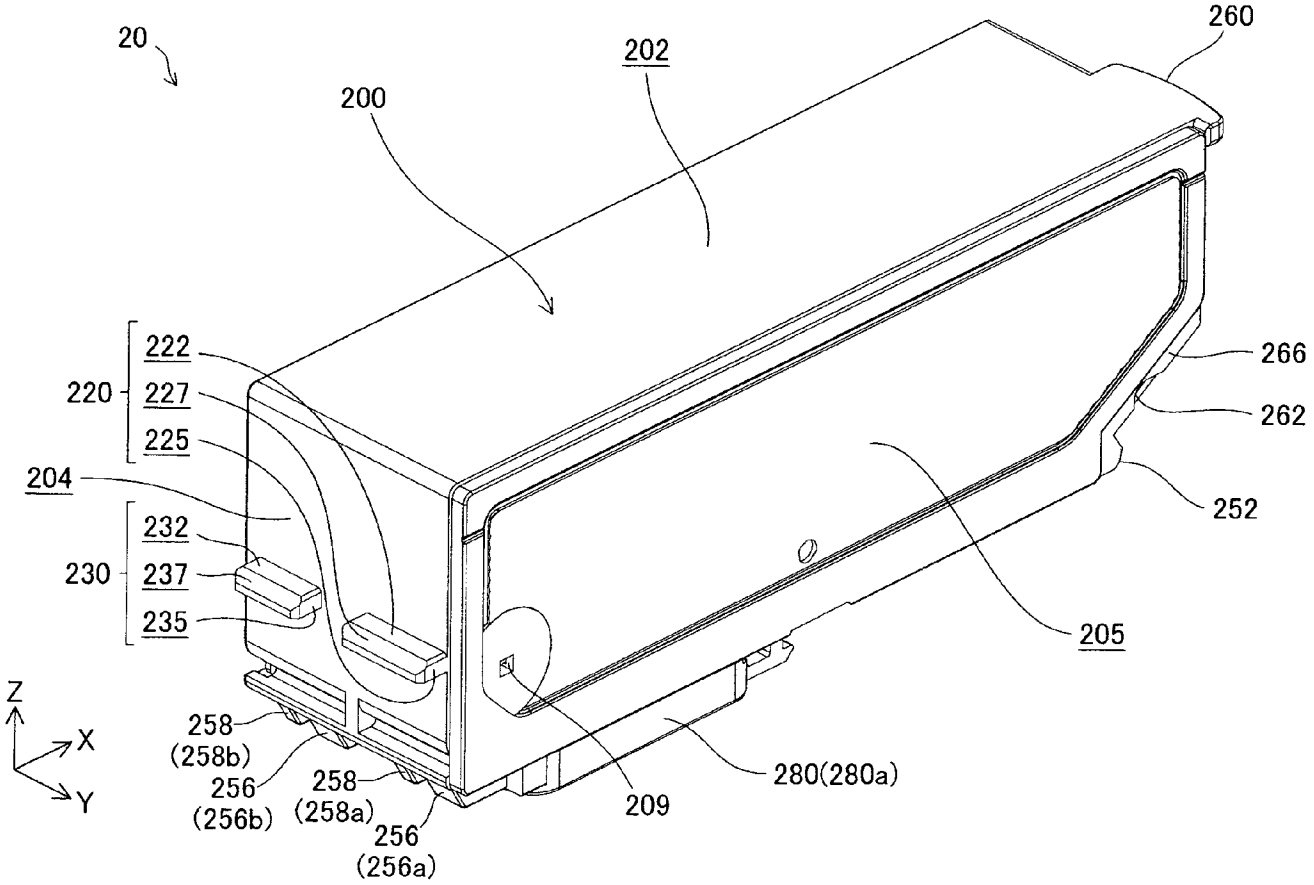
FIG. 8 is a perspective diagram illustrating a configuration of a cartridge.
Figure 9:
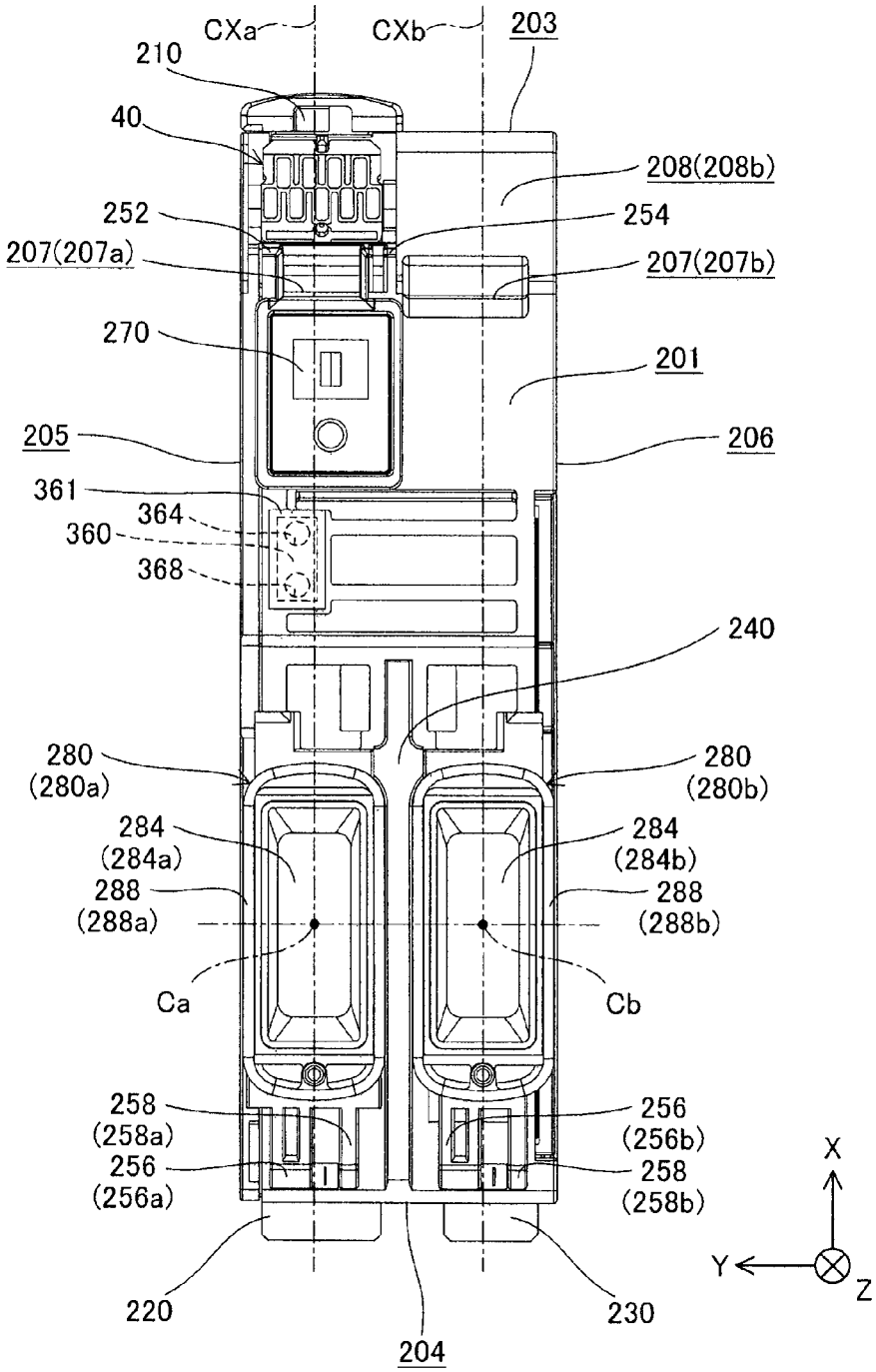
FIG. 9 is a bottom surface diagram illustrating a configuration of a cartridge.
Figure 10:
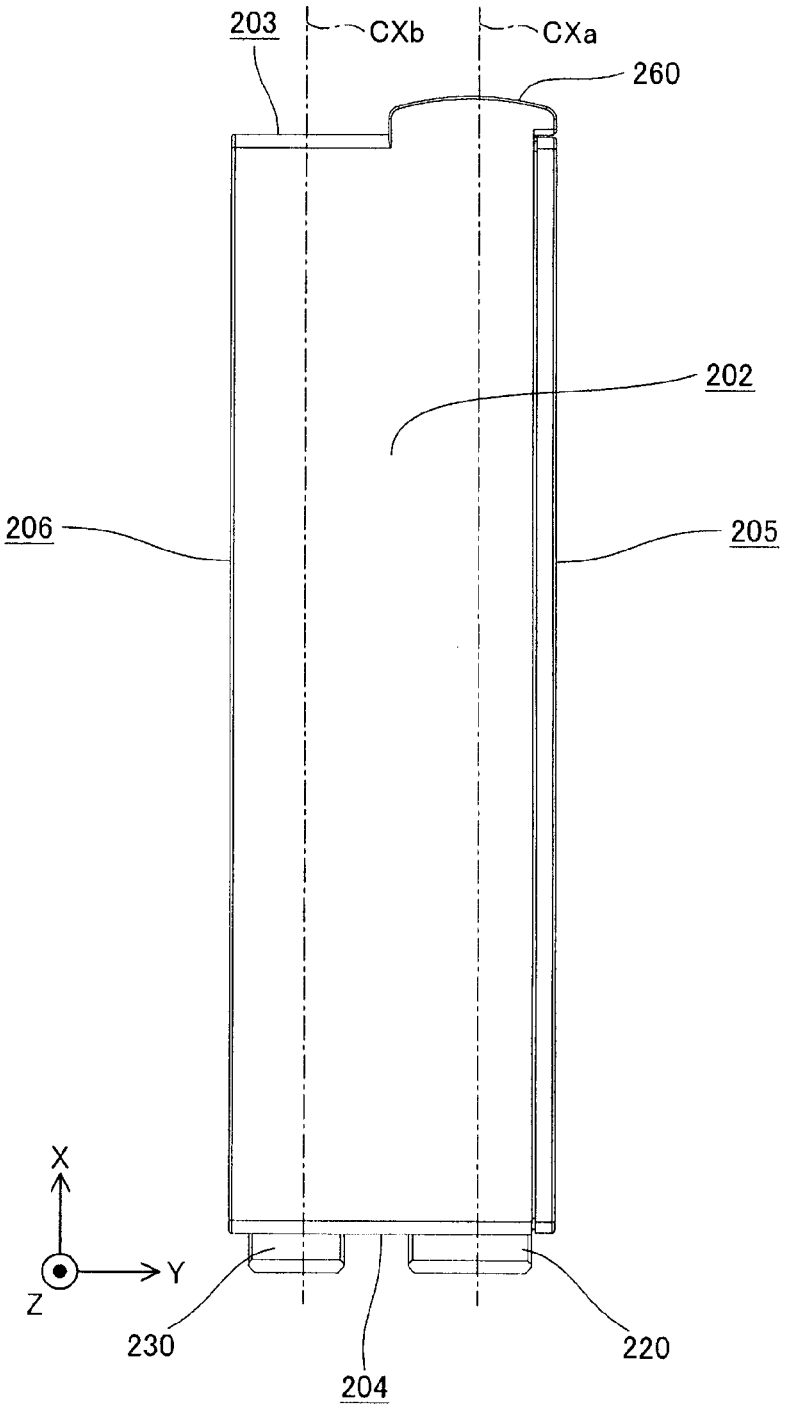
FIG. 10 is an upper surface diagram illustrating a configuration of a cartridge.
Figure 11:
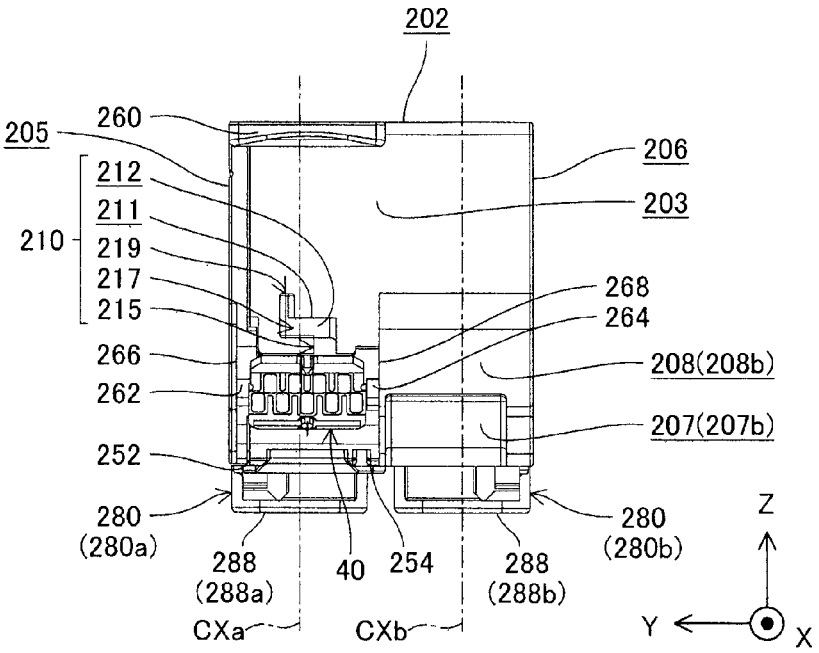
FIG. 11 is a front surface diagram illustrating a configuration of a cartridge.
Figure 12:
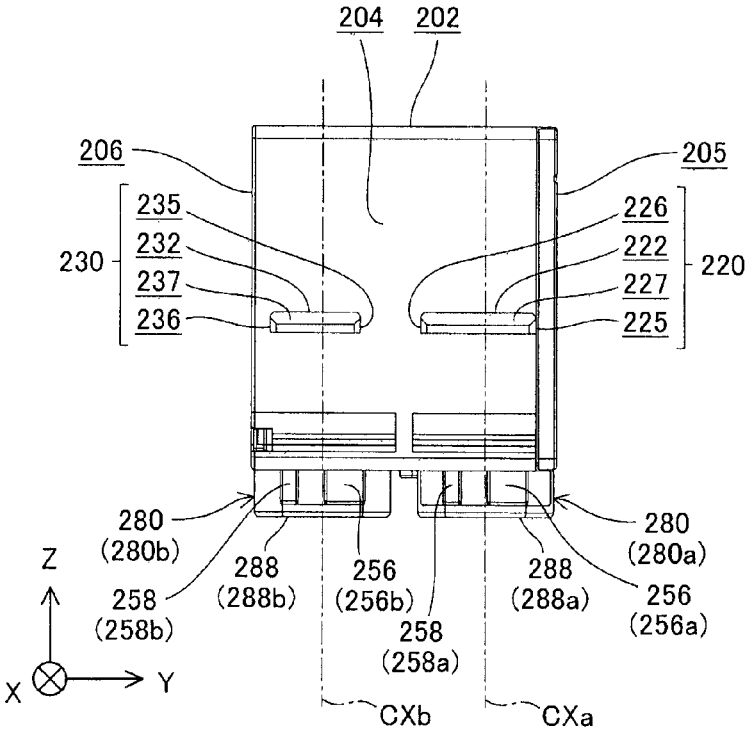
FIG. 12 is a rear surface diagram illustrating a configuration of a cartridge.
Figure 13:
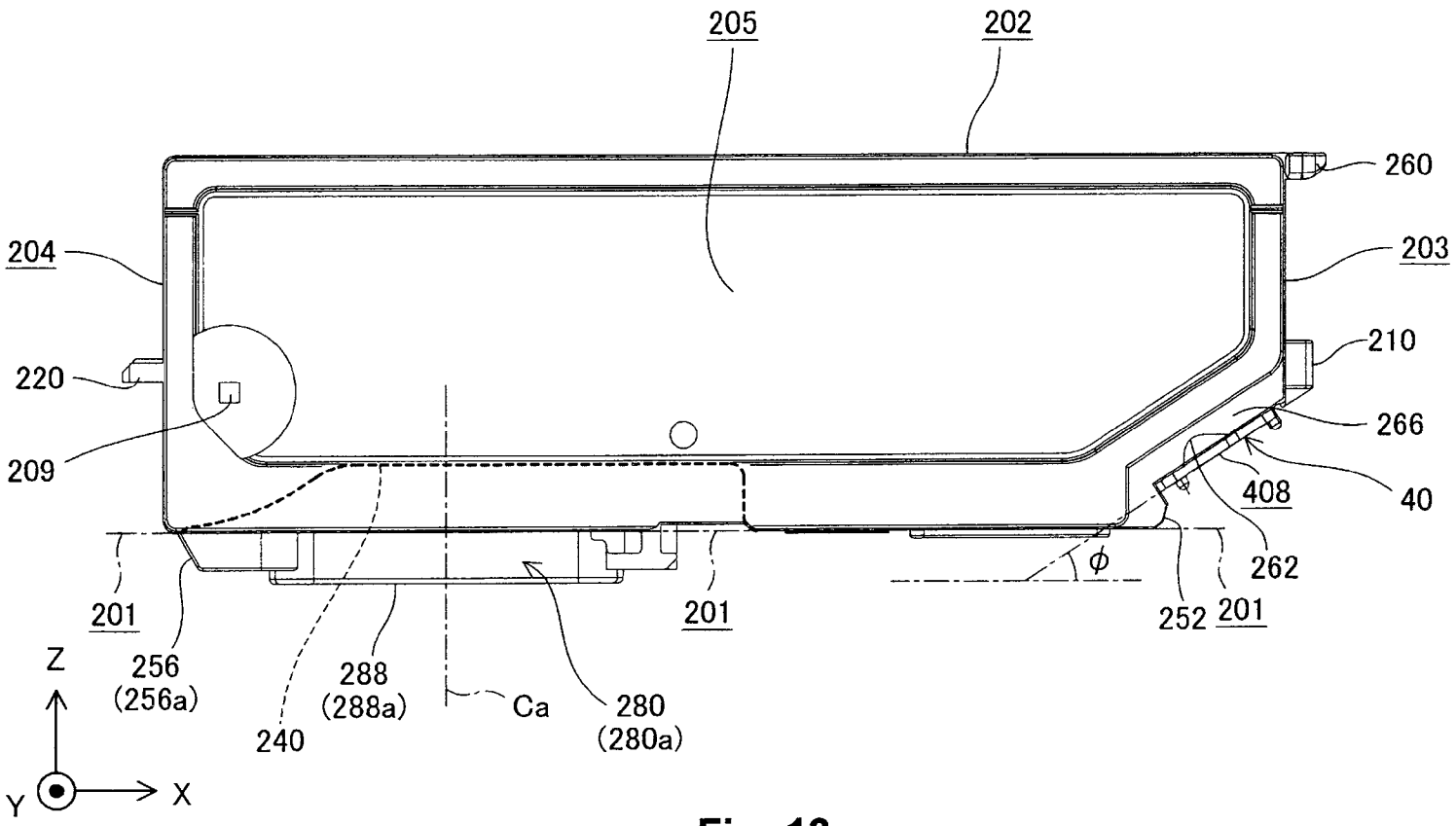
FIG. 13 is a left side surface diagram illustrating a configuration of a cartridge.
Figure 14:
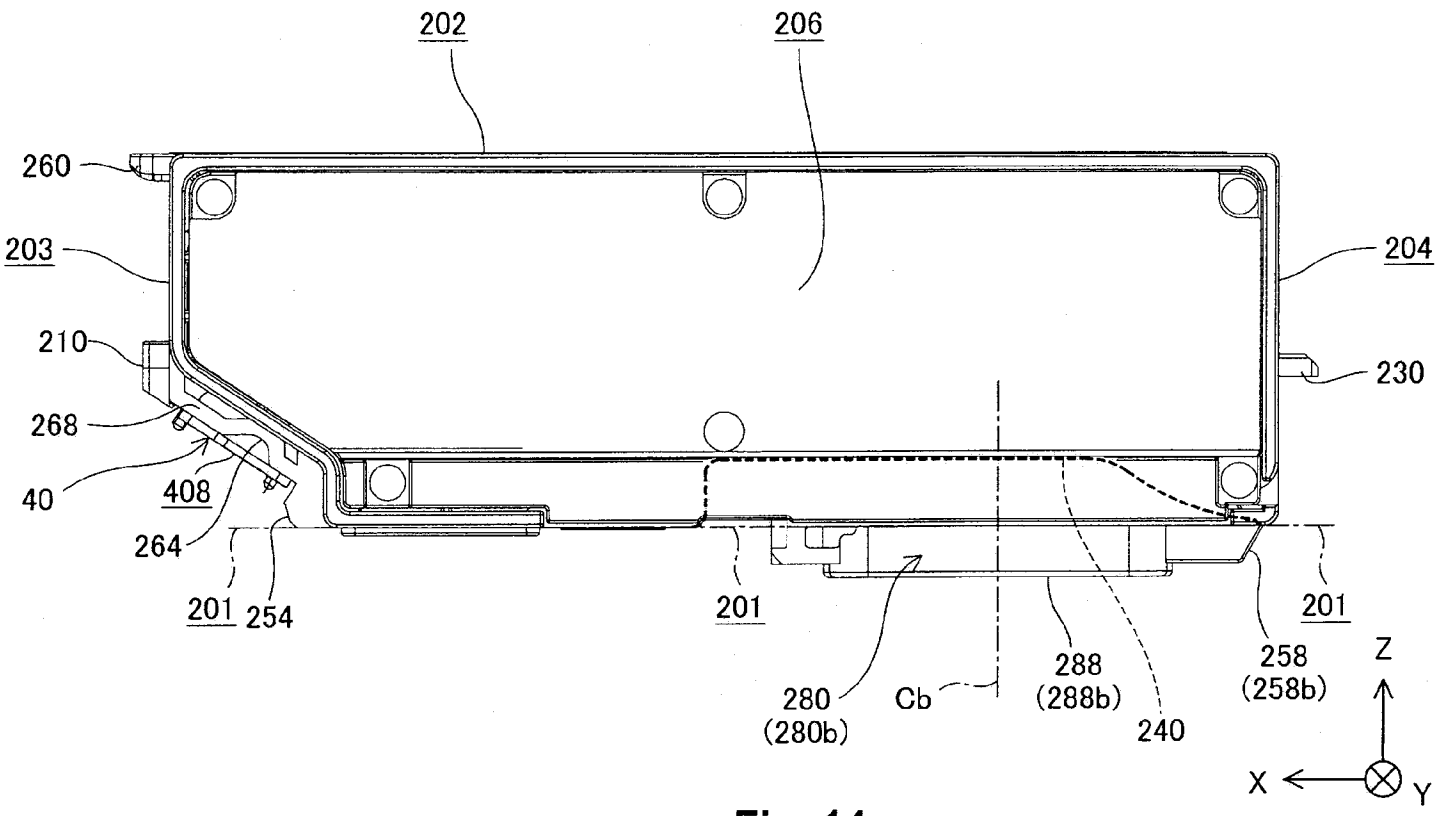
FIG. 14 is a right side surface diagram illustrating a configuration of a cartridge.
Figure 15:
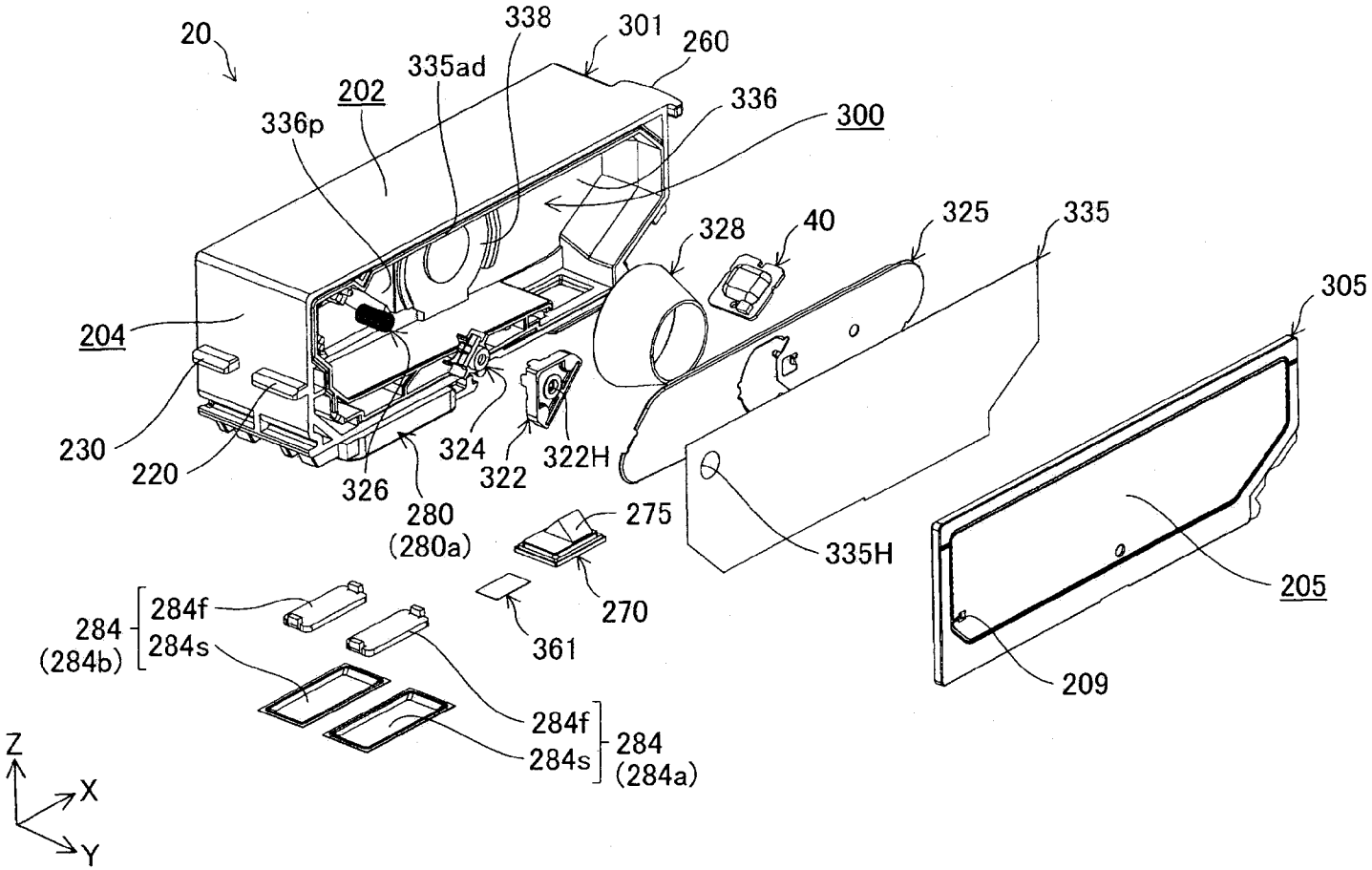
FIG. 15 is an exploded perspective diagram illustrating a configuration of a cartridge.
Figure 16:
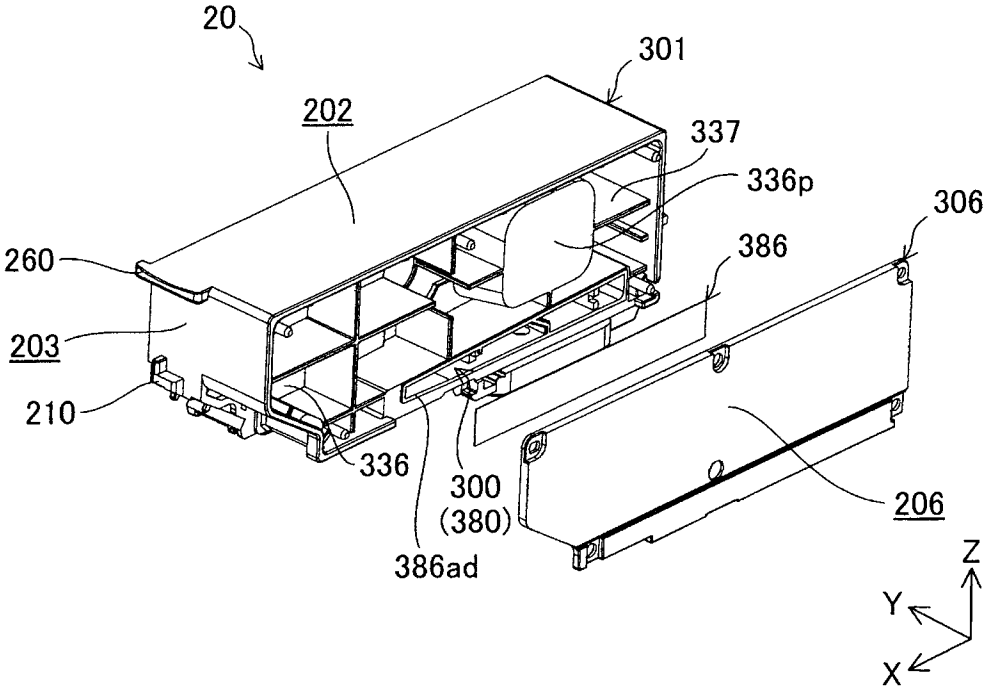
FIG. 16 is an exploded perspective diagram illustrating a configuration of a cartridge.

FIG. 7 and FIG. 8 are perspective diagrams illustrating the configuration of the cartridge 20. FIG. 9 is a bottom surface diagram illustrating the configuration of the cartridge 20. FIG. 10 is an upper surface diagram illustrating the configuration of the cartridge 20. FIG. 11 is a front surface diagram illustrating the configuration of the cartridge 20. FIG. 12 is a rear surface diagram illustrating the configuration of the cartridge 20. FIG. 13 is a left side surface diagram illustrating the configuration of the cartridge 20. FIG. 14 is a right side surface diagram illustrating the configuration of the cartridge 20. FIG. 15 and FIG. 16 are exploded perspective diagrams illustrating the configuration of the cartridge 20.

In the explanation of the cartridge 20, the X axis, the Y axis, and the Z axis are axes on the cartridge with regard to the cartridge 20 which is in the mounting state of being mounted in the holder 60. In the present embodiment, the +X axial direction side is the front surface of the cartridge 20 in the mounting state where the cartridge 20 is mounted in the holder 60. In the present embodiment, a mounting direction SD when the cartridge 20 is mounted in the holder 60 is the −Z axial direction.

In the explanation of the present embodiment, a reference numeral "280" is used in cases where both of the two ink supply ports 280 in the cartridge 20 are being referred to, a reference numeral "280*a*" is used in cases indicating the ink supply port on the +Y axial direction side, and a reference numeral "280*b*" is used in cases indicating the ink supply port on the −Y axial direction side.

A central axis Ca shown in FIG. 9 and FIG. 13 corresponds to the central axis C of the ink supply pipe 640 which is connected to the ink supply port 280*a* in the mounting state where the cartridge 20 is mounted in the holder 60, and in the present embodiment, is the central axis of the ink supply port 280*a*. A plane CXa shown in FIG. 9 to FIG. 12 is a plane which passes through the central axis Ca and which is parallel to the Z axis and the X axis. That is, the plane CXa is a plane which passes through the center of the length along the Y axis of the ink supply port 280*a* and is orthogonal to the Y axis.

A central axis Cb shown in FIG. 9 and FIG. 14 corresponds to the central axis C of the ink supply pipe 640 which is connected to the ink supply port 280*b*, and in the present embodiment, is the central axis of the ink supply port 280*b*. A plane CXb shown in FIG. 9 to FIG. 12 is a plane which passes through the central axis Cb and which is parallel to the Z axis and the X axis. That is, the plane CXb is a plane which passes through the center of the length along the Y axis of the ink supply port 280*b* and is orthogonal to the Y axis. In the explanation of the present embodiment, a reference numeral "CX" is used in cases where both of the plane CXa and the plane CXb are being referred to.

As shown in FIG. 7 to FIG. 14, the cartridge 20 is provided with an outer shell 200 with a cuboid as a basis. The cartridge 20 has a first surface 201, a second surface 202, a third surface 203, a fourth surface 204, a fifth surface 205, and a sixth surface 206 as six wall sections which configure the outer shell 200. In the present embodiment, the cartridge 20 has a seventh surface 207 and an eighth surface 208 along with the six of the first surface 201 to the sixth surface 206. As shown in FIG. 15, the ink containing section 300 is formed at the inner side of the first surface 201 to the eighth surface 208.

The first surface 201 to the eighth surface 208 are formed substantially as flat surfaces, it is not necessary for the entire area of the surface to be completely flat, and there may be bumps on a portion of the surface. In the present embodiment, the first surface 201 to the eighth surface 208 are the outer surfaces of an assembly which is assembled from a plurality of members.

In the present embodiment, comparing the length (length in the X axial direction), the width (length in the Y axial direction), and the height (length in the Z axial direction) of the cartridge 20 in terms of the size, the length is larger than the height, and the height is larger than the width. It is possible to arbitrarily change the size relationship of the length, the width, and the height of the cartridge 20. For example, the height may be larger than the length, and the length may be larger than the width. Alternatively, the height, the length, and the width may be the same.

The first surface 201 and the second surface 202 of the cartridge 20 are surfaces which are parallel to the X axis and the Y axis and have a positional relationship so as to oppose each other in the Z axial direction. The first surface 201 is positioned on the −Z axial direction side and the second surface 202 is positioned on the +Z axial direction side. The first surface 201 and the second surface 202 have a positional relationship so as to intersect with the third surface 203, the fourth surface 204, the fifth surface 205, and the sixth surface 206. Here, in this specification, the "intersecting" of two surfaces means any of a state where two surfaces intersect by being linked to each other, a state where an extended surface of one of the surfaces intersects with the other surface, and a state where extended surfaces intersect with each other. In the present embodiment, the first surface 201 configures the bottom surface of the cartridge 20 and the second surface 202 configures the upper surface of the cartridge 20 in the mounting state where the cartridge 20 is mounted in the holder 60.

The two ink supply ports 280 are formed in the first surface 201 as shown in FIG. 7 and FIG. 9. Each of the ink supply ports 280 protrude from the first surface 201 in the −Z axial direction and have opening edges 288 with an opening in a surface which is parallel to the X axis and the Z axis in an edge section in the −Z axial direction. In the explanation of the present embodiment, a reference numeral "288" is used in cases where both of the opening edges of the ink supply ports 280 are being referred to, a reference numeral "288*a*" is used in cases indicating the opening edge of the ink supply port 280*a*, and a reference numeral "288*b*" is used in cases indicating the opening edge of the ink supply port 280*b*.

In the present embodiment, the opening edges 288 of the ink support ports 280 are sealed by a sealing member (not shown) such as a cap or a film during shipping of the cartridge 20 from the factory. After this, the sealing member (not shown) which seals the opening edge 288 is removed from the cartridge 20 during mounting of the cartridge 20 with regard to the holder 60.

In the present embodiment, as shown in FIG. 9, the leakage preventing members 284 are provided in an inner side in the +Z axial direction side from the opening edges 288 at the inner side of the ink supply ports 280. In the present embodiment, as shown in FIG. 15, the leakage preventing member 284 includes a porous member 284*f* and a sheet member 284*s* made of synthetic resin (for example, polyethylene terephthalate). In the explanation of the present embodiment, the leakage preventing member "284" is used in cases where the leakage preventing members of the ink supply ports 280 are being referred to, a reference numeral "284*a*" is used in cases indicating the leakage preventing member of the ink supply port 280*a*, and a reference numeral "284*b*" is used in cases indicating the leakage preventing member of the ink supply port 280*b*.

In the present embodiment, the ink supply ports 280 of the cartridge 20 protrude in the −Z axial direction with the central axis C of the ink supply pipe 640 in the holder 60 as the center, but in other embodiments, the center of the ink supply port 280 may deviate from the central axis C of the ink supply pipe 640. In the present embodiment, the opening edges 288 of the ink supply ports 280 viewed from the −Z axial direction to the +Z axial direction has line symmetrical contours with regard to axes which are respectively parallel to the X axis and the Y axis, but in other embodiments, there may be contours which are not symmetrical. In the present embodiment, the shape of the opening edge 288 viewed from the Z axial direction is a shape where the corners of a rectangle have been rounded as shown in FIG. 9, but in other embodiments, it may be a shape such as a circle, an ellipse, an oval, a square, or a rectangle.

As shown in FIG. 7, FIG. 9, FIG. 13, and FIG. 14, a groove section 240 is provided between the two ink supply ports 280 in the first surface 201 in a position which corresponds to the partition plate 607 in the holder 60. As shown by the dashed line in FIG. 13 and FIG. 14, the groove section 240 is provided to be concave closer to the +Z axial direction side than the first surface 201 and is configured so that it is possible for insertion of the partition plate 607 to be received in a state where the ink supply ports 280 are connected to the ink supply pipe 640. The length of the groove section 240 along the X axis is larger than the length of the partition plate 607 along the X axis. The length of the groove section 240 along the Y axis is larger than the length of the partition plate 607 along the Y axis.

As shown in FIG. 7 and FIG. 9, an optical detection element 270 is provided in the first surface 201 in a position which cuts across the plane CXa. The detection element 270 is a structure which is configured so that it is possible to optically detect ink in the ink containing section 300 from the outside of the cartridge 20. As shown in FIG. 15, in the present embodiment, the detection element 270 includes a prism 275 which is arranged to come into contact with the ink which is contained in the ink containing section 300.

Light which is emitted toward the prism 275 from the outside of the cartridge 20 passes through the prism 275 when the vicinity of the prism 275 is filled with ink. On the other hand, the light which is emitted toward the prism 275 from the outside of the cartridge 20 is reflected by the prism 275 when there is no ink in the vicinity of the prism 275. In the present embodiment, the printer 50 receives the light which is reflected by the prism 275 using an optical sensor (not shown). In this manner, it is possible for the presence or absence of ink in the ink containing section 300 to be detected based on the presence or absence of the reflected light from the prism 275. Here, the absence of ink includes a state where only little ink remains. In the present embodiment, the printer 50 can detect the remaining amount of ink that can be supplied from each of the ink supply ports 280 based on the amount of ink consumed in the head 540 after the absence of ink is detected using the detection element 270.

The third surface 203 and the fourth surface 204 of the cartridge 20 are surfaces which are parallel to the Y axis and the Z axis and have a positional relationship so as to oppose each other in the X axial direction. The third surface 203 is positioned on the +X axial direction side and the fourth surface 204 is positioned on the −X axial direction side. The third surface 203 and the fourth surface 204 have a positional relationship so as to intersect with the first surface 201, the second surface 202, the fifth surface 205, and the sixth surface 206. In the present embodiment, the third surface 203 configures the front surface of the cartridge 20 and the fourth surface 204 configures the rear surface of the cartridge 20 in the mounting state where the cartridge 20 is mounted in the holder 60.

As shown in FIG. 7 and FIG. 11, the substrate side fastening section 210 is formed in the third surface 203 in a position which cuts across the plane CXa. The substrate side fastening section 210 is provided closer to the +Z axial direction side and the +X axial direction side than the ink supply port 280 and the circuit substrate 40. The substrate side fastening section 210 has a fastening surface 211 which faces the +Z axial direction and is configured to limit movement of the cartridge 20 in the +Z axial direction by the terminal platform side fastening section 810 which is positioned at the first fastening location 810L being fastened to the fastening surface 211 due to the rotation of the lever 80.

In the present embodiment, the substrate side fastening section 210 has a fastening surface 212 which faces the +X axial direction in addition to the fastening surface 211 which faces the +Z axial direction and is configured to limit the movement of the cartridge 20 in the +Z axial direction and the +X axial direction by the terminal platform side fastening section 810 which is positioned at the first fastening position 810L being fastened to the fastening surface 211 and the fastening surface 212 due to the rotation of the lever 80. Consequently, it is possible to maintain the cartridge 20 in the designed mounting position in a more stable state.

In the present embodiment, the substrate side fastening section 210 is a convex section which protrudes from the third surface 203 in the +X axial direction. Consequently, it is possible to easily form the substrate side fastening section 210 in the third surface 203. In addition, it is possible for the user to easily identify the substrate side fastening section 210 during mounting of the cartridge 20.

In the present embodiment, the substrate side fastening section 210 is provided closer to an edge 203 *mz* on the −Z axial direction side in the third surface 203 than an edge 203 *pz* on the +Z axial direction side in the third surface 203. In the present embodiment, due to the −Z axial direction side of the substrate side fastening section 210 being adjacent to the edge 203 *mz* on the −Z axial direction side of the third surface 203, there is an adjacent positional relationship even with regard to the circuit substrate 40 which is provided in the eighth surface. In other embodiments, the substrate side fastening section 210 may be separated from the edge 203 *mz* on the −Z axial direction side of the third surface 203 and may be closer to the edge 203 *mz* on the −Z axial direction side of the third surface 203.

In the present embodiment, the substrate side fastening section 210 has a part 215, a part 217, and a part 219 as shown in FIG. 7 and FIG. 11. The part 215 is formed in a shape which is linked to the −Z axial direction side of the part 217 and rises toward the part 217 from the third surface 203 and toward the +X axial direction side while heading toward the +Z axial direction. The part 217 is formed in a convex shape which interests with the plane CXa and which rises towards the +X axial direction from the third surface. The part 219 is formed in a convex shape which is linked to the +Z axial direction side of the part 217 and rises toward the +X axial direction side from the third surface 203. In the present embodiment, the substrate side fastening section 210 is a convex section in the shape of a letter L which protrudes from the third surface 203 with an L shape where the two sides are respectively parallel to the Y axis and the Z axis, the part 217 configures a part which is parallel to the Y axis of the convex section with the L shape, and the part 219 configures a part which is parallel to the Z axis of the convex section with the L shape.

In the present embodiment, the fastening surface 211 of the substrate side fastening section 210 is formed as a plane which faces the +Z axial direction in the part 217. That is, the fastening surface 211 is a plane which is parallel to the X axis and the Y axis. In the present embodiment, the fastening surface 212 of the substrate side fastening section 210 is formed as a plane which faces the +X axial direction in the part 217. That is, the fastening surface 212 is a plane which is parallel to the Y axis and the Z axis.

In the present embodiment, since the substrate side fastening section 210 has the part 215 adjacent in the −Z axial direction side of the part 217 where the fastening surface 211 is formed, it is possible to smoothly lead the terminal platform side fastening section 810 in the holder 60 toward the fastening surface 211 of the substrate side fastening section 210 when the cartridge 20 is mounted in the holder 60.

In the present embodiment, since the substrate side fastening section 210 has the part 219 adjacent in the +Z axial direction side of the part 217 where the fastening surface 211 is formed, it is possible to prevent the lever 80 from riding up on top of the +Z axial direction side of the fastening surface 211 when the cartridge 20 is mounted in the holder 60.

In the present embodiment, a protruding section 260 is formed in the third surface 203. The protruding section 260 is formed in a shape where the second surface 202 extends in the +X axial direction and protrudes from the third surface 203 in the +X axial direction. Since the protruding section 260 is formed in the cartridge 20, it is possible to easily perform lifting of the cartridge 20 in the +Z axial direction with the supply port side fastening section 220 as the rotation pivot by a user hooking a finger which presses the operation section 830 of the lever 80 toward the −X axial direction side as it is in the protruding section 260 when the cartridge 20 is removed from the holder 60. In other embodiments, the protruding section 260 may be omitted from the third surface 203.

As shown in FIG. 8, FIG. 9, and FIG. 12, the supply port side fastening section 220 is provided in the fourth surface 204 in a position which cuts across the plane CXa. The supply port side fastening section 220 is provided closer to the +Z axial direction side and the −X axial direction side than the ink supply port 280 and the circuit substrate 40. The supply port side fastening section 220 has a fastening surface 222 which faces the +Z axial direction and is configured to limit movement of the cartridge 20 in the +Z axial direction by the supply port side fastening section 620 in the holder 60 being fastened to the fastening surface 222.

As shown in FIG. 8, FIG. 9, and FIG. 12, the supply port side fastening section 230 is provided in the fourth surface 204 in a position which cuts across the plane CXb. The supply port side fastening section 230 is provided closer to the +Z axial direction side and the −X axial direction side than the ink supply port 280 and the circuit substrate 40. The supply port side fastening section 230 has a fastening surface 232 which faces the +Z axial direction and is configured to limit movement of the cartridge 20 in the +Z axial direction by the supply port side fastening section 620 in the holder 60 being fastened to the fastening surface 232.

In the present embodiment, the supply port side fastening sections 220 and 230 are configured so as to function as the rotation pivot of the cartridge 20 with regard to the holder 60 by being engaged with the supply pipe side fastening section 620 when mounting the cartridge 20 with regard to the holder 60. Consequently, it is possible to easily perform attaching and detaching of the cartridge 20 with regard to the holder 60.

In the present embodiment, the supply port side fastening sections 220 and 230 are convex sections which protrude to the −X axial direction from the fourth surface 204. Consequently, it is possible to easily form the supply port side fastening sections 220 and 230 in the fourth surface 204. In addition, it is possible for the user to easily identify the supply port side fastening sections 220 and 230 when mounting the cartridge 20.

In the present embodiment, the fastening surface 222 of the supply port side fastening section 220 is formed as a flat surface facing the +Z axial direction which configures a convex section which protrudes to the −X axial direction from the fourth surface 204, and the fastening surface 232 of the supply port side fastening section 230 is formed as a flat surface facing the +Z axial direction which configures a convex section which protrudes to the −X axial direction from the fourth surface 204. That is, the fastening surfaces 222 and 223 are flat surfaces which are parallel to the X axis and the Y axis.

In the present embodiment, the supply port side fastening section 220 has an inclined surface 227 which is adjacent to the −X axial direction side of the fastening surface 222 and the supply port side fastening section 230 has an inclined surface 237 which is adjacent to the −X axial direction side of the fastening surface 232. The inclined surfaces 227 and 237 are inclined toward the +Z axial direction and the −X axial direction. Consequently, it is possible to smoothly lead the fastening surfaces 222 and 232 toward the supply pipe side fastening section 620 in the holder 60 when the cartridge 20 is mounted in the holder 60. In other embodiments, the inclined surfaces 227 and 237 may be omitted.

The fifth surface 205 and the sixth surface 206 of the cartridge 20 are surfaces which are parallel to the Z axis and the X axis and have a positional relationship so as to oppose each other in the Y axial direction. The fifth surface 205 is positioned on the +Y axial direction side and the sixth surface 206 is positioned on the −Y axial direction side. The fifth surface 205 and the sixth surface 206 have a positional relationship so as to intersect with the first surface 201, the second surface 202, the third surface 203, and the fourth surface 204. In the present embodiment, the fifth surface 205 configures the left side surface of the cartridge 20 and the sixth surface 206 configures the right side surface of the cartridge 20 in the mounting state where the cartridge 20 is mounted in the holder 60.

As shown in FIG. 8 and FIG. 13, an air introduction port 209 is provided in the fifth surface 205. The air introduction port 209 connects to a space in the inside of the outer shell 200. In the present embodiment, air, which is introduced from the air introduction port 209, is introduced into the ink containing section 300 at a predetermined timing according to the consumption state of the ink in the ink containing section 300. In other embodiments, air, which is introduced from the air introduction port 209, may be introduced into the ink containing section 300 as required in accordance with decreases in the ink in the ink containing section 300. Furthermore, in other embodiments, the ink containing section 300 may be a closed space where air is not introduced.

As shown in FIG. 7, the seventh surface 207 of the cartridge 20 is configured as a corner portion which connects between the first surface 201 and the third surface 203 along with the eighth surface 208. The seventh surface 207 includes a seventh surface 207*a* which is provided closer to the +Y axial direction and a seventh surface 207*b* which is provided closer to the −Y axial direction. In the explanation of the present embodiment, a reference numeral "207" is used in cases where both the seventh surface 207*a* and the seventh surface 207*b* are being referred to.

The seventh surface 207 is a surface which is formed to extend from the first surface 201 to the +Z axial direction side, links with the eighth surface 208 on the +Z axial direction side, and links with the first surface 201 on the −Z axial direction side. In the present embodiment, the seventh surface 207 is a surface which is parallel to the Y axis and the Z axis and has a positional relationship which opposes the fourth surface 204.

As shown in FIG. 7, the eighth surface 208 of the cartridge 20 is configured as a corner portion which connects between the first surface 201 and the third surface 203 along with the seventh surface 207. The eighth surface 208 includes an eighth surface 208*a* which is provided closer to the +Y axial direction and an eighth surface 208*b* which is provided closer to the −Y axial direction. In the explanation of the present embodiment, a reference numeral "208" is used in cases where both the eighth surface 208*a* and the eighth surface 208*b* are being referred to.

The eighth surface 208 is a surface which is formed closer to the +Z axial direction side than the seventh surface 207, links with the third surface 203 on the +Z axial direction side, and links with the seventh surface 207 on the −Z axial direction side. In the present embodiment, the eighth surface 208 is inclined toward the −Z axial direction and the +X axial direction as shown in FIG. 7, FIG. 13, and FIG. 14. That is, the eighth surface is an inclined surface which links between the first surface 201 and the third surface 203 by being inclined with regard to the first surface 201 and the third surface 203.

As shown in FIG. 9, the circuit substrate 40 is provided in a position which cuts across the plane CXa. As shown in FIG. 7 and FIG. 13, the circuit substrate 40 has a cartridge side inclined surface 408. The cartridge side inclined surface 408 is inclined towards the −Z axial direction and the +X axial direction with regard to the first surface 201 and the third surface 203 in a state of being arranged in the eighth surface 208. The cartridge side terminals 430 are provided in the cartridge side inclined surface 408 and the cartridge side terminals 430 on the circuit substrate 40 in the cartridge 20 come into contact with the device side terminals 730 on the terminal platform 70 in the holder 60 in a state where the cartridge 20 is mounted in the holder 60.

It is preferable for an angle $\phi$ where the cartridge side inclined surface 408 is inclined with regard to a flat surface which is parallel to the X axis and the Y axis (for example, the flat surface where the opening edge 288 of the ink supply port 280 is positioned) to be 25° to 40° as shown in FIG. 13. By the angle of the cartridge side inclined surface 408 being 25° or more, it is possible to secure a sufficient wiping amount. Wiping is scrapping of the cartridge side terminals 430 on the cartridge side inclined surface 408 using the device side terminals 730 on the terminal platform 70 when the cartridge 20 is mounted in the holder 60. The wiping amount is a length where it is possible for the cartridge side terminals 430 to scrap the device side terminals 730. Due to the wiping, it is possible to remove dust and dirt which has become attached onto the cartridge side terminals 430 and reduce connection defects between the cartridge side terminals 430 and the device side terminals 730. By the angle of the cartridge side inclined surface 408 being 40° or less, it is possible to secure sufficient components in the +Z axial direction which are included in the pressing force Pt with regard to the circuit substrate 40 from the device side terminals 730 which are provided in the terminal platform 70.

In the present embodiment, substrate side engaging sections 252 and 254 are provided in the seventh surface of the cartridge 20 as shown in FIG. 7, FIG. 9, and FIG. 11. The substrate side engaging section 252 of the cartridge 20 is provided to extend toward the +X axial direction of the seventh surface 207 closer to the +Y axial direction and the substrate side engaging section 254 of the cartridge 20 is provided to extend toward the +X axial direction of the seventh surface 207 closer to the −Y axial direction. The substrate side engaging sections 252 and 254 face each other on an axis which is parallel to the Y axis on the −Z axial direction side of the circuit substrate 40 and are configured to engage with an engaging section 665 in a state where the engaging section 665 is interposed between the substrate side engaging section 252 and the substrate side engaging section 254 in the holder 60 shown in FIG. 4. Consequently, it is possible to prevent positional deviation of the circuit substrate 40 with regard to the holder 60 in the X axial direction and the Y axial direction and it is possible for the cartridge side terminals 430 to come into contact with the device side terminals 730 at the correct position. In the present embodiment, the length of the substrate side engaging section 252 along the Y axis is different from the length of the substrate side engaging section 254 along the Y axis in order to prevent erroneous mounting of the cartridge 20 with regard to the holder 60.

In the present embodiment, supply port side engaging sections 256 and 258 are provided in the first surface of the cartridge 20 as shown in FIG. 7, FIG. 9, and FIG. 12. The supply port side engaging section 256 is provided to extend from the first surface which faces the −Z axial direction to be adjacent to the −X axial direction side of the ink supply, port 280 closer to the +Y axial direction, and the supply port side fastening section 258 is provided to extend from the first surface which faces the −Z axial direction to be adjacent to the −X axial direction side of the ink supply port 280 closer to the −Y axial direction. The supply port side engaging sections 256 and 258 are configured to engage with engaging sections (not shown) in the holder 60. Consequently, it is possible to prevent positional deviation of the ink supply port 280 with regard to the holder 60 in the X axial direction and the Y axial direction and it is possible to connect the ink supply port 280 to the ink supply pipe 640 at the correct position. In the present embodiment, the length of the supply port side engaging section 256 along the Y axis is different from the length of the supply port side fastening section 258 along the Y axis in order to prevent erroneous mounting of the cartridge 20 with regard to the holder 60. In the explanation of the present embodiment, reference numerals "256 and 258" are used in cases where both of the supply port side engaging sections are being referred to, reference numerals "256*a* and 258*a*" are used in cases indicating the supply port side engaging section which is adjacent to the ink supply port 280*a*, and reference numerals "256*b* and 258*b*" are used in cases indicating the supply port side engaging section which is adjacent to the ink supply port 280*b*.

In the present embodiment, a substrate side surface engaging section 262 which has a flat surface which is parallel to the Z axis and the Y axis toward the +Y axial direction is provided in the vicinity of the +Y axial direction side of the circuit substrate 40 and a substrate side surface engaging section 264 which has a flat surface which is parallel to the Z axis and the Y axis toward the −Y axial direction is provided in the vicinity of the −Y axial direction side of the circuit substrate 40 in the cartridge 20 as shown in FIG. 7 and FIG. 11. The substrate side surface engaging sections 262 and 264 are configured to engage with the engaging sections 662 and 664 in the holder 60 shown in FIG. 4. Consequently, it is possible to prevent positional deviation of the circuit substrate 40 with regard to the holder 60 in the X axial direction and the Y axial direction, and it is possible for the cartridge side terminals 430 to come into contact with the device side terminals 730 at the correct position.

In the present embodiment, a substrate side engaging section 266 which has a flat surface which is parallel to the Z axis and the Y axis toward the +Y axial direction is further provided on the +Y axial direction side of the substrate side surface engaging section 262 and a substrate side engaging section 268 which has a flat surface which is parallel to the Z axis and the Y axis toward the −Y axial direction is further provided on the −Y axial direction side of the substrate side surface engaging section 264 as shown in FIG. 7 and FIG. 11. The substrate side engaging sections 266 and 268 are configured to engage with the fastening sections 666 and 668 in the holder 60 shown in FIG. 4. Consequently, it is possible to prevent positional deviation of the circuit substrate 40 with regard to the holder 60 in the X axial direction and the Y axial direction, and it is possible for the cartridge side terminals 430 to come into contact with the device side terminals 730 at the correct position.

As shown in FIG. 15 and FIG. 16, the cartridge 20 has a main body member 301, a left side surface member 305, and a right side surface member 306 as members which configure the outer shell 200. The cartridge 20 has film members 335, 361, and 386 in addition to the main body member 301 as members which define the ink containing section 300. The cartridge 20 further has valve members 322, 324, a plate member 325, and elastic members 326, 328 as members which adjust the internal pressure of the ink containing section 300.

Figure 17:
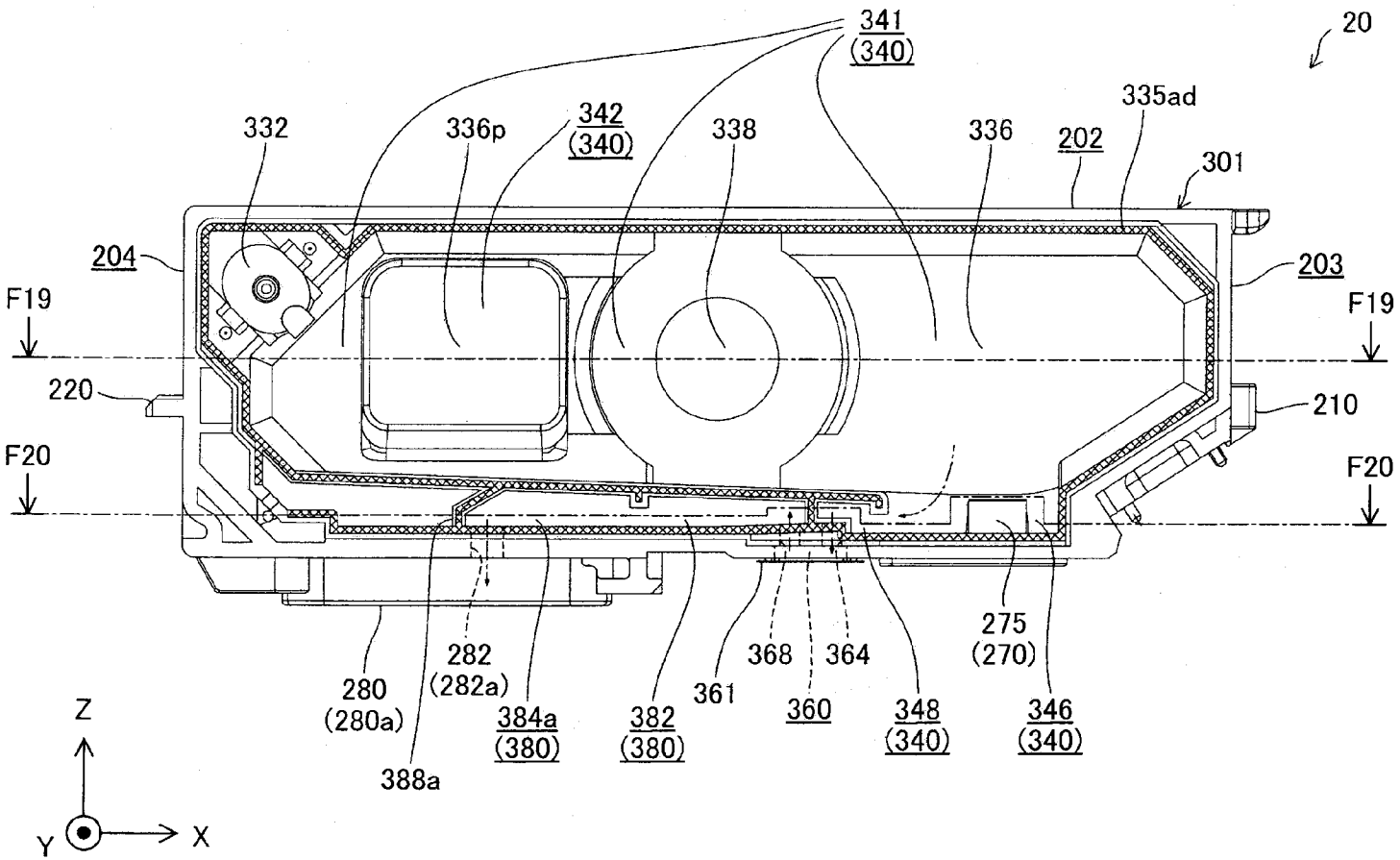
FIG. 17 is a left side surface diagram illustrating a configuration of a main body member of a cartridge.
Figure 18:
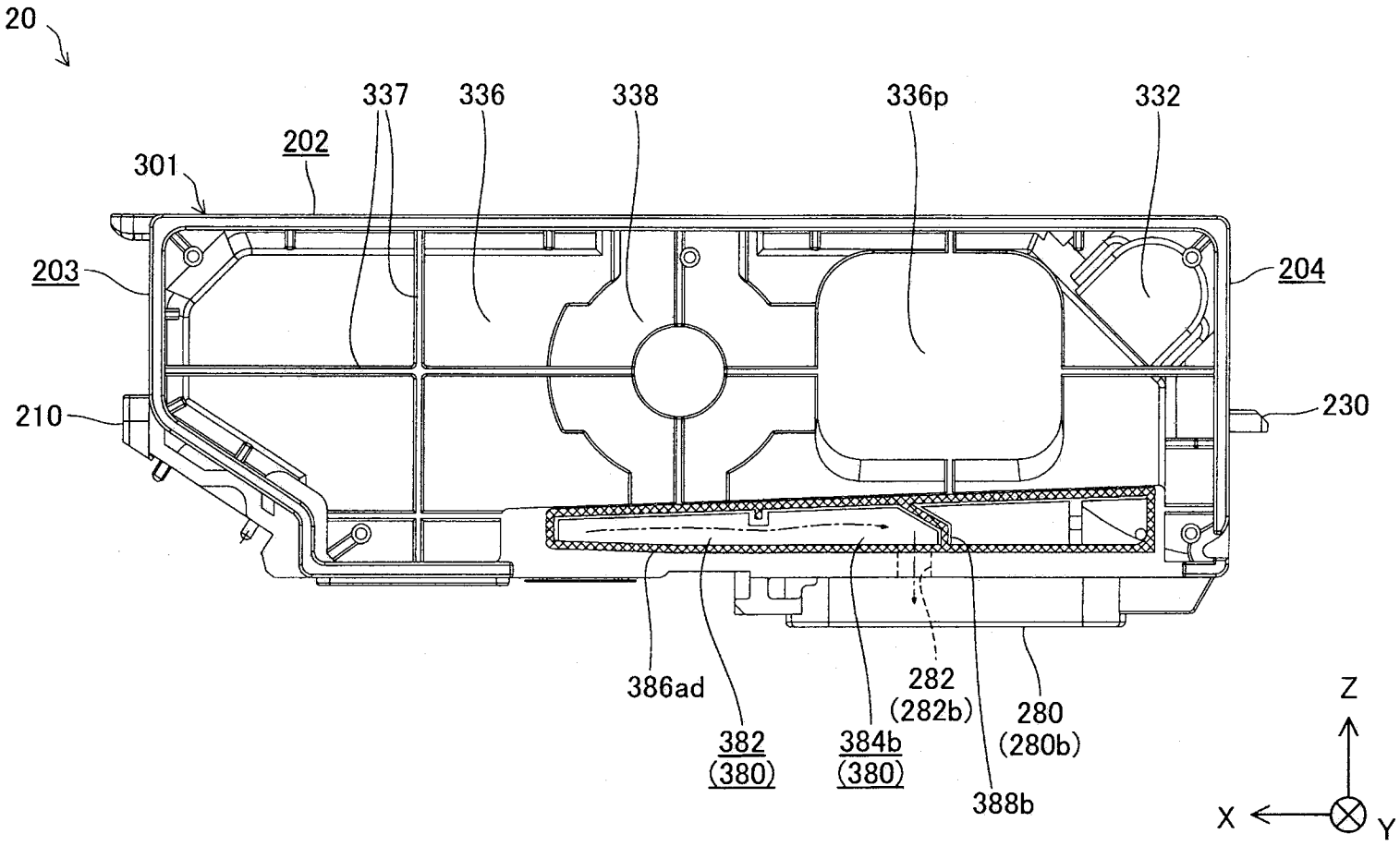
FIG. 18 is a right side surface diagram illustrating a configuration of a main body member of a cartridge.
Figure 19:
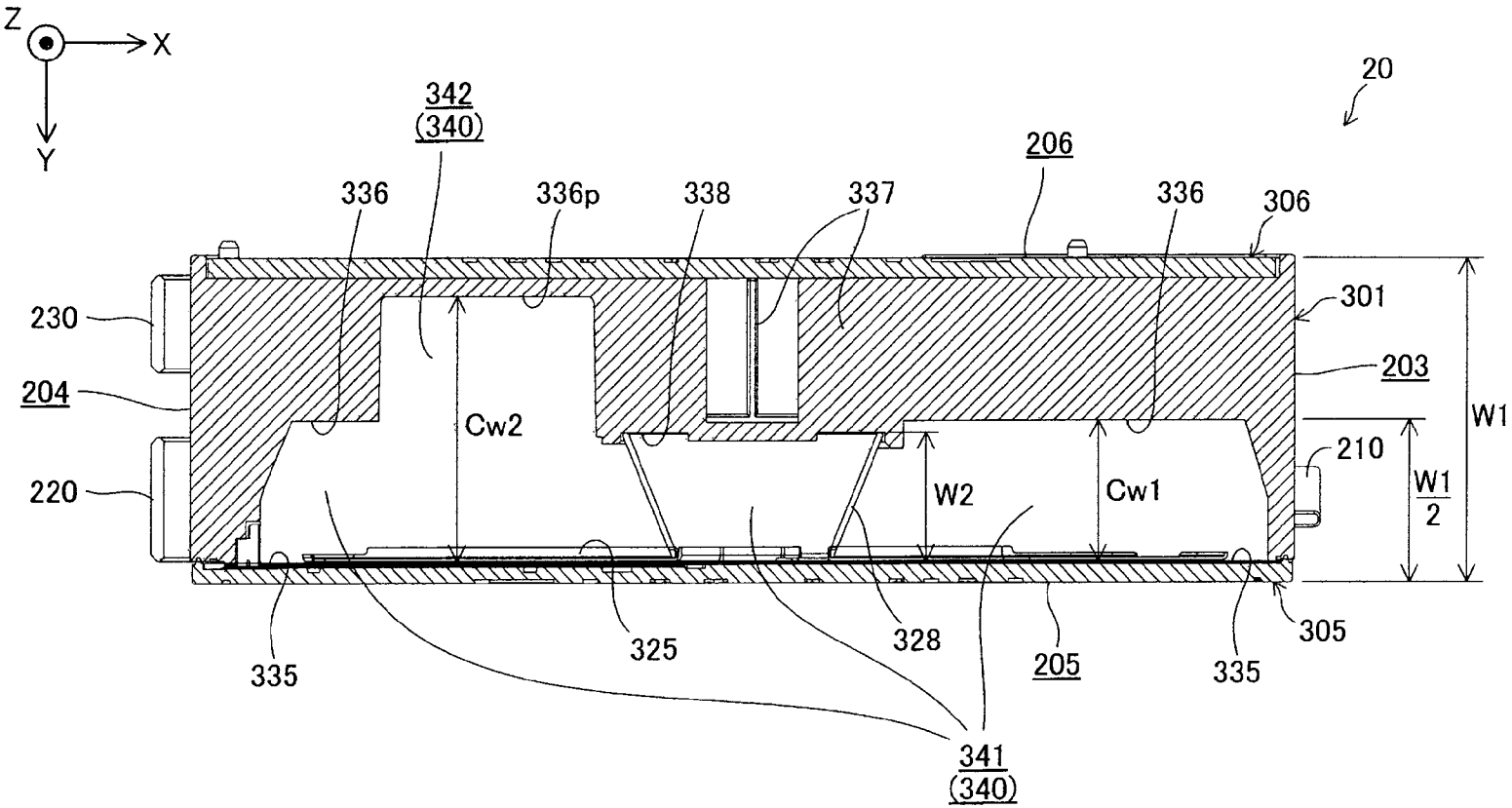
FIG. 19 is a cross-sectional diagram illustrating a cartridge cut in a position corresponding to an arrow F19-F19 in FIG. 17.
Figure 20:
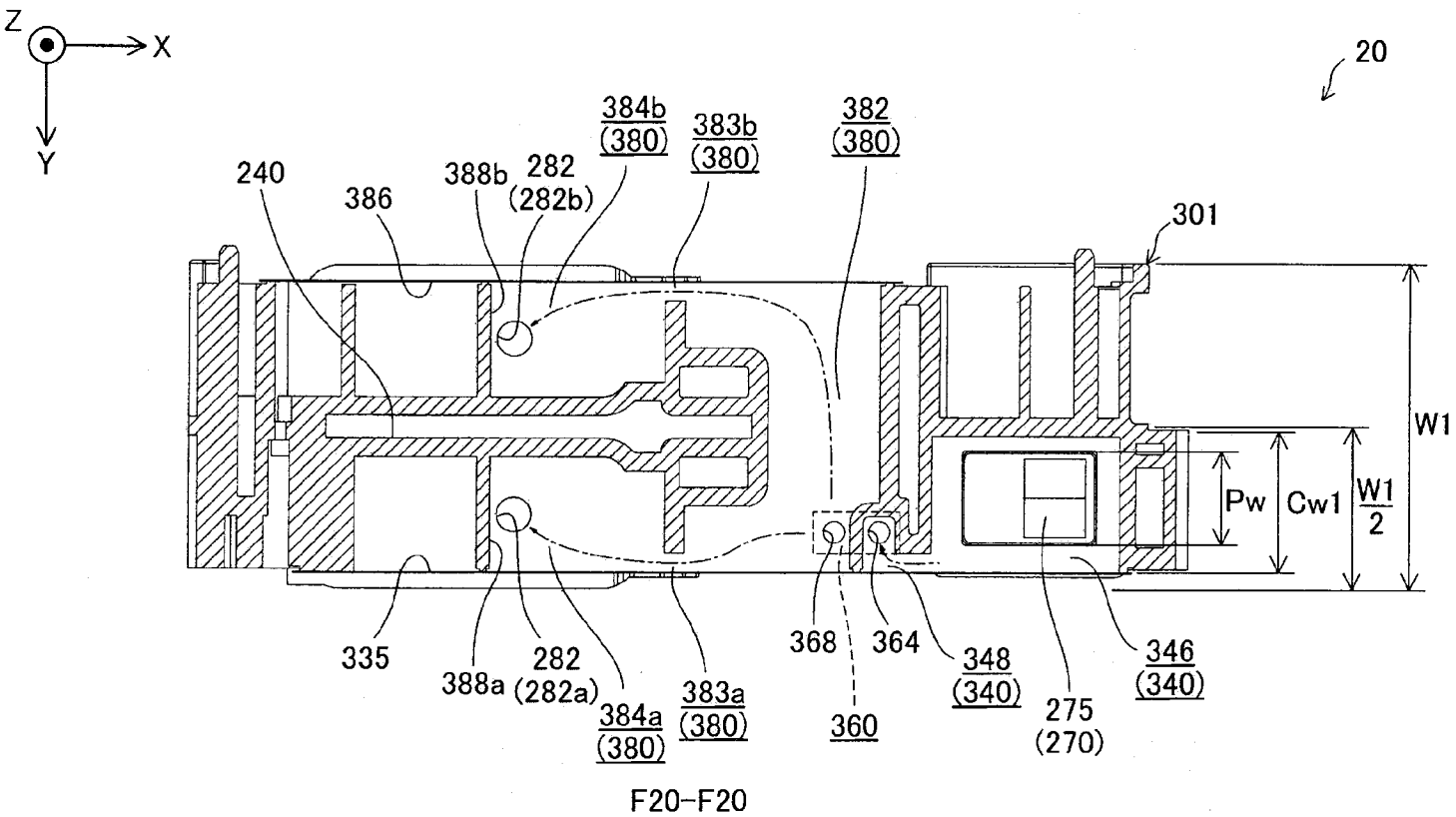
FIG. 20 is a cross-sectional diagram illustrating a cartridge cut in a position corresponding to an arrow F20-F20 in FIG. 17.

FIG. 17 is a left side surface diagram illustrating the configuration of the main body member 301 of the cartridge 20. FIG. 18 is a right side surface diagram illustrating the configuration of the main body member 301 of the cartridge 20. FIG. 19 is a cross-sectional diagram illustrating the cartridge 20 cut in a position corresponding to an arrow F19-F19 in FIG. 17. FIG. 20 is a cross-sectional diagram illustrating the cartridge 20 cut in a position corresponding to an arrow F20-F20 in FIG. 17. As shown in FIG. 17 to FIG. 20, the cartridge 20 has a main ink chamber 340 and a sub ink chamber 380 as parts which configure the ink containing section 300. The main ink chamber 340 and the sub ink chamber 380 are connected by a connecting path 360, and a slight amount of ink is contained also in the connecting path 360.

As shown in FIG. 15 to FIG. 20, in the present embodiment, the main body member 301 of the cartridge 20 is a member which is obtained by integrally forming structures such as the first surface 201, the second surface 202, the third surface 203, the fourth surface 204, the substrate side fastening section 210, the supply port side fastening sections 220, 230, the protruding section 260, the ink supply port 280, and the like. In addition to these structures, the main body member 301 has a valve containing section 332, an intermediate wall 336, and peripheral convex sections 335*ad*, 386*ad*. In the present embodiment, the main body member 301 is made of synthetic resin (for example, polypropylene (PP) or polyacetal (POM)).

As shown in FIG. 17, the valve containing section 332 of the main body member 301 is provided in the main ink chamber 340, and contains the valve members 322, 324, and the elastic member 326. In the present embodiment, the valve containing section 332 is provided on the +Z axial direction side and the −X axial direction side in the main ink chamber 340.

As shown in FIG. 15, the intermediate wall 336 of the main body member 301 is a wall section which defines the −Y axial direction side of the ink containing section 300 along the Z axis and the X axis. In the present embodiment, the intermediate wall 336 has a protruding section 336*p* a part of which protrudes toward the −Y axial direction. In the present embodiment, the intermediate wall 336 has a retaining section 338 which retains the elastic member 328. As shown in FIG. 16, in the present embodiment, a reinforcing plate 337 for reinforcing the main body member 301 is formed on the −Y axial direction side of the intermediate wall 336.

As shown in FIG. 15, the peripheral convex section 335*ad* of the main body member 301 is provided in the periphery of a part of the ink containing section 300 open to the +Y axial direction in the main body member 301, and has a convex shape in the +Y axial direction. In FIG. 17, the peripheral convex section 335*ad* is illustrated with cross-hatching. The film member 335 is attached to the peripheral convex section 335*ad* in a closed state.

As shown in FIG. 16, the peripheral convex section 386*ad* of the main body member 301 is provided in the periphery of a part of the ink containing section 300 open to the −Y axial direction in the main body member 301, and has a convex shape in the −Y axial direction. In FIG. 18, the peripheral convex section 386*ad* is illustrated with cross-hatching. The film member 386 is attached to the peripheral convex section 386*ad* in a closed state.

As shown in FIG. 15, in the present embodiment, the left side surface member 305 of the cartridge 20 is a member which is obtained by integrally forming structures such as the fifth surface 205, the air introduction port 209, and the like. In the present embodiment, similarly to the main body member 301, the left side surface member 305 is made of synthetic resin (for example, polypropylene or polyacetal). In the present embodiment, the left side surface member 305 is attached to the +Y axial direction side of the main body member 301 by heat adhesion.

As shown in FIG. 16, in the present embodiment, the right side surface member 306 of the cartridge 20 is a member which is obtained by integrally forming structures such as the sixth surface 206 and the like. In the present embodiment, similarly to the main body member 301, the right side surface member 306 is made of synthetic resin (for example, polypropylene or polyacetal). In the present embodiment, the right side surface member 306 is attached to the −Y axial direction side of the main body member 301 by heat adhesion.

The film member 335 of the cartridge 20 is a thin film which has ink impermeability, air tightness, and flexibility. As shown in FIG. 15 and FIG. 17, the film member 335 is attached to the peripheral convex section 335*ad* of the main body member 301 in a closed state, and defines the +Y axial direction side in each ink containing chamber of the main ink chamber 340 and the sub ink chamber 380. In the present embodiment, the film member 335 is made of synthetic resin (for example, a composite material of nylon and polypropylene).

The valve member 322 of the cartridge 20 is a valve body which has a through hole 322H. The valve member 322 is attached to the valve containing section 332 of the main body member 301 in a state where the +Y axial direction side thereof is attached to the film member 335. The through hole 322H of the valve member 322 connects to the air introduction port 209 via a through hole 335H of the film member 335. In the present embodiment, the valve member 322 is made of synthetic resin (for example, polypropylene).

The valve member 324 of the cartridge 20 is pressed against the valve member 322 by the elastic member 326 so as to close the through hole 322H of the valve member 322. The valve member 324 opens the through hole 322H of the valve member 322 depending on the position of the plate member 325 in the main ink chamber 340. In the present embodiment, the valve member 324 is made of synthetic resin (for example, polypropylene). In the present embodiment, the elastic member 326 is a coil spring made of metal.

As shown in FIG. 19, the plate member 325 of the cartridge 20 is a plate-shaped member which abuts against the film member 335 in a state of being biased by the elastic member 328 in a direction of expanding the volume of the main ink chamber 340 inside the main ink chamber 340. The plate member 325 is displaced together with the film member 335 in response to the internal pressure of the main ink chamber 340, and in the present embodiment, the plate member 325 is displaced along the Y axis. In the present embodiment, the plate member 325 is made of synthetic resin (for example, polypropylene) or metal (stainless steel).

As shown in FIG. 19, the elastic member 328 of the cartridge 20 presses the plate member 325 against the film member 335 inside the main ink chamber 340. That is, the elastic member 328 biases the plate member 325 in a direction of expanding the volume of the main ink chamber 340. In this manner, the elastic member 328 configures the negative pressure generating member which generates negative pressure in the main ink chamber 340 in cooperation with the plate member 325. The elastic member 328 expands and contracts in response to the internal pressure of the main ink chamber 340, and in the present embodiment, the elastic member 328 expands and contracts along the Y axis. In the present embodiment, the elastic member 328 is attached to the retaining section 338 of the main body member 301 in a state of being communicated with the plate member 325.

In the present embodiment, the elastic member 328 is a coil spring made of metal. In FIG. 15 and FIG. 19, the elastic member 328 as a coil spring is schematically illustrated. The elastic member 328 is not limited to a coil spring made of metal, and it is sufficient for the elastic member 328 to be made of a material which can generate negative pressure in the main ink chamber 340. For example, the elastic member 238 may be another type of spring made of metal, a spring made of synthetic resin, a rubber member, a fluid spring, a continuous porous member (for example, polyurethane foam), or the like.

The film member 361 of the cartridge 20 is a thin film which has ink impermeability and air tightness. As shown in FIG. 9 and FIG. 17, the film member 361 is attached to the −Z axial direction side of the main body member 301 in a closed state, and defines the −Z axial direction side in the connecting path 360. In the present embodiment, the film member 361 is made of synthetic resin (for example, a composite material of nylon and polypropylene).

The film member 386 of the cartridge 20 is a thin film which has ink impermeability and air tightness. As shown in FIG. 16 and FIG. 18, the film member 386 is attached to the peripheral convex section 386*ad* of the main body member 301 in a closed state, and defines the −Y axial direction side in the sub ink chamber 380. In the present embodiment, the film member 386 is made of synthetic resin (for example, a composite material of nylon and polypropylene).

As shown in FIG. 17, FIG. 19 and FIG. 20, the main ink chamber 340 forms a space which can contain ink in the cartridge 20. In the present embodiment, the main ink chamber 340 is constructed of the main body member 301 and the film member 335. The main ink chamber 340 has a first region 341, a second region 342, a detection region 346, and a communicating path 348.

As shown in FIG. 17 and FIG. 19, the first region 341 in the main ink chamber 340 is formed from the +X axial direction side to the −X axial direction side closer to the +Y axial direction between the fifth surface 205 and the sixth surface 206. As described above, the plate member 325 and the elastic member 328 are arranged in the first region 341 as the negative pressure generating member.

As shown in FIG. 19, the relationship between a length W1 and a length W2 satisfies W2<W1/N, where W1 is a length of the cartridge 20 along the Y axis from the fifth surface 205 to the sixth surface 206, W2 is a length of the plate member 325 and the elastic member 328 arranged in the first region 341 along the Y axis, and N is the number of the ink supply ports 280. Specifically, in the cartridge 20 which has two ink supply ports 280, W2<W1/2 is satisfied. The length W2 is also a length between the retaining section 338 of the main body member 301 and the film member 335 along the Y axis.

In the present embodiment, a length Cw1 of the first region 341 along the Y axis is smaller than W1/N, that is, W1/2. In other embodiments, the length Cw1 of the first region 341 may be W1/N or more, but it is preferable that the length Cw1 of the first region 341 is nearly equal to W1/N. That is, it is preferable to satisfy Cw1≤W1/2. In particular, with respect to a region (in the present embodiment, a region on the +X axial direction side) of the first region 341 close to the detection region 346, it is preferable to satisfy Cw1≤W1/2. This is to prevent false detection of ink in the detection region 346.

As explained above, the presence or absence of ink is detected in the detection region 346 using the detection element 270. There is a possibility that the presence or absence of ink cannot be detected accurately in a state where ink is unstable in the vicinity of the detection element 270. Such circumstances will easily occur in some cases including a case where air bubbles enter the ink in the vicinity of the detection element 270, a case where the liquid level of the ink shakes in the vicinity of the detection element 270, or a case where ink stagnates before in the detection region 346 and does not move toward the detection element 270. In order to prevent such phenomena, it is necessary to send the ink to the detection element 270 smoothly or make the flow of ink stable in the vicinity of the detection element 270. For this purpose, it is preferable that a length Pw of the detection element 270 along the Y axis (FIG. 20) is not significantly different from the length Cw1 of the first region 341 along the Y axis, in particular, the length Cw1 of the region (in the present embodiment, the region on the +X axial direction side) close to the detection region 346. As shown in FIG. 20, in the present embodiment, the length Pw of the detection element 270 along the Y axial direction is slightly smaller than the length Cw1 of the first region 341 along the Y axis.

Consequently, the length Cw1 of the first region 341 along the Y axial direction may be W1/N or more (in the present embodiment, N=2), but it is preferable to satisfy Cw1≤W1/N and it is more preferable to satisfy Pw≤Cw1≤W1/N. In the present embodiment, the length Cw1 of the first region 341 along the Y axial direction is greater than the length W2 of the plate member 325 and the elastic member 328 arranged in the first region 341 along the Y axis.

As shown in FIG. 17 and FIG. 19, the second region 342 in the main ink chamber 340 is formed by the protruding section 336*p* closer to the fourth surface 204 than the retaining section 338. As shown in FIG. 19, the second region 342 is adjacent to the first region 341, and has a shape in which a part of the first region 341 is expanded in the −Y axial direction. A length Cw2 of the second region 342 along the Y axis is greater than the length Cw1 of the first region 341, and greater than W1/N, that is, W1/2. In the present embodiment, the length Cw2 of the second region 342 along the Y axis is twice as much as the length Cw1 of the first region 341 along the Y axis.

In the present embodiment, while the length Cw1 of the first region 341 is close to W1/N, the length Cw2 of the second region 342 is close to W1. Specifically, it satisfies Cw1<W1/N<<Cw2<W1. The second region 342 whose length Cw2 along the Y axis is significantly greater than W1/N is positioned closer to the fourth surface 204 (−X axial direction side) in the main ink chamber 340, and positioned opposite to the detection region 346 which is positioned closer to the third surface 203 (+X axial direction side) in the main ink chamber 340. More specifically, since the second region 342 and the detection region 346 are positioned away from each other in the X axial direction, false detection of ink in the detection region 346 can be prevented as described previously.

In the present embodiment, the volume of the main ink chamber 340 can be changed in accordance with change in the specification of the cartridge 20 by adjusting the presence or absence, or the position along the Y axis of a bush (not shown) for forming the second region 342 in a mold (not shown) used for integrally forming the main body member 301. For example, in the cartridge 20 of the present embodiment, the length of the first region 341 along the Y axial direction in the ink containing section 300 is partially different compared to the cartridge 22 (FIG. 29 to FIG. 31) of the second embodiment described later. Thus, a basic mold common to the cartridge 20 of the present embodiment and the cartridge 20 of the second embodiment is prepared, and a bush is added to a position which corresponds to a part of the first region 341 in the mold for manufacturing the cartridge 20 of the present embodiment.

As shown in FIG. 19, the film member 335 is a first defining plane which defines the first region 341 and the second region 342 on the fifth surface 205 side, and has a shape along the fifth surface 205 all over the first region 341 and the second region 342. The intermediate wall 336 is a second defining plane which defines the first region 341 and the second region 342 on the sixth surface 206 side, and has a shape in which a part of the intermediate wall 336 corresponding to the second region 342 protrudes toward the sixth surface 206.

The detection region 346 in the main ink chamber 340 is configured to detect ink in the main ink chamber 340. As shown in FIG. 17 and FIG. 20, in the present embodiment, the prism 275 of the detection element 270 is provided in the detection region 346, and ink in the main ink chamber 340 can be detected using the detection element 270 as explained above. The detection region 346 is formed closer to the third surface 203 than the retaining section 338. The detection region 346 is adjacent to the first region 341 on the −Z axial direction side, and has a shape in which a part of the first region 341 is expanded in the −Z axial direction.

The communicating path 348 in the main ink chamber 340 communicates the detection region 346 and the connecting path 360. As shown in FIG. 17 and FIG. 20, in the present embodiment, the communicating path 348 is adjacent to the detection region 346 on the −X axial direction side. In the present embodiment, the communicating path 348 proceeds from the detection region 346 in the −X axial direction, then rises by one step in the +Z axial direction with respect to the detection region 346 and proceeds in the −Y axial direction, and leads to the connecting path 360 on the −Z axial direction side via a through hole 364.

As shown in FIG. 9, FIG. 17 and FIG. 20, the connecting path 360 in the cartridge 20 forms a space which can contain a slight amount of ink, and communicates the main ink chamber 340 and the sub ink chamber 380. In the present embodiment, the connecting path 360 is constructed of the main body member 301 and the film member 361. The connecting path 360 is provided on the −Z axial direction side with respect to the main ink chamber 340 and the sub ink chamber 380. The connecting path 360 leads to the main ink chamber 340 on the +Z axial direction side via the through hole 364, and leads to the sub ink chamber 380 on the +Z axial direction side via a through hole 368. Consequently, the connecting path 360 serves as a backflow preventing section which prevents backflow of ink from the sub ink chamber 380 to the detection region 346 in the main ink chamber 340.

As shown in FIG. 17, FIG. 18 and FIG. 20, the sub ink chamber 380 in the cartridge 20 forms a space which can contain ink. As shown in FIG. 20, the sub ink chamber 380 is branched into each of the ink flow paths 282 to communicate the main ink chamber 340 and the ink flow paths 282, so that the sub ink chamber 380 serves as a branch communicating section which is configured to distribute ink to each of the ink flow paths 282. In the explanation of the present embodiment, a reference numeral "282" is used in cases where the ink flow paths 282 are being referred to. A reference numeral "282*a*" is used in cases indicating the ink flow path which leads to the ink supply port 280*a* among the plurality of ink flow paths 282, and a reference numeral "282*b*" is used in cases indicating the ink flow path which leads to the ink supply port 280*b* among the plurality of ink flow paths 282.

In the present embodiment, the sub ink chamber 380 is constructed of the main body member 301, the film member 335, and the film member 386. As shown in FIG. 17, the sub ink chamber 380 is provided on the −Z axial direction side with respect to the first region 341 in the main ink chamber 340, on the −X axial direction side with respect to the detection region 346, and on the +Z axial direction side with respect to the connecting path 360.

As shown in FIG. 20, the sub ink chamber 380 has a region 382, a region 383*a*, a region 383*b*, a region 384*a*, and a region 384*b*. The through hole 368 is provided in the region 382. The ink flow path 282*a* is provided in the region 384*a*, and the ink flow path 282*b* is provided in the region 384*b*. The region 383*a* forms a flow path which is narrower than the region 382 and the region 384*a*, and communicates the region 382 and the region 384*a*. The region 383*b* forms a flow path which is narrower than the region 382 and the region 384*b*, and communicates the region 382 and the region 384*b*.

In the present embodiment, the −X axial direction side of the region 384*a* in the sub ink chamber 380 is defined by a partition section 388*a* of the main body member 301, and the −X axial direction side of the region 384*b* in the sub ink chamber 380 is defined by a partition section 388*b* of the main body member 301. In the present embodiment, the volumes of the region 384*a* and the region 384*b* can be changed in accordance with change in the specification of the cartridge 20 by adjusting the presence or absence, or the position along the X axis of a bush (not shown) for forming the region 384*a* and the region 384*b* in a mold (not shown) used for integrally forming the main body member 301.

For example, as shown in FIG. 17 and FIG. 18, in the cartridge 20 of the present embodiment, the −X axial direction side of the regions 384*a*, 384*b* in the sub ink chamber 380 is defined by the partition sections 388*a*, 388*b* of the main body member 301. In contrast to this, another cartridge in which the volume of the sub ink chamber 380 is expanded by removing the partition sections 388*a*, 388*b* for a new lineup is assumed. In such a case, a basic mold common to the cartridge with no the partition sections 388*a*, 388*b* and the cartridge 20 of the present embodiment is prepared, and a bush is added to a position which corresponds to a part of the partition sections 388*a*, 388*b* in the basic mold for manufacturing the cartridge with no partition sections 388*a*, 388*b*.

In order to fill ink in the cartridge 20, the through hole 322H of the valve member 322 is blocked from outside in a state where the left side surface member 305 is detached from the main body member 301 so as to reduce the pressure inside the cartridge 20 in a subsequent process. Then, the pressure inside the cartridge 20 is reduced from the ink supply port 280. This pressure reduction may be conducted from one of the two ink supply ports 280 in a state where the other of the two ink supply ports 280 is blocked, or may be conducted from both of the two ink supply ports 280. After the pressure inside the cartridge 20 is reduced, ink is supplied to the ink supply ports 280, and the ink is aspirated from the ink supply ports 280 to the inside of the cartridge 20. In this manner, ink is filled in the main ink chamber 340, the connecting path 360, and the sub ink chamber 380 in the cartridge 20.

As shown by the arrow in FIG. 17 and FIG. 20, ink in the main ink chamber 340 is distributed from the detection region 346 to the communicating path 348, passes the through hole 364, and is distributed to the connecting path 360. As shown by the arrow in FIG. 17, ink in the connecting path 360 passes the through hole 368, and is distributed to the sub ink chamber 380. As shown by the arrow in FIG. 17, FIG. 18 and FIG. 20, ink in the sub ink chamber 380 is branched from the region 382 into the region 384*a* and the region 384*b*. Ink in the region 384*a* passes the ink flow path 282*a*, and is supplied from the ink supply port 280*a* to the outside of the cartridge 20. Ink in the region 384*b* passes the ink flow path 282*b*, and is supplied from the ink supply port 280*b* to the outside of the cartridge 20.

Figure 21:
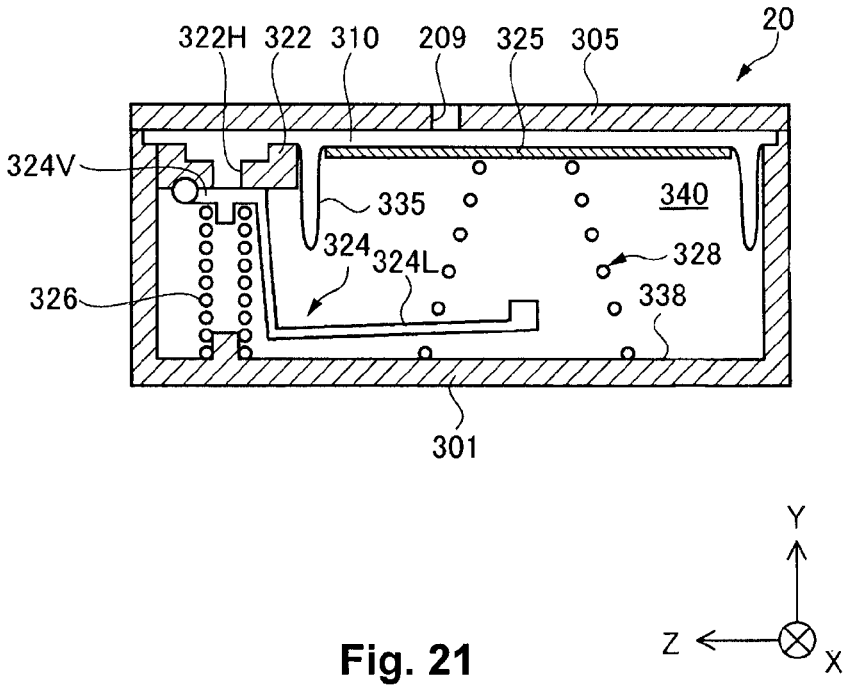
FIG. 21 is an explanatory diagram schematically illustrating a state of adjusting internal pressure of a cartridge.
Figure 22:
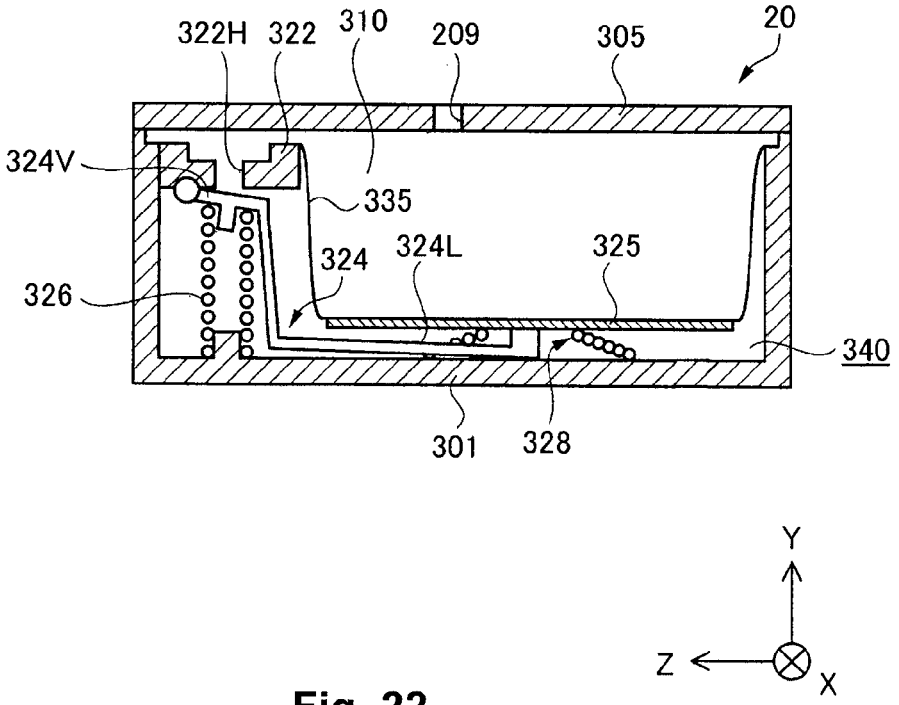
FIG. 22 is an explanatory diagram schematically illustrating a state of adjusting internal pressure of a cartridge.
Figure 23:
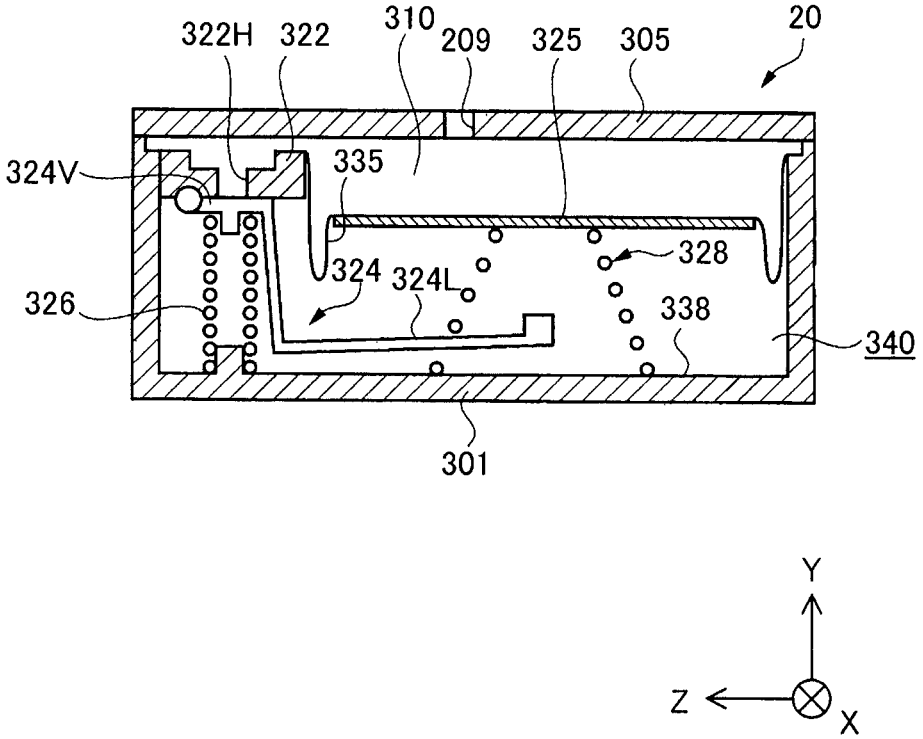
FIG. 23 is an explanatory diagram schematically illustrating a state of adjusting internal pressure of a cartridge.

FIG. 21, FIG. 22, and FIG. 23 are explanatory diagrams schematically illustrating a state of adjusting internal pressure of the cartridge 20. As shown in FIG. 21, in a state where the main ink chamber 340 is sufficiently filled with ink, a valve section 324V of the valve member 324 is biased against the valve member 322 by the elastic member 326 so as to block the through hole 322H of the valve member 322. In this state, the elastic member 328 biases the plate member 325 in a direction of expanding the volume of the main ink chamber 340 (the +Y axial direction). In this manner, the internal pressure of the main ink chamber 340 is maintained at pressure lower than atmospheric pressure (negative pressure).

As shown in FIG. 22, when the ink in the main ink chamber 340 is consumed and the internal pressure of the main ink chamber 340 becomes lower than that of the state of FIG. 21, the plate member 325 is displaced in the −Y axial direction together with the film member 335 so as to press a lever section 324L of the valve member 324 in the −Y axial direction. In response to this, the valve section 324V of the valve member 324 opens the through hole 322H of the valve member 322, and the main ink chamber 340 is temporarily communicated with an air region 310 which is filled with air through the air introduction port 209. Consequently, air is flowed into the main ink chamber 340, and as shown in FIG. 23, the volume of the main ink chamber 340 becomes larger than that of the state of FIG. 22. In addition, the internal pressure of the main ink chamber 340 becomes closer to the atmospheric pressure compared to the state of FIG. 22. As shown in FIG. 23, when a certain amount of air is flowed into the main ink chamber 340, the plate member 325 is separated from the lever section 324L of the valve member 324 and the valve section 324V of the valve member 324 blocks the through hole 322H of the valve member 322 again. In this manner, the internal pressure of the cartridge 20 is maintained in an appropriate pressure range.

A-4. Detailed Configuration of Another Cartridge

Figure 24:
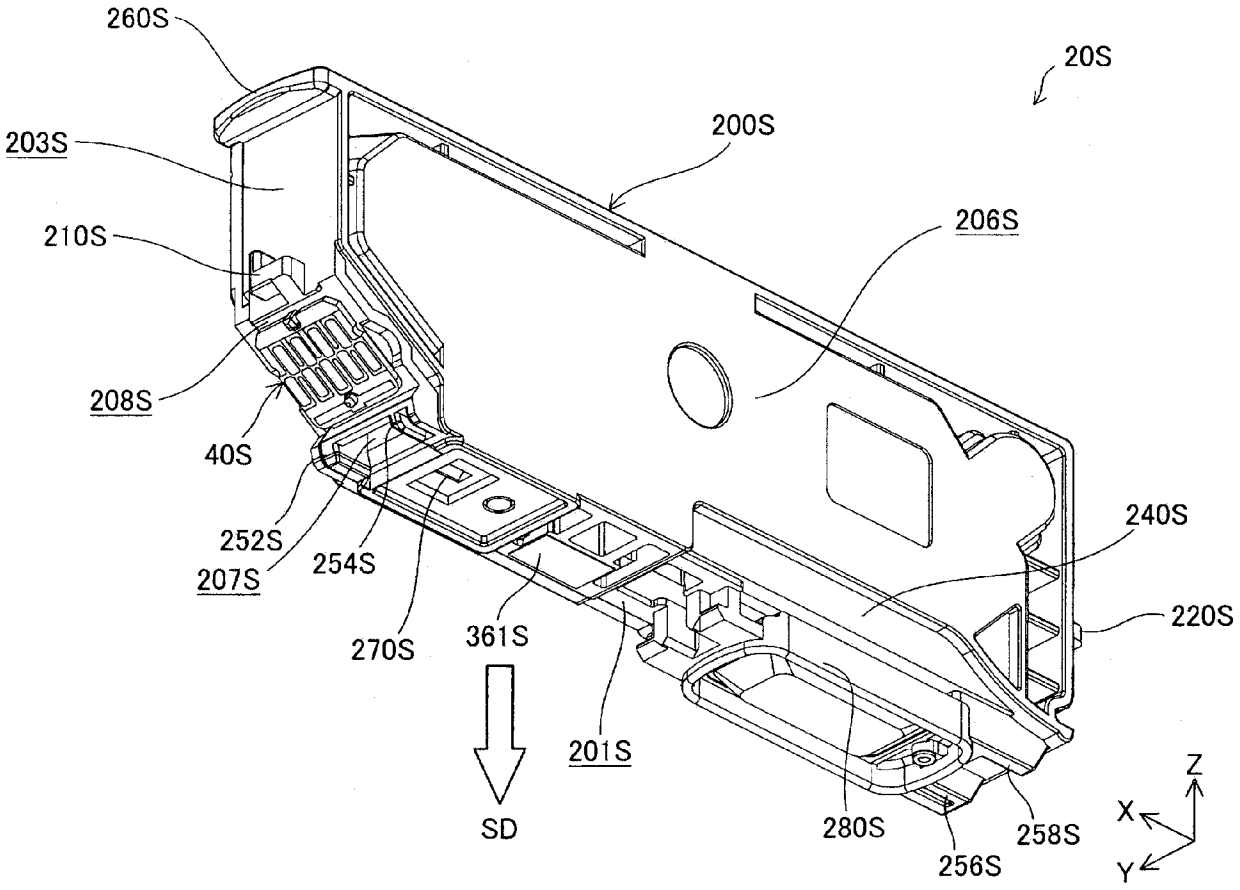
FIG. 24 is a perspective diagram illustrating another configuration of a cartridge.
Figure 25:
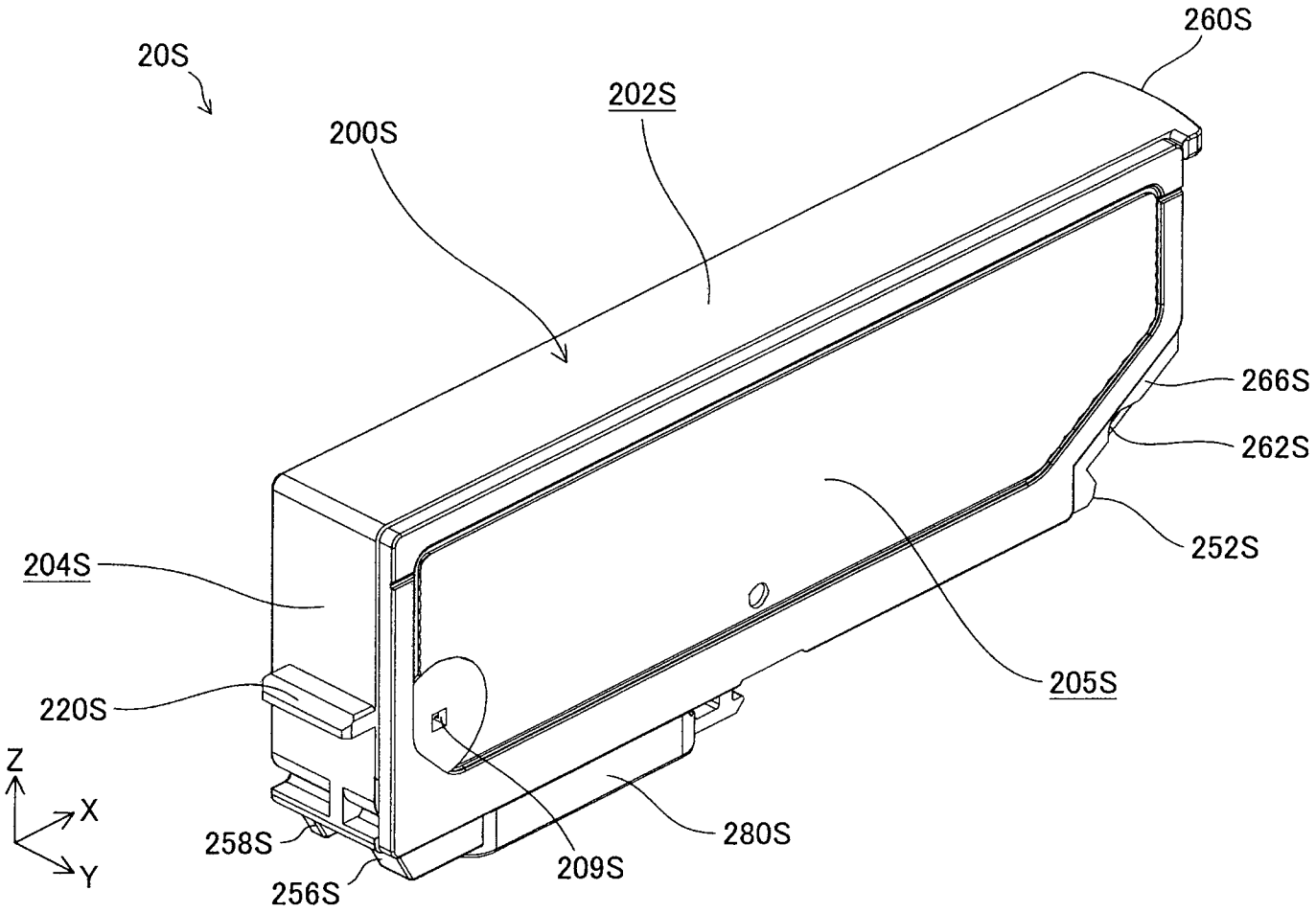
FIG. 25 is a perspective diagram illustrating another configuration of a cartridge.

FIG. 24 and FIG. 25 are perspective diagrams illustrating a configuration of another cartridge 20S. In the explanation of the cartridge 20S, a reference numeral where "S" is attached to the reference numeral is used to indicate the configuration of the cartridge 20S with regard to configurations which are the same as or correspond to the configuration of the cartridge 20, and the description thereof is omitted.

The configuration of the cartridge 20S corresponds to a configuration with the plane CXa on the +Y axial direction side in the cartridge 20 as the center. The cartridge 20S is provided with an outer shell 20S with a cuboid as a basis. The cartridge 20S has a first surface 201S, a second surface 202S, a third surface 203S, a fourth surface 204S, a fifth surface 205S, and a sixth surface 206S as six wall sections which configure the outer shell 200S. The cartridge 20S has a seventh surface 207S and an eighth surface 208S between the first surface 201S and the third surface 2035.

A detection element 270S, an ink supply port 280S, and supply port side engaging sections 256S and 258S are provided in the first surface 201S of the cartridge 20S. The configuration of the detection element 270S is similar to the detection element 270 of the cartridge 20.

A substrate side fastening section 210S is provided in the third surface 203S of the cartridge 20S. A supply port side fastening section 220S is provided in the fourth surface 204S of the cartridge 20S. An air introduction port 209S is provided in the fifth surface 205S of the cartridge 20S.

A depression section 240S is provided in the sixth surface 206S of the cartridge 20S at a position which corresponds to the partition plate 607 of the holder 60. The depression section 240S is formed in a shape where a part thereof closer to the −X axial direction out of the outer edge on the −Z axial direction side of the sixth surface 206S is depressed in the +Y axial direction and is configured so that a part on the +Y axial direction side of the partition plate 607 can be received in a state where the ink supply port 280S is connected to the ink supply pipe 640.

Substrate side engaging sections 252S and 254S are provided in the seventh surface 207S of the cartridge 20S. A circuit substrate 40S is provided in the eighth surface 208S of the cartridge 20S. The configuration of the circuit substrate 40S is similar to the circuit substrate 40 of the cartridge 20.

Figure 26:
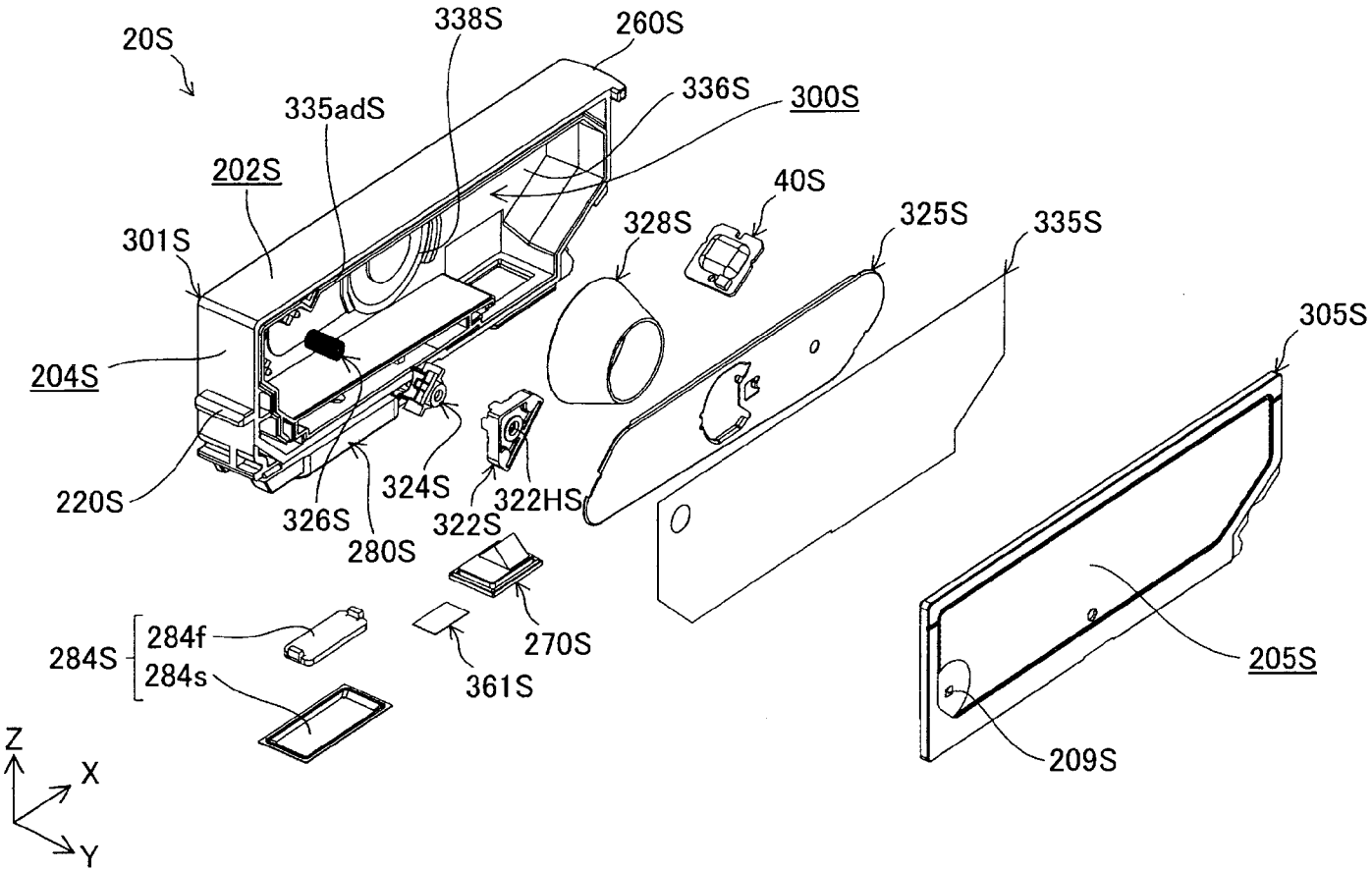
FIG. 26 is an exploded perspective diagram illustrating another configuration of a cartridge.

FIG. 26 is an exploded perspective diagram illustrating the configuration of the cartridge 20S. The cartridge 20S has a main body member 301S and a left side surface member 305S as members which configure the outer shell 200S. In the present embodiment, the configuration of the left side surface member 305S is similar to the left side surface member 305 of the cartridge 20.

The cartridge 20S has a film member 335S and a film member 361S in addition to the main body member 301S as members which define the ink containing section 300S. In the present embodiment, the configuration of the film member 335S is similar to the film member 335 of the cartridge 20. In the present embodiment, the configuration of the film member 361S is similar to the film member 361 of the cartridge 20.

The cartridge 20S further has valve members 322S, 324S, a plate member 325S, and elastic members 326S, 328S as members which adjust the internal pressure of the ink containing section 300S. In the present embodiment, the configuration of the valve member 322S is similar to the valve member 322 of the cartridge 20. In the present embodiment, the configuration of the valve member 324S is similar to the valve member 324 of the cartridge 20. In the present embodiment, the configuration of the plate member 325S is similar to the plate member 325 of the cartridge 20. In the present embodiment, the configuration of the elastic member 326S is similar to the elastic member 326 of the cartridge 20. In the present embodiment, the configuration of the elastic member 328S is similar to the elastic member 328 of the cartridge 20.

Figure 27:
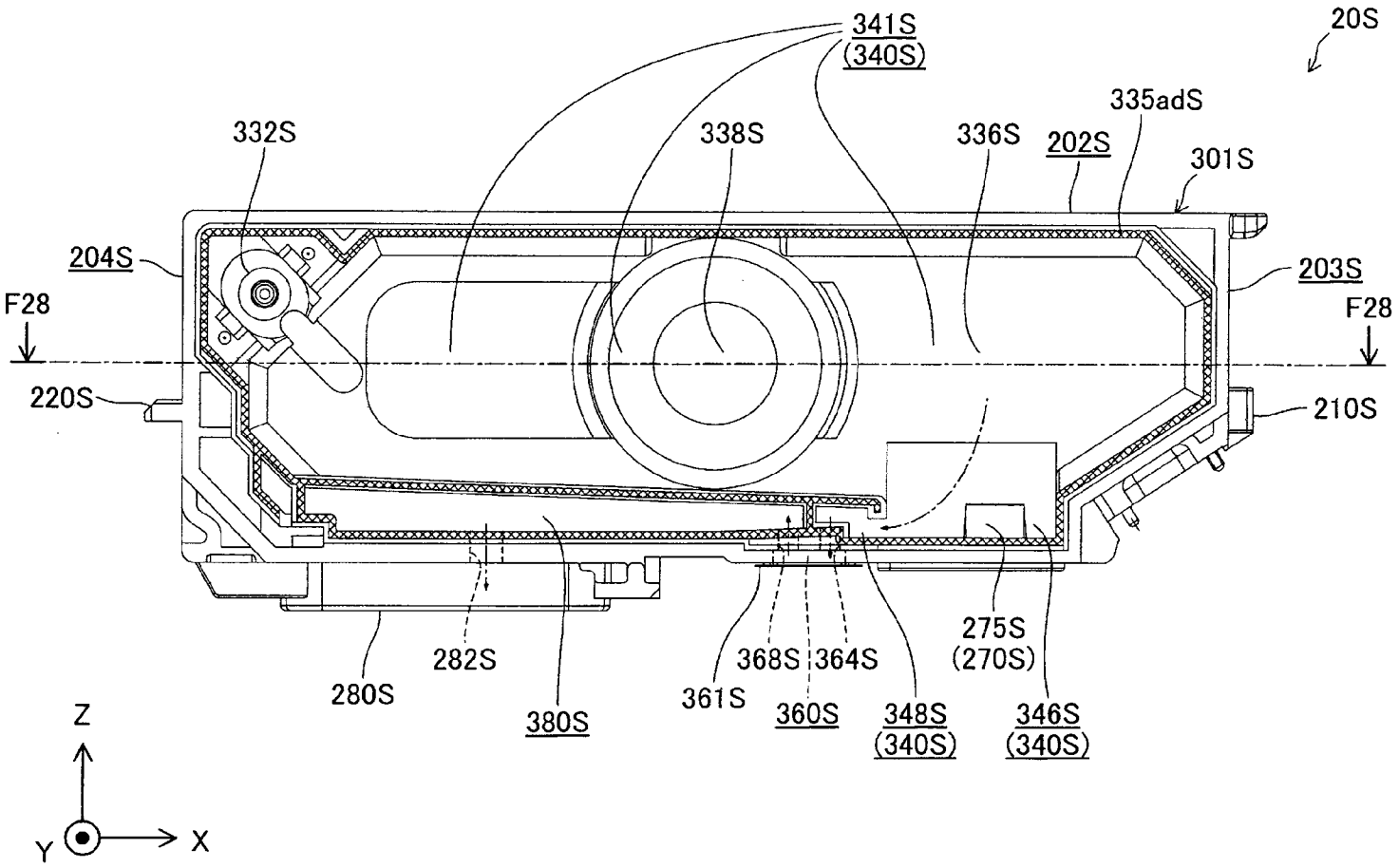
FIG. 27 is a left side surface diagram illustrating a configuration of a main body member of a cartridge.
Figure 28:
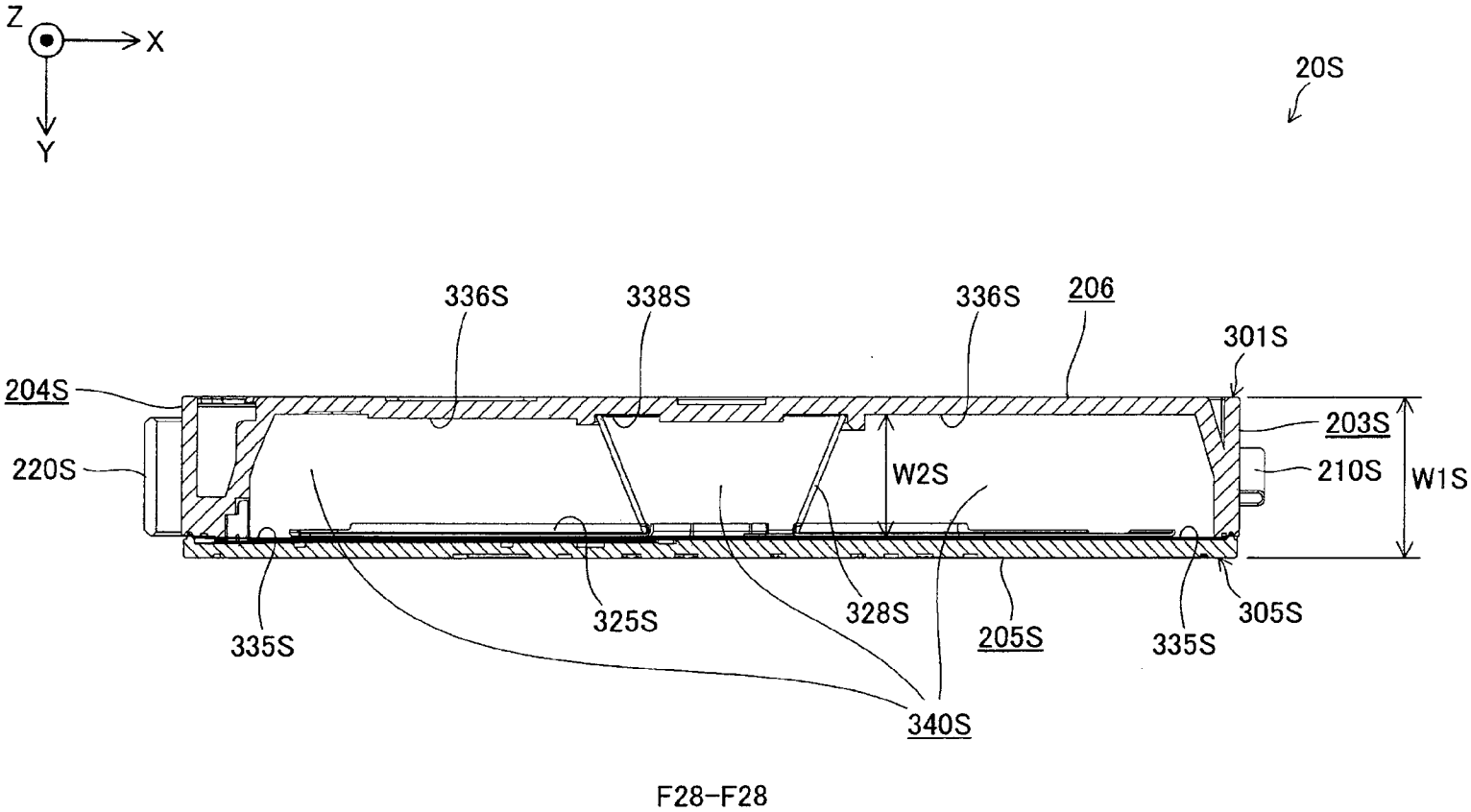
FIG. 28 is a cross-sectional diagram illustrating a cartridge cut in a position corresponding to an arrow F28-F28 in FIG. 27.

FIG. 27 is a left side surface diagram illustrating the configuration of the main body member 301S of the cartridge 20S. FIG. 28 is a cross-sectional diagram illustrating the cartridge 20S cut in a position corresponding to the arrow F28-F28 in FIG. 27. As shown in FIG. 27 and FIG. 28, the cartridge 20S has a main ink chamber 340S, a connecting path 360S, and a sub ink chamber 380S as parts which configure the ink containing section 300S.

As shown in FIG. 26 to FIG. 28, in the present embodiment, the main body member 301S of the cartridge 20S is a member which is obtained by integrally forming structures such as the first surface 201S, the second surface 202S, the third surface 203S, the fourth surface 204S, the sixth surface 206S, the substrate side fastening section 210S, the supply port side fastening sections 220S, the protruding section 260S, the ink supply port 280S, and the like. In addition to these structures, the main body member 301S has a valve containing section 332S, an intermediate wall 336S, a peripheral convex section 335*ad*S. In the present embodiment, the main body member 301S is made of synthetic resin (for example, polypropylene (PP) or polyacetal (POM)).

As shown in FIG. 28, the intermediate wall 336S of the main body member 301S is a wall section which configures the sixth surface 206S and defines the −Y axial direction side of the ink containing section 300S along the Z axis and the X axis. In the present embodiment, the intermediate wall 336S has a retaining section 338S which retains the elastic member 328S.

As shown in FIG. 27, the peripheral convex section 335*ad*S of the main body member 301S is provided in the periphery of a part of the ink containing section 300S open to the +Y axial direction in the main body member 301S, and has a convex shape in the +Y axial direction. In FIG. 27, the peripheral convex section 335*ad*S is illustrated with cross-hatching. The film member 335S is attached to the peripheral convex section 335*ad*S in a closed state.

As shown in FIG. 26 to FIG. 28, the main ink chamber 340S forms a space which can contain ink in the cartridge 20S. In the present embodiment, the main ink chamber 340S is constructed of the main body member 301S and the film member 335S. The main ink chamber 340S has a containing region 341S, a detection region 346S, and a communicating path 348S.

As shown in FIG. 27 and FIG. 28, the containing region 341S in the main ink chamber 340S is formed from the +X axial direction side to the −X axial direction side between the fifth surface 205S and the sixth surface 206S. The plate member 325S and the elastic member 328S are arranged in the containing region 341S which construct the negative pressure generating member in cooperation with each other.

As shown in FIG. 28, the relationship between a length W1S and a length W2S satisfies W2S<W1S, where W1S is a length of the cartridge 20S along the Y axis from the fifth surface 205S to the sixth surface 206S, and W2S is a length of the plate member 325S and the elastic member 328S arranged in the containing region 341S along the Y axis. The length W2S is also a length between the retaining section 338S of the main body member 301S and the film member 335S along the Y axis. In the present embodiment, the length W2S is also a length of the containing region 341S along the Y axis. In the present embodiment, the length W2S in the cartridge 20S is similar to the length W2 in the cartridge 20.

The detection region 346S in the main ink chamber 340S is configured to detect ink in the main ink chamber 340S. As shown in FIG. 27, the prism 275S of the detection element 270S is provided in the detection region 346S, and ink in the main ink chamber 340S can be detected using the detection element 270S. The detection region 346S is formed closer to the third surface 203S than the retaining section 338S. The detection region 346S is adjacent to the containing region 341S on the −Z axial direction side, and has a shape in which a part of the containing region 341S is expanded in the −Z axial direction.

The communicating path 348S in the main ink chamber 340S communicates the detection region 346S and the connecting path 360S. As shown in FIG. 27, in the present embodiment, the communicating path 348S is adjacent to the detection region 346S on the −X axial direction side. In the present embodiment, the communicating path 348S leads to the connecting path 360S on the −Z axial direction side via a through hole 364S.

As shown in FIG. 27, the connecting path 360S in the cartridge 20S forms a space which can contain ink, and communicates the main ink chamber 340S and the sub ink chamber 380S. In the present embodiment, the connecting path 360S is constructed of the main body member 301S and the film member 361S. The connecting path 360S is provided on the −Z axial direction side with respect to the main ink chamber 340S and the sub ink chamber 380S. The connecting path 360S leads to the main ink chamber 340S on the +Z axial direction side via the through hole 364S, and leads to the sub ink chamber 380S on the +Z axial direction side via a through hole 368S. Consequently, the connecting path 360S serves as a backflow preventing section which prevents backflow of ink from the sub ink chamber 380S to the main ink chamber 340S.

As shown in FIG. 27, the sub ink chamber 380S in the cartridge 20S forms a space which can contain ink, and communicates the main ink chambers 340S and an ink flow path 282S. In the present embodiment, the sub ink chamber 380 is constructed of the main body member 301 and the film member 335. As shown in FIG. 27, the sub ink chamber 380S is provided on the −Z axial direction side with respect to the containing region 341S in the main ink chamber 340S, on the −X axial direction side with respect to the detection region 346S, and on the +Z axial direction side with respect to the connecting path 360S.

In order to fill ink in the cartridge 20S, similarly to the cartridge 20, a through hole 322HS of the valve member 322S is blocked from outside, and then the pressure inside the cartridge 20S is reduced from the ink supply port 280S. Then, ink is supplied to the ink supply port 280S, and the ink is aspirated from the ink supply port 280S to the inside of the cartridge 20S. In this manner, ink is filled in the main ink chamber 340S, the connecting path 360S, and the sub ink chamber 380S in the cartridge 20S.

As shown by the arrow in FIG. 27, ink in the main ink chamber 340S is distributed from the detection region 346S to the communicating path 348S, passes the through hole 364S, and is distributed to the connecting path 360S. As shown by the arrow in FIG. 27, ink in the connecting path 360S passes the through hole 368S, and is distributed to the sub ink chamber 380S. As shown by the arrow in FIG. 27, ink in the sub ink chamber 380S passes the ink flow path 282S, and is supplied from the ink supply port 280S to the outside of the cartridge 20S. As explained with reference to FIG. 21 to FIG. 23, the internal pressure of the cartridge 20S is maintained in an appropriate pressure range similarly to the cartridge 20.

A-5. Effects

According to the first embodiment as described above, in the cartridge 20 in which the number of the ink supply ports 280 is N (N=2), as shown in FIG. 19, the relationship between the length W1 along the Y axis from the fifth surface 205 to the sixth surface 206 and the length W2 of the elastic member 328 as the negative pressure generating member in a state of being provided between the fifth surface 205 and the sixth surface 206 satisfies W2<W1/N. Consequently, it is possible to share the elastic member 328 as the negative pressure generating member with another cartridge 20S which has a length along the Y axis corresponding to one of the ink supply ports 280. As a result, it is possible to reduce the cost of the cartridge 20 which has two ink supply ports 280.

As shown in FIG. 19, in the cartridge 20, the main ink chamber 340 includes the first region 341 in which the elastic member 328 as the negative pressure generating member is provided and the second region 342 whose length along the Y axis is greater than W1/N. Consequently, it is possible to change the volume of the main ink chamber 340 while making it possible to share the elastic member 328 as the negative pressure generating member provided in the main ink chamber 340.

As shown in FIG. 19, in the cartridge 20, the film member 335 as the first defining plane has a shape along the fifth surface 205 all over the first region 341 and the second region 342, and the intermediate wall 336 as the second defining plane has a shape in which a part of the intermediate wall 336 corresponding to the second region 342 protrudes toward the sixth surface 206. Consequently, it is possible to change the volume of the main ink chamber 340 while making it possible to share the film member 335 as the first defining plane. It is also possible to share a mold by changing a bush in the mold which corresponds to the second region 342 in the case of integrally forming the intermediate wall 336 as the second defining plane using the mold.

As shown in FIG. 17, in the cartridge 20, the second region 342 is positioned closer to the fourth surface 204 (−X axial direction side) in the main ink chamber 340, and the detection region 346 is positioned closer to the third surface 203 (+X axial direction side) in the main ink chamber 340. Specifically, since the second region 342 and the detection region 346 are positioned away from each other in the X axial direction, influence on detection of ink in the detection region 346 can be controlled.

In the cartridge 20, the detection region 346 is adjacent to the first region 341, and the relationship among the length Pw along the Y axis of the detection element 270 provided in the detection region 346, the length Cw1 along the Y axis of the first region 341 and the length W1 along the Y axis of the cartridge 20 satisfies Pw≤Cw1≤W1/N. Therefore, compared to a case where the detection region 346 is adjacent to the second region 342 whose length along the Y axis is greater than W1/N, it is possible to make ink in the detection region 346 stable. As a result, false detection of ink in the detection region 346 can be controlled. Particularly, in the present embodiment, since the length Pw of the detection element 270 and the length Cw1 of the first region 341 are not significantly different, false detection of ink in the detection region 346 can further be controlled.

Also, according to the first embodiment described above, as shown in FIG. 20, in the cartridge 20, ink passing through the detection region 346 in the main ink chamber is branched into each of the ink supply ports 280 by the sub ink chamber 380 which serves as the branch communicating section. It is thus possible to secure the correlation between the state of ink in the detection region 346 and the remaining amount of ink which can be supplied from each of the ink supply ports 280. As a result, it is possible to improve the accuracy in detecting the remaining amount of ink which can be supplied from each of the ink supply ports 280 corresponding to the state of ink in the detection region 346. Further, in the cartridge 20, the connecting path 360 serving as the backflow preventing section can prevent false detection of the remaining amount of ink caused by ink which flows back from the sub ink chamber 380 to the detection region 346.

A-6. Modified Example of First Embodiment

In the cartridge 20 of the embodiment described above, the length Cw1 of the first region 341 along the Y axis in the ink containing section 300 is greater than the length W2 of the elastic member 328 along the Y axis. However, the length Cw1 may be the same as the length W2. Consequently, it is possible to make a basic mold common with another cartridge 20S.

In the cartridge 20 of the embodiment described above, the detection element 270 and the connecting path 360 are provided in a position which cuts across the plane CXa. However, the detection element 270 and the connecting path 360 may be provided in a position which cuts across the plane CXb.

In the cartridge 20 of the embodiment described above, the optical detection element 270 is used to detect ink in the detection region 346. However, it may be possible to use a detection element (including a sensor) which detects mechanically, electromagnetically, thermally, acoustically, or chemically.

In the cartridge 20 of the embodiment described above, the connecting path 360 as the backflow preventing section is provided between the main ink chamber 340 and the sub ink chamber 380. However, various kinds of check valves may be provided as the backflow preventing section in addition to the connecting path 360 or instead of the connecting path 360.

In the cartridge 20 of the embodiment described above, as shown in FIG. 19, the main ink chamber 340 is provided closer to the fifth surface 205. However, the main ink chamber 340 may be provided closer to the sixth surface 206, or between the fifth surface 205 and the sixth surface 206.

In the cartridge 20 of the embodiment described above, as shown in FIG. 17, in the main ink chamber 340, the second region 342 is provided closer to the fourth surface 204, and the detection region 346 is provided closer to the third surface 203, respectively. However, the second region 342 may be provided closer to the third surface 203, and the detection region 346 may be provided closer to the fourth surface 204, respectively.

In the cartridge 20 of the embodiment described above, the substrate side fastening section 210 is provided in the third surface 203 in a position which cuts across the plane CXa. However, the substrate side fastening section 210 may be provided in the third surface 203 in a position which cuts across the plane CXb, or the substrate side fastening section 210 may be provided in the third surface 203 in positions which cut across the plane CXa and the plane CXb, respectively.

In the cartridge 20 of the embodiment described above, the circuit substrate 40 is provided in the eighth surface 208 in a position which cuts across the plane CXa. However, the circuit substrate 40 may be provided in the eighth surface 208 in a position which cuts across the plane CXb, or the circuit substrate 40 may be provided in the eighth surface 208 in positions which cut across the plane CXa and the plane CXb, respectively.

B. Second Embodiment

Figure 29:
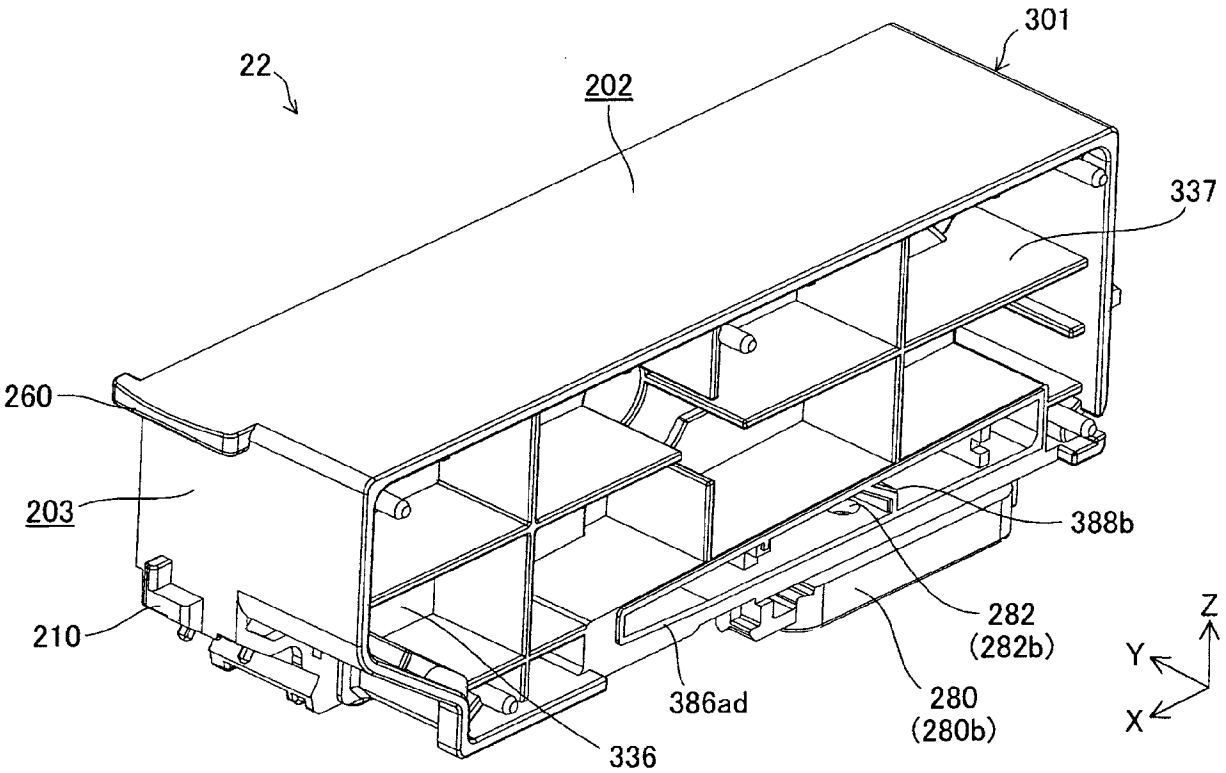
FIG. 29 is a perspective diagram illustrating a main body member of a cartridge according to a second embodiment.
Figure 30:
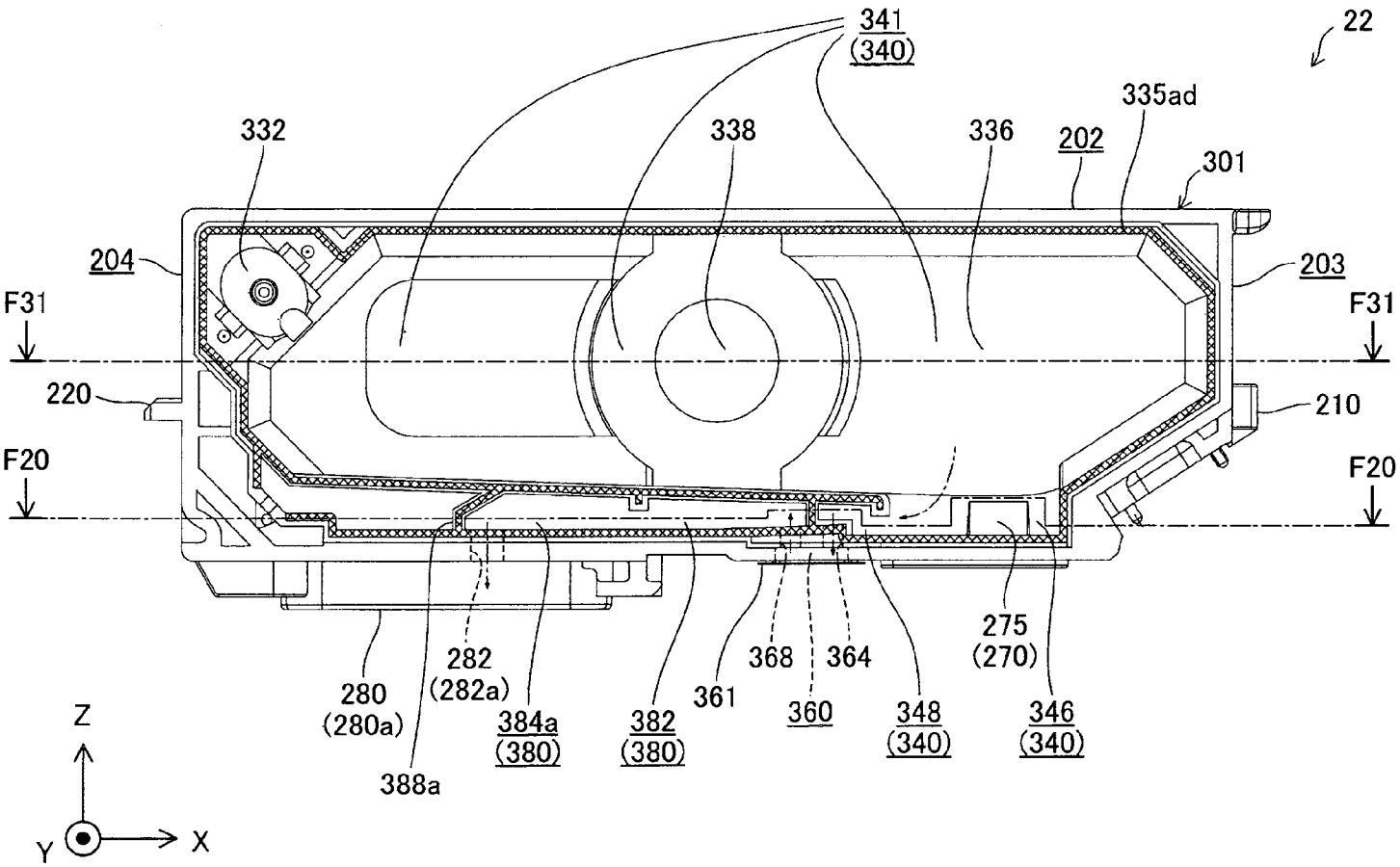
FIG. 30 is a left side surface diagram illustrating a configuration of a main body member of a cartridge according to a second embodiment.
Figure 31:
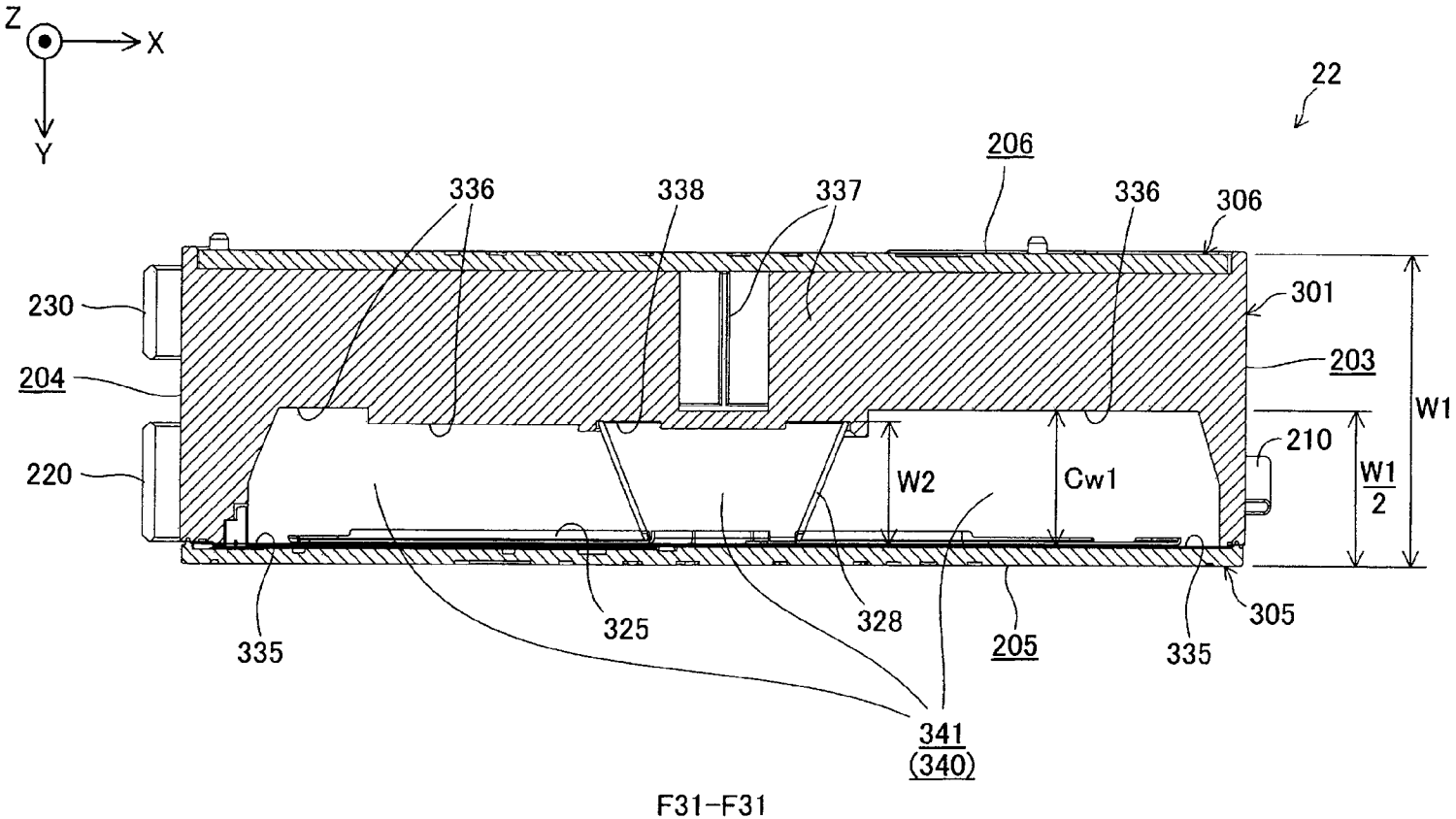
FIG. 31 is a cross-sectional diagram illustrating a cartridge cut in a position corresponding to an arrow F31-F31 in FIG. 30.

FIG. 29 is a perspective diagram illustrating the main body member 301 of a cartridge 22 according to a second embodiment. FIG. 30 is a left side surface diagram illustrating a configuration of the main body member 301 of the cartridge 22 according to the second embodiment. FIG. 31 is a cross-sectional diagram illustrating the cartridge 22 cut in a position corresponding to the arrow F31-F31 in FIG. 30. The second embodiment is similar to the first embodiment except that the cartridge 22 with no second region 342 provided in the main ink chamber 340 is used. Configurations similar to the first embodiment, including modified examples, can be applied to the second embodiment except that the second region 342 is not provided. In the explanation of the second embodiment, the same reference numerals will be given with regard to the configurations which are similar to the first embodiment, and the description thereof will be omitted.

As shown in FIG. 29 to FIG. 31, the cartridge 22 of the second embodiment is similar to the cartridge 20 of the first embodiment except that the protruding section 336*p* is not formed in the intermediate wall 336 and the second region 342 is not provided in the main ink chamber 340. The cross-sectional shape of the cartridge 22 cut in a position corresponding to the arrow F20-F20 in FIG. 30 is similar to the cross-sectional shape of the cartridge 20 of the first embodiment shown in FIG. 20.

As shown in FIG. 31, similarly to the cartridge 20 of the first embodiment, the relationship between the length W1 and the length W2 satisfies W2<W1/N, where W1 is the length of the cartridge 22 along the Y axis from the fifth surface 205 to the sixth surface 206, W2 is the length of the plate member 325 and the elastic member 328 arranged in the first region 341 along the Y axis, and N is the number of the ink supply ports 280. Specifically, in the cartridge 22 which has two ink supply ports 280, W2<W1/2 is satisfied.

In the present embodiment, the length Cw1 of the first region 341 along the Y axis is smaller than W1/N, that is, W1/2. In other embodiments, the length Cw1 of the first region 341 may be W1/N or more. In the present embodiment, the length Cw1 is greater than the length W2.

According to the second embodiment described above, in the cartridge 22 in which the number of the ink supply ports 280 is N (N=2), similarly to the cartridge 20 of the first embodiment, as shown in FIG. 31, it is possible to share the elastic member 328 as the negative pressure generating member with another cartridge 20S which has a length along the Y axis corresponding to one of the ink supply ports 280. As a result, it is possible to reduce the cost of the cartridge 22 which has the two ink supply ports 280. In addition to this, it is possible to achieve effects similar to the first embodiment, and in a case of applying a modified example, it is possible to achieve effects similar to a case of applying a modified example to the first embodiment.

C. Third Embodiment

Figure 32:
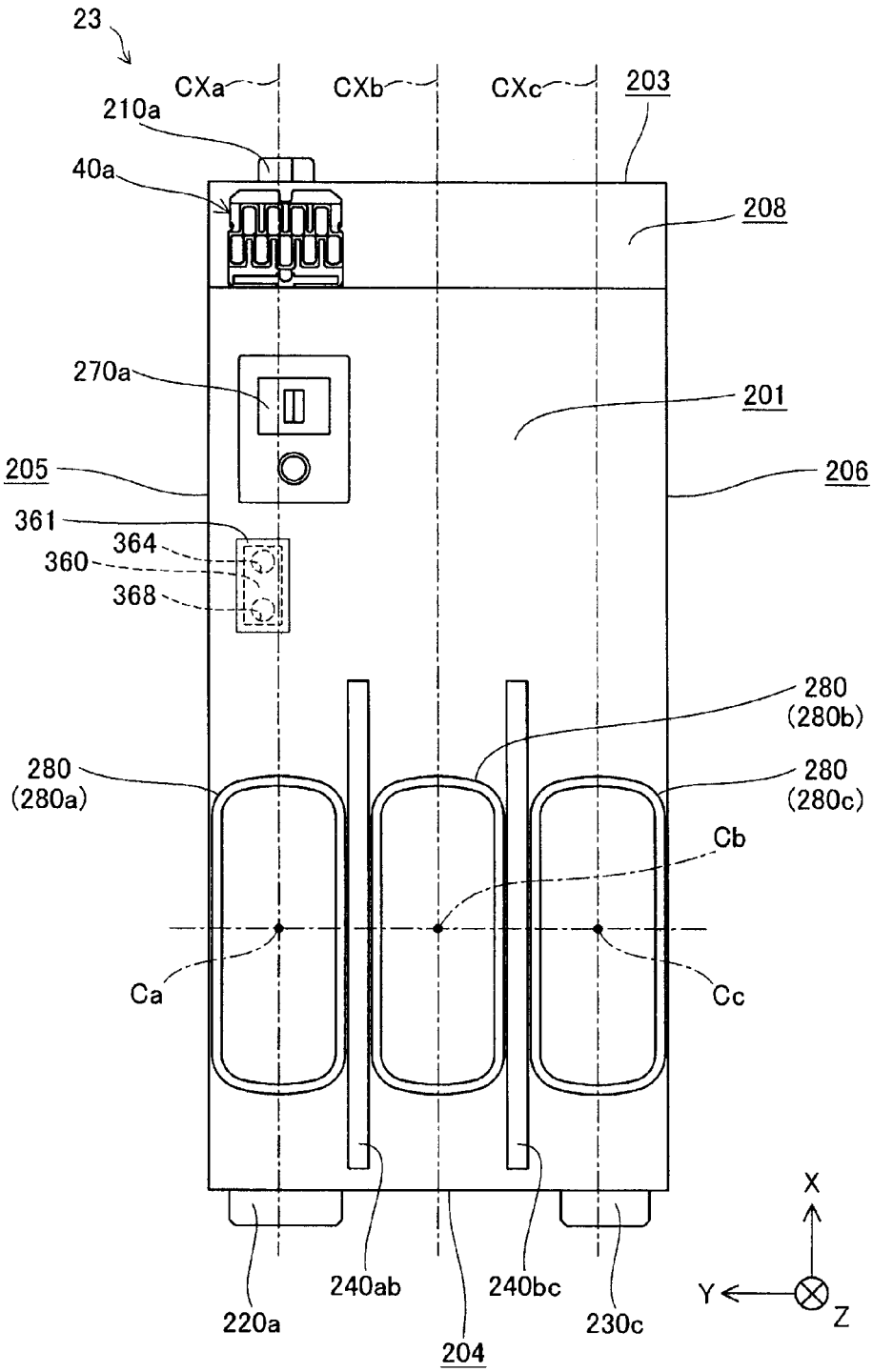
FIG. 32 is a bottom surface diagram illustrating a configuration of a cartridge according to a third embodiment.

FIG. 32 is a bottom surface diagram illustrating a configuration of a cartridge 23 according to a third embodiment. The third embodiment is similar to the first embodiment except that the cartridge 23 provided with three ink supply ports 280 is used. In the explanation of the third embodiment, the same reference numerals will be given with regard to the configurations which are similar to the first embodiment, and the description thereof will be omitted.

The cartridge 23 of the third embodiment is provided with the three ink supply ports 280. In the third embodiment, it is possible to mount one cartridge 23 with respect to the three slots SL which are adjacent to each other in the holder 60. As shown in FIG. 32, the three ink supply ports 280 are provided in the first surface 201 of the cartridge 23 in the third embodiment.

In the explanation of the present embodiment, a reference numeral "280" is used in cases where all of the three ink supply ports 280 in the cartridge 23 are being referred to. A reference numeral "280*a*" is used in cases indicating the ink supply port which is positioned at the end on the +Y axial direction side of the lineup of the three ink supply ports 280. A reference numeral "280*b*" is used in cases indicating the ink supply port which is positioned at the center of the lineup of the three ink supply ports 280. A reference numeral "280*c*" is used in cases indicating the ink supply port which is positioned at the end on the −Y axial direction side of the lineup of the three ink supply ports 280.

A central axis Ca shown in FIG. 32 corresponds to the central axis C of the ink supply pipe 640 which is connected to the ink supply port 280*a* in the mounting state where the cartridge 23 is mounted in the holder 60, and in the present embodiment, it is also the central axis of the ink supply port 280*a*. A central plane CXa shown in FIG. 32 is a plane which passes through the central axis Ca and which is parallel to the Z axis and the X axis. That is, the central plane CXa is a plane which passes through the center of the length along the Y axis of the ink supply port 280*a* and is orthogonal to the Y axis.

A central axis Cb shown in FIG. 32 corresponds to the central axis C of the ink supply pipe 640 which is connected to the ink supply port 280*b* in the mounting state where the cartridge 23 is mounted in the holder 60, and in the present embodiment, it is also the central axis of the ink supply port 280*b*. A central plane CXb shown in FIG. 32 is a plane which passes through the central axis Cb and which is parallel to the Z axis and the X axis. That is, the central plane CXb is a plane which passes through the center of the length along the Y axis of the ink supply port 280*b* and is orthogonal to the Y axis.

A central axis Cc shown in FIG. 32 corresponds to the central axis C of the ink supply pipe 640 which is connected to the ink supply port 280*c* in the mounting state where the cartridge 23 is mounted in the holder 60, and in the present embodiment, it is also the central axis of the ink supply port 280*c*. A central plane CXc shown in FIG. 32 is a plane which passes through the central axis Cc and which is parallel to the Z axis and the X axis. That is, the central plane CXc is a plane which passes through the center of the length along the Y axis of the ink supply port 280*c* and is orthogonal to the Y axis.

In the third embodiment, a groove section 240*ab* is provided between the ink supply port 280*a* and the ink supply port 280*b* and a groove section 240*bc* is provided between the ink supply port 280*b* and the ink supply port 280*c* in the first surface 201 of the cartridge 23. The groove section 240*ab* and the groove section 240*bc* are provided in positions which correspond to the partition plate 607 in the holder 60, are recessed toward the +Z axial direction with respect to the first surface 201, and are configured to receive the insertion of the partition plate 607 in a state where the ink supply ports 280 are connected to the ink supply pipe 640 in the same manner as the groove section 240 of the first embodiment.

In the third embodiment, a detection element 270*a* is provided in the first surface 201 of the cartridge 23 in a position which cuts across the plane CXa. The configuration of the detection element 270*a* in the third embodiment is similar to the detection element 270 in the first embodiment except that the arrangement is different. In the third embodiment, the connecting path 360 is provided in a position which cuts across the plane CXa corresponding to the detection element 270*a*.

In the third embodiment, a substrate side fastening section 210*a* is provided in the third surface 203 of the cartridge 23 in a position which cuts across the plane CXa. The configuration of the substrate side fastening section 210*a* in the third embodiment is similar to the substrate side fastening section 210 in the first embodiment except that the arrangement is different.

In the third embodiment, a supply port side fastening section 220*a* is provided in the fourth surface 204 of the cartridge 23 in a position which cuts across the plane CXa and a supply port side fastening section 230*c* is provided in the fourth surface 204 of the cartridge 23 in a position which cuts across the plane CXc. The configuration of the supply port side fastening section 220*a* in the third embodiment is similar to the supply port side fastening section 220 in the first embodiment except that the arrangement is different. The configuration of the supply port side fastening section 230*c* in the third embodiment is similar to the supply port side fastening section 230 in the first embodiment except that the arrangement is different.

In the third embodiment, a circuit substrate 40*a* is provided in the eighth surface 208 of the cartridge 23 in a position which cuts across the plane CXa. The configuration of the circuit substrate 40*a* in the third embodiment is similar to the circuit substrate 40 in the first embodiment except that the arrangement is different.

The internal configuration of the cartridge 23 in the third embodiment is similar to the cartridge 20 in the first embodiment except that the sub ink chamber 380 serves as a branch communicating section which is branched into each of the ink flow paths 282 corresponding to the three ink supply ports 280 so as to communicate the main ink chamber 340 and the ink flow paths 282. Similarly to the cartridge 20 in the first embodiment, the cartridge 23 in the third embodiment is provided with the connecting path 360 which serves as a backflow preventing section for preventing backflow of ink from the sub ink chamber 380 to the main ink chamber 340.

According to the third embodiment described above, in the cartridge 23 in which the number of the ink supply ports 280 is N (N=3), similarly to the cartridge 20 in the first embodiment, it is possible to share the elastic member 328 as the negative pressure generating member with another cartridge 20S which has a length along the Y axis corresponding to one of the ink supply ports 280. As a result, it is possible to reduce the cost of the cartridge 23 which has the three ink supply ports 280. In addition to this, it is possible to achieve effects similar to the first embodiment with respect to the parts in which configurations similar to the first embodiment are employed.

As a modified example of the third embodiment, a cartridge may be configured to be provided with four or more of the ink supply ports 280 with two or more of the ink supply ports 280 being provided along with the groove section 240 between the ink supply port 280*a* and the ink supply port 280*c* in the same manner as the ink supply port 280*b*. In addition, a cartridge may be configured to be provided with four or more of the ink supply ports 280 with one or more of the ink supply ports 280 being provided along with the groove section 240 on at least either one of the +Y axial direction side of the ink supply port 280*a* and the −Y axial direction side of the ink supply port 280*c*.

In the cartridge 23 of the embodiment described above, the detection element 270*a* is provided in the first surface 201 in a position which cuts across the plane CXa. However, the detection element 270 may be provided in the first surface 201 in a position which cuts across the plane CXb, or the detection element 270 may be provided in the first surface 201 in a position which cuts across the plane CXc.

In the cartridge 23 of the embodiment described above, the substrate side fastening section 210*a* is provided in the third surface 203 in a position which cuts across the plane CXa. However, the substrate side fastening section 210 may be provided in the third surface 203 in a position which cuts across the plane CXb, the substrate side fastening section 210 may be provided in the third surface 203 in a position which cuts across the plane CXc, or the substrate side fastening section 210 may be provided in the third surface 203 in positions which cut across the plane CXa, the plane CXb, and the plane CXc, respectively.

In the cartridge 23 of the embodiment described above, the supply port side fastening section 230 is not provided in the fourth surface 204 in a position which cuts across the plane CXb. However, the supply port side fastening section 230 may be provided in the fourth surface 204 in a position which cuts across the plane CXb.

In the cartridge 23 of the embodiment described above, the circuit substrate 40*a* is provided in the eighth surface 208 in a position which cuts across the plane CXa. However, the circuit substrate 40 may be provided in the eighth surface 208 in a position which cuts across the plane CXb, the circuit substrate 40 may be provided in the eighth surface 208 in a position which cuts across the plane CXc, or the circuit substrate 40 may be provided in the eighth surface 208 in positions which cut across the plane CXa, the plane CXb, and the plane CXc, respectively.

D. Fourth Embodiment

Figure 33:
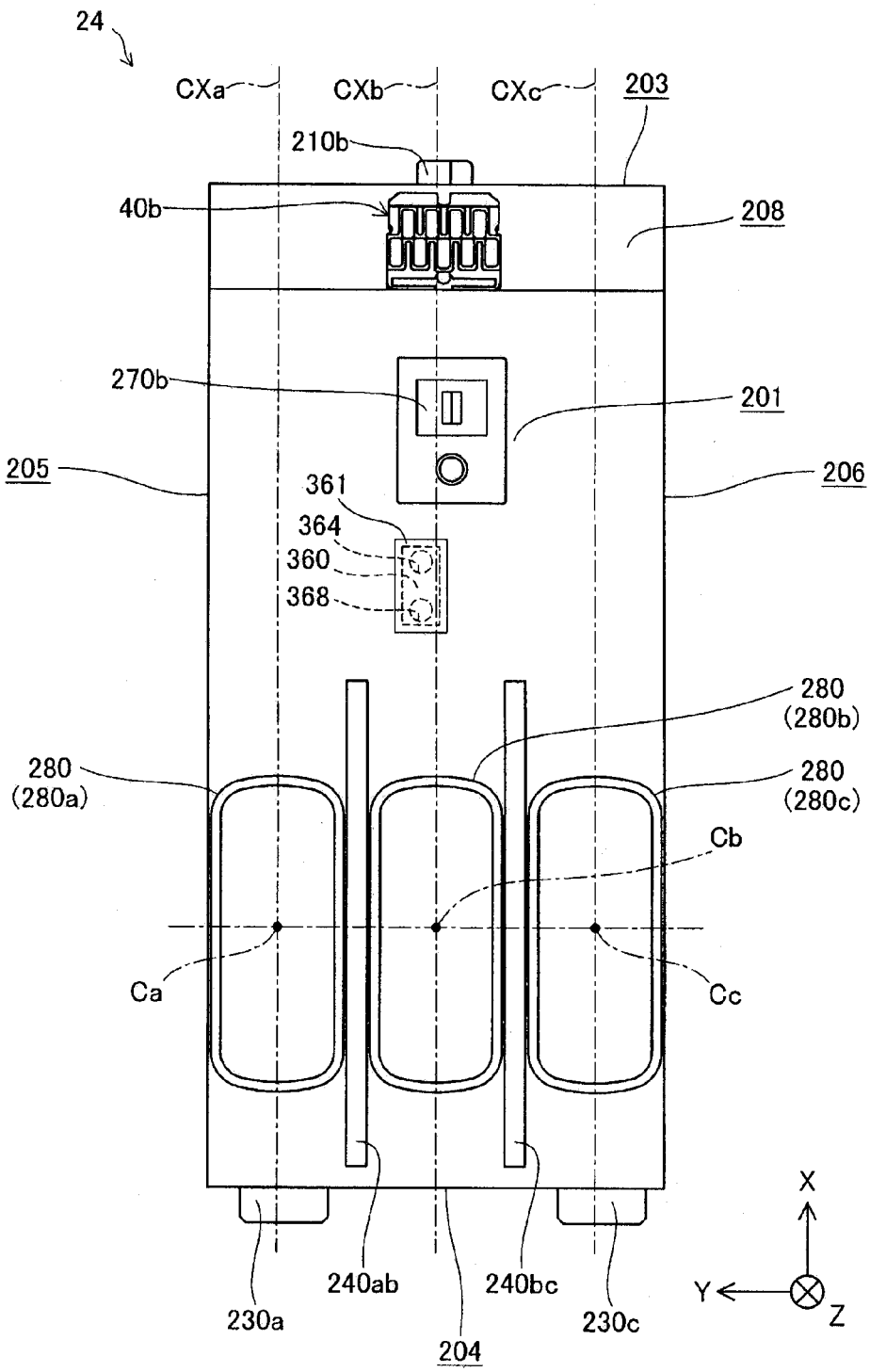
FIG. 33 is a bottom surface diagram illustrating a configuration of a cartridge according to a fourth embodiment.

FIG. 33 is a perspective diagram illustrating a configuration of a cartridge 24 according to a fourth embodiment. The fourth embodiment is similar to the first embodiment except that a cartridge 24 provided with three ink supply ports 280 is used. In the explanation of the fourth embodiment, the same reference numerals will be given with regard to the configurations which are similar to the first embodiment, and the description thereof will be omitted.

The cartridge 24 of the fourth embodiment is provided with the three ink supply ports 280. In the fourth embodiment, it is possible to mount one cartridge 24 in the three slots SL which are adjacent to each other in the holder 60. As shown in FIG. 33, the three ink supply ports 280 are provided in the first surface 201 of the cartridge 24 in the fourth embodiment.

In the explanation of the present embodiment, a reference numeral "280" is used in cases where all of the three ink supply ports 280 in the cartridge 24 are being referred to. A reference numeral "280*a*" is used in cases indicating the ink supply port which is positioned at the end on the +Y axial direction side of the lineup of the three ink supply ports 280. A reference numeral "280*b*" is used in cases indicating the ink supply port which is positioned at the center of the lineup of the three ink supply ports 280. A reference numeral "280*c*" is used in cases indicating the ink supply port which is positioned at the end on the −Y axial direction side of the lineup of the three ink supply ports 280. The central axes Ca, Cb, and Cc and the planes CXa, CXb, and CXc shown in FIG. 32 are similar to the fourth embodiment.

In the fourth embodiment, a groove section 240*ab* is provided between the ink supply port 280*a* and the ink supply port 280*b* and a groove section 240*bc* is provided between the ink supply port 280*b* and the ink supply port 280*c* in the first surface 201 of the cartridge 24 in the same manner as the third embodiment. The groove section 240*ab* and the groove section 240*bc* are provided in positions which correspond to the partition plate 607 in the holder 60, are recessed to the +Z axial direction with respect to the first surface 201, and are configured to receive the insertion of the partition plate 607 in a state where the ink supply ports 280 are connected to the ink supply pipe 640 in the same manner as the groove section 240 of the first embodiment.

In the fourth embodiment, a detection element 270*b* is provided in the first surface 201 of the cartridge 24 in a position which cuts across the plane CXb. The configuration of the detection element 270*b* in the fourth embodiment is similar to the detection element 270 in the first embodiment except that the arrangement is different. In the fourth embodiment, the connecting path 360 is provided in a position which cuts across the plane CXb corresponding to the detection element 270*b*.

In the fourth embodiment, a substrate side fastening section 210*b* is provided in the third surface 203 of the cartridge 24 in a position which cuts across the plane CXb. The configuration of the substrate side fastening section 210*b* in the fourth embodiment is similar to the substrate side fastening section 210 in the first embodiment except that the arrangement is different.

In the fourth embodiment, a supply port side fastening section 230*a* is provided in the fourth surface 204 of the cartridge 24 in a position which cuts across the plane CXa and a supply port side fastening section 230*c* is provided in the fourth surface 204 of the cartridge 24 in a position which cuts across the plane CXc. The configurations of the supply port side fastening section 230*a* and the supply port side fastening section 230*c* in the fourth embodiment are similar to the supply port side fastening section 230 in the first embodiment except that the arrangement is different.

In the fourth embodiment, a circuit substrate 40*b* is provided in the eighth surface 208 of the cartridge 24 in a position which cuts across the plane CXb. The configuration of the circuit substrate 40*b* in the fourth embodiment is similar to the circuit substrate 40 in the first embodiment except that the arrangement is different.

The internal configuration of the cartridge 24 in the fourth embodiment is similar to the cartridge 20 in the first embodiment except that the sub ink chamber 380 serves as a branch communicating section which is branched into each of the ink flow paths 282 corresponding to the three ink supply ports 280 so as to communicate the main ink chamber 340 and the ink flow paths 282. Similarly to the cartridge 20 in the first embodiment, the cartridge 24 in the fourth embodiment is provided with the connecting path 360 which serves as a backflow preventing section for preventing backflow of ink from the sub ink chamber 380 to the main ink chamber 340.

According to the fourth embodiment described above, in the cartridge 24 in which the number of the ink supply ports 280 is N (N=3), similarly to the cartridge 20 in the first embodiment, it is possible to share the elastic member 328 as the negative pressure generating member with another cartridge 20S which has a length along the Y axis corresponding to one of the ink supply ports 280. As a result, it is possible to reduce the cost of the cartridge 24 in which the three ink supply ports 280 are provided. In addition to this, it is possible to achieve effects similar to the first embodiment with respect to the parts in which configurations similar to the first embodiment are employed.

As a modified example of the fourth embodiment, a cartridge may be configured to be provided with four or more ink supply ports 280 with one or more of the ink supply ports 280 being provided along with the groove section 240 at least either one of between the ink supply port 280*a* and the ink supply port 280*b* or between the ink supply port 280*b* and the ink supply port 280*c*. In addition, a cartridge may be configured to be provided with four or more ink supply ports 280 with one or more of the ink supply ports 280 being provided along with the groove section 240 at least either one of the +Y axial direction side of the ink supply port 280*a* or the −Y axial direction side of the ink supply port 280*c*.

In the cartridge 24 of the embodiment described above, the detection element 270*b* is provided in the first surface 201 in a position which cuts across the plane CXb. However, the detection element 270 may be provided in the first surface 201 in a position which cuts across the plane CXa, or the detection element 270 may be provided in the first surface 201 in a position which cuts across the plane CXc.

In the cartridge 24 of the embodiment described above, the substrate side fastening section 210*b* is provided in the third surface 203 in a position which cuts across the plane CXb. However, the substrate side fastening section 210 may be provided in the third surface 203 in a position which cuts across the plane CXa, the substrate side fastening section 210 may be provided in the third surface 203 in a position which cuts across the plane CXc, or the substrate side fastening section 210 may be provided in the third surface 203 in positions which cut across the plane CXa, the plane CXb, and the plane CXc, respectively.

In the cartridge 24 of the embodiment described above, the supply port side fastening section 220 is not provided in the fourth surface 204 in a position which cuts across the plane CXb. However, the supply port side fastening section 220 may be provided in the fourth surface 204 in a position which cuts across the plane CXb.

In the cartridge 24 of the embodiment described above, the circuit substrate 40*b* is provided in the eighth surface 208 in a position which cuts across the plane CXb. However, the circuit substrate 40 may be provided in the eighth surface 208 in a position which cuts across the plane CXa, the circuit substrate 40 may be provided in the eighth surface 208 in a position which cuts across the plane CXc, or the circuit substrate 40 may be provided in the eighth surface 208 in positions which cut across the plane CXa, the plane CXb, and the plane CXc, respectively.

E. Modified Example

Embodiments of the present invention have been described above but the present invention is not limited to these embodiments and various aspects are naturally possible within a scope which does not depart from the gist of the present invention.

E-1. Modified Examples of Outer Appearance of Cartridge

Figure 34A:
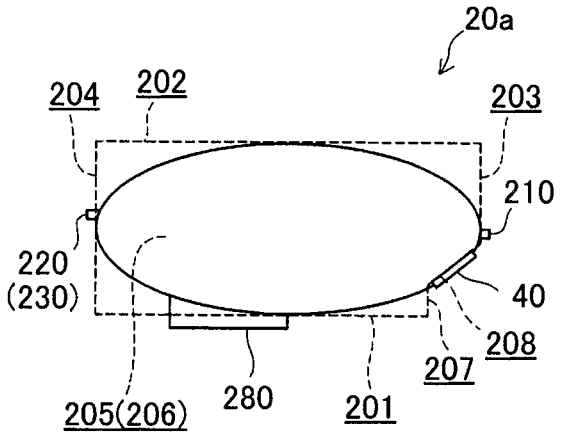
FIG. 34A is an explanatory diagram illustrating a modified example of an outer appearance of a cartridge.
Figure 34B:
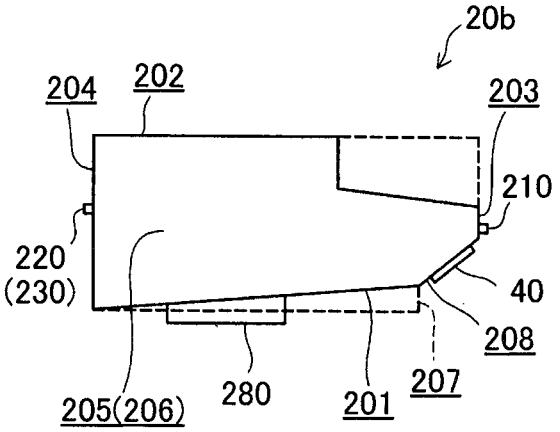
FIG. 34B is an explanatory diagram illustrating a modified example of an outer appearance of a cartridge.

FIG. 34A and FIG. 34B are explanatory diagrams illustrating modified examples of an outer appearance of a cartridge. Two modified examples which are different in terms of the outer appearance of the cartridge are illustrated in FIG. 34A and FIG. 34B. In the explanation of the modified examples, the same reference numerals are given with regard to configurations which are similar to the cartridge 20 in the first embodiment, and the description thereof is omitted.

The outer shell of a cartridge 20*a* of FIG. 34A has a side surface which is an elliptical shape or an oval shape. The substrate side fastening section 210 and the circuit substrate 40 are provided on the front surface side of the cartridge 20*a*. The ink supply port 280 is formed on the bottom surface side of the cartridge 20*a*. The supply port side fastening sections 220 and 230 are formed on the rear surface side of the cartridge 20*a*. The cartridge 20*a* has a constant width when the cartridge 20*a* is viewed from the front surface side.

A cartridge 20*b* of FIG. 34B is similar to the cartridge 20 of the first embodiment except that a part where the second surface 202 and the third surface 203 intersect is cut out and the seventh surface 207 is omitted by the first surface 201 being inclined to the eighth surface 208.

In either of the cartridges 20*a* and 20*b* which are the modified examples shown in FIG. 34A and FIG. 34B, the substrate side fastening section 210, the supply port side fastening sections 220 and 230, the ink supply port 280, and the circuit substrate 40 are provided in positions which correspond to the cartridge 20 of the first embodiment. Consequently, either of the cartridges 20*a* and 20*b* which are the modified examples is compatible with the cartridge 20 of the first embodiment.

As is understood from either of the modified examples in FIG. 34A and FIG. 34B, various modified examples can be considered in regard to the shape of the outer appearance of the cartridge. Even in a case where the shape of the outer appearance of the cartridge has a shape other than a shape which is substantially cuboidal, it is possible to consider, for example, six surfaces which are substantially rectangular in a virtual manner as shown by dotted lines in FIG. 34A and FIG. 34B, that is, the first surface 201 (the bottom surface), the second surface 202 (the upper surface), the third surface 203 (the front surface), the fourth surface 204 (the rear surface), the fifth surface 205 (the left side surface), and the sixth surface 206 (the right side surface) shown in FIG. 7 and FIG. 8. In the present specification, the term "surface" (plane) is used with a meaning which encompasses both a plane in a virtual manner (a virtual plane, or a plane which does not actually exist) and an actual surface such as described in FIG. 7 and FIG. 8. In addition, in the present specification, the term "surface" is used with a meaning which encompasses both a flat plane and a curved plane.

E-2. First Cartridge Using Adaptor

Figure 35:
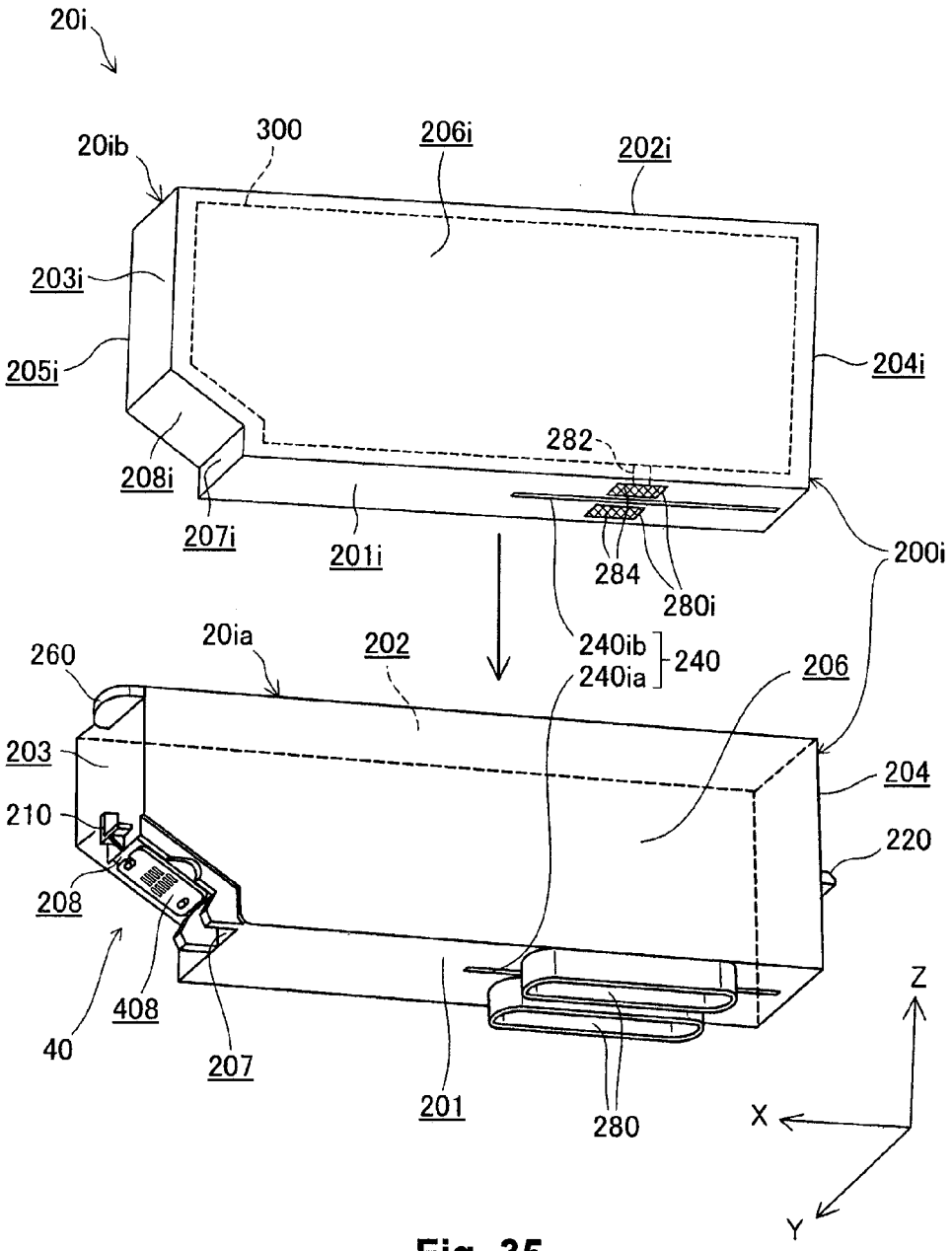
FIG. 35 is a perspective diagram illustrating a configuration of a cartridge which uses an adapter.

FIG. 35 is a perspective diagram illustrating a configuration of a cartridge 20*i* which uses an adapter. The cartridge 20*i* is configured to be separated into an adaptor 20*ia* and a containing member 20*ib*. The containing member 20*ib* has the ink containing section 300 which contains a printing material. In a case where there is no longer any printing material in the ink containing section 300, it is possible to exchange the containing member 20*ib* with a new containing member 20*ib* or replenish a printing material in the ink containing member 300. When performing exchanging of the containing member 20*ib* or replenishing of a printing material, it is possible to reuse the adaptor 20*ia*. The cartridge 20*i* of FIG. 35 is compatible with the cartridge 20 of the first embodiment shown in FIG. 7.

An outer shell 200*i* of the cartridge 20*i* is configured by a combination of an outer shell of the adaptor 20*ia* and an outer shell of the containing member 20*ib*. The containing member 20*ib* has the ink flow path 282 and the leakage preventing member 284 in addition to the ink containing section 300.

The containing member 20*ib* of the cartridge 20*i* is provided with a second surface 202*i* which is equivalent to the second surface 202 of the cartridge 20*i*. The containing member 20*ib* is provided with a first surface 201*i*, a third surface 203*i*, a fourth surface 204*i*, a fifth surface 205*i*, a sixth surface 206*i*, a seventh surface 207*i*, and an eighth surface 208*i* which respectively correspond to the first surface 201, the third surface 203, the fourth surface 204, the fifth surface 205, the sixth surface 206, the seventh surface 207, and the eighth surface 208 of the cartridge 20*i*.

The first surface 201*i* and the second surface 202*i* oppose each other in the Z axial direction, the first surface 201*i* is positioned on the −Z axial direction side, and the second surface 202*i* is positioned on the +Z axial direction side. The third surface 203*i* and the fourth surface 204*i* oppose each other in the X axial direction, the third surface 203*i* is positioned on the +X axial direction side, and the fourth surface 204*i* is positioned on the −X axial direction side. The fifth surface 205*i* and the sixth surface 206*i* oppose each other in the Y axial direction, the fifth surface 205*i* is positioned on the +Y axial direction side, and the sixth surface 206*i* is positioned on the −Y axial direction side. The seventh surface 207*i* and the eighth surface 208*i* form connection surfaces which connect the first surface 201*i* and the third surface 203*i*.

Two containing member side supply ports 280*i* are provided in the first surface 201*i* in order to supply ink to the two ink supply ports 280 which are provided in the adaptor 20*ia*. The leakage preventing member 284 is provided in each of the two containing member side supply ports 280*i*. A concave section 240*ib* for configuring the groove section 240 is provided between the two containing member side supply ports 280*i*. The concave section 240*ib* is recessed toward the +Z axial direction side with respect to the first surface 201*i*.

The seventh surface 207*i* is a surface which intersects with the first surface 201*i* at a right angle. The seventh surface 207*i* is a surface (YZ plane) which is parallel to the Y axis and the Z axis. The seventh surface 207*i* as a step surface is a surface which rises up with regard to the first surface 201*i*. That is, the seventh surface 207*i* is a surface which extends from the first surface 201*i* in the +Z axial direction. The seventh surface 207*i* is positioned on the −X axial direction side and the −Z axial direction side with regard to the eighth surface 208*i*.

The eighth surface 208*i* is a surface which connects the seventh surface 207*i* and the third surface 203*i*. The eighth surface 208*i* is an inclined surface which is inclined toward a direction which includes components in the +X axial direction and the −Z axial direction. The eighth surface 208*i* is a surface which is inclined with regard to the first surface 201*i* and the third surface 203*i*. The eighth surface 208*i* is a surface which intersects with the fifth surface 205*i* and the sixth surface 206*i* at a right angle. The eighth surface 208*i* is inclined with regard to the XY plane and the YZ plane, and intersects with regard to the XZ plane at a right angle.

The adaptor 20*ia* of the cartridge 20*i* is provided with surfaces which are equivalent to the first surface 201, the third surface 203, the fourth surface 204, the fifth surface 205, the sixth surface 206, the seventh surface 207, and the eighth surface 208 of the cartridge 20*i*, respectively. The surface equivalent to the second surface 202 of the cartridge 20*i* out of the surfaces of the adaptor 20*ia* is opened. A space for receiving the containing member 20*ib* is formed in an inner portion of the adaptor 20*ia*. The ink supply ports 280 are provided in the first surface 201 of the adaptor 20*ia*.

A slit 240*ia* for configuring the groove section 240 is provided in the first surface 201 between the two ink supply ports 280. The slit 240*ia* provided in the first surface 201 of the adaptor 20*ia* and the concave section 240*ib* provided in the containing member 20*ib* are both provided in a position which corresponds to the partition plate 607 in the holder 60. Then, the groove section 240 is formed by combining the slit 240*ia* which is provided in the first surface 201 of the adaptor 20*ia* and the concave section 240*ib* which is provided in the containing member 20*ib*. As such, it is possible for the partition plate 607 to be received in the groove section 240 in a state where the ink supply ports 280 are connected to the ink supply pipe 640.

The configuration of the cartridge 20*i* of FIG. 35 is similar to the cartridge 20 of the first embodiment which is shown in FIG. 7 including the modified examples except that the adaptor 20*ia* and the containing member 20*ib* are able to be separated as described above. That is, the configuration of the ink containing section inside the containing member 20*ib* is similar to the cartridge 20 of the first embodiment except that the ink supply ports 280 are provided on the adaptor 20*ia* side. Here, in other embodiments or other modified examples, a configuration where the containing member and the adaptor are able to be separated may be adopted as with the cartridge 20*i* of FIG. 35. Here, the dimension and the ratio of each section in the cartridge 20*i* of FIG. 35 may be a dimension and a ratio which are similar to the first embodiment even though there are parts which are different from the first embodiment.

E-3. Second Cartridge Using Adaptor

Figure 36:
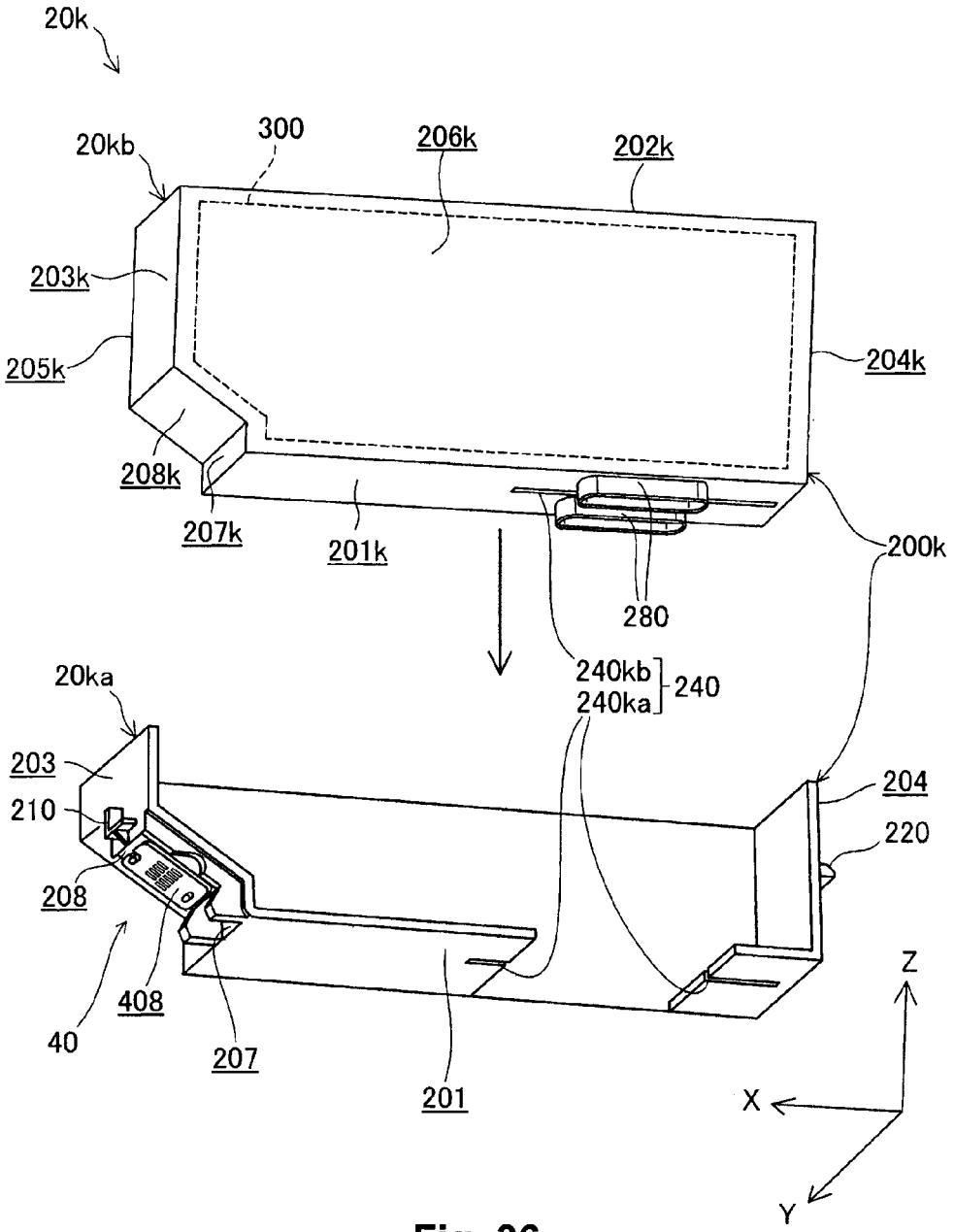
FIG. 36 is a perspective diagram illustrating a configuration of a cartridge which uses an adapter.

FIG. 36 is a perspective diagram illustrating a configuration of a cartridge 20*k* which uses an adapter. The cartridge 20*k* is configured to be separated into an adaptor 20*ka* and a containing member 20*kb*. The containing member 20*kb* has the ink containing section 300 which contains a printing material. In a case where there is no longer any printing material in the ink containing section 300, it is possible to exchange the containing member 20*kb* with a new containing member 20*kb* or replenish a printing material in the ink containing member 300. When performing exchanging of the containing member 20*kb* or replenishing of a printing material, it is possible to reuse the adaptor 20*ka*. The cartridge 20*k* in FIG. 36 is compatible with the cartridge 20 of the first embodiment shown in FIG. 7.

An outer shell 200*k* of the cartridge 20*k* is configured by a combination of an outer shell of the adaptor 20*ka* and an outer shell of the containing member 20*kb*. The containing member 20*kb* has the ink containing section 300 and the ink supply port 280.

The containing member 20*kb* of the cartridge 20*k* is provided with a second surface 202*k* and a sixth surface 206*k* which are respectively equivalent to the second surface 202 and the sixth surface 206 of the cartridge 20*k*. The containing member 20*kb* is provided with a first surface 201*k*, a third surface 203*k*, a fourth surface 204*k*, a fifth surface 205*k*, a seventh surface 207*k*, and an eighth surface 208*k* which respectively correspond to the first surface 201, the third surface 203, the fourth surface 204, the fifth surface 205, the seventh surface 207, and the eighth surface 208 of the cartridge 20*k*.

The first surface 201*k* and the second surface 202*k* oppose each other in the Z axial direction, the first surface 201*k* is positioned on the −Z axial direction side, and the second surface 202*k* is positioned on the +Z axial direction side. The third surface 203*k* and the fourth surface 204*k* oppose each other in the X axial direction, the third surface 203*k* is positioned on the +X axial direction side, and the fourth surface 204*k* is positioned on the −X axial direction side. The fifth surface 205*k* and the sixth surface 206*k* oppose each other in the Y axial direction, the fifth surface 205*k* is positioned on the +Y axial direction side, and the sixth surface 206*k* is positioned on the −Y axial direction side. The seventh surface

207*k* and the eighth surface 208*k* form connection surfaces which connect the first surface 201*k* and the third surface 203*k*.

A concave section 240*kb* for configuring the groove section 240 is provided in the first surface 201*k* between the two ink supply ports 280. The concave section 240*kb* is recessed toward the +Z axial direction side with respect to the first surface 201*k*.

The seventh surface 207*k* is a surface which intersects with the first surface 201*k* at a right angle. The seventh surface 207*k* is a surface (YZ plane) which is parallel to the Y axis and the Z axis. The seventh surface 207*k* as a step surface is a surface which rises up with regard to the first surface 201*k*. That is, the seventh surface 207*k* is a surface which extends from the first surface 201*k* in the +Z axial direction. The seventh surface 207*k* is positioned at the −X axial direction side and the −Z axial direction side with regard to the eighth surface 208*k*.

The eighth surface 208*k* is a surface which connects the seventh surface 207*k* and the third surface 203*k*. The eighth surface 208*k* is an inclined surface which is inclined toward a direction which includes components in the +X axial direction and the −Z axial direction. The eighth surface 208*k* is a surface which is inclined with regard to the first surface 201*k* and the third surface 203*k*. The eighth surface 208*k* is a surface which intersects with the fifth surface 205*k* and the sixth surface 206*k* at a right angle. The eighth surface 208*k* is inclined with regard to the XY plane and the YZ plane, and intersects with regard to the XZ plane at a right angle.

The adaptor 20*ka* of the cartridge 20*k* is provided with surfaces which are equivalent to the first surface 201, the third surface 203, the fourth surface 204, and the fifth surface 205 of the cartridge 20*k*. The surfaces equivalent to the second surface 202 and the sixth surface 206 of the cartridge 20*k* out of the surfaces of the adaptor 20*ka* are opened. A space for receiving the containing member 20*kb* is formed in an inner portion of the adaptor 20*ka*. The adaptor 20*ka* has an opening in a portion of the first surface 201 and is connected to the ink supply pipe 640 by the ink supply port 280 of the containing member 20*kb* being exposed via the opening.

A slit 240*ka* for configuring the groove section 240 is provided in the first surface 201 in a position which is equivalent to between the two ink supply ports 280, that is, in a position which corresponds to the concave section 240*kb* provided in the first surface 201*k* of the containing member 20*kb*. The slit 240*ka* provided in the first surface 201 of the adaptor 20*ka* and the concave section 240*kb* provided in the containing member 20*kb* are both provided in positions which correspond to the partition plate 607 in the holder 60. Then, the groove section 240 is formed by combining the slit 240*ka* which is provided in the first surface 201 of the adaptor 20*ka* and the concave section 240*kb* which is provided in the containing member 20*kb*. As such, it is possible for the partition plate 607 to be received in the groove section 240 in a state where the ink supply ports 280 are connected to the ink supply pipe 640.

The configuration of the cartridge 20*k* in FIG. 36 is similar to the cartridge 20 of the first embodiment which is shown in FIG. 7 including the modified examples except that the adaptor 20*ka* and the containing member 20*kb* are able to be separated as described above. That is, the configuration of the ink containing section inside the containing member 20*kb* is similar to the cartridge 20 of the first embodiment. Here, in other embodiments or other modified examples, a configuration where the containing member and the adaptor are able to be separated may be adopted as with the cartridge 20*k* of FIG. 36. Here, the dimension and the ratio of each section in the cartridge 20*k* of FIG. 36 may be a dimension and a ratio which are similar to the first embodiment even though there are parts which are different from the first embodiment.

E-4. Third Cartridge Using Adaptor

Figure 37:
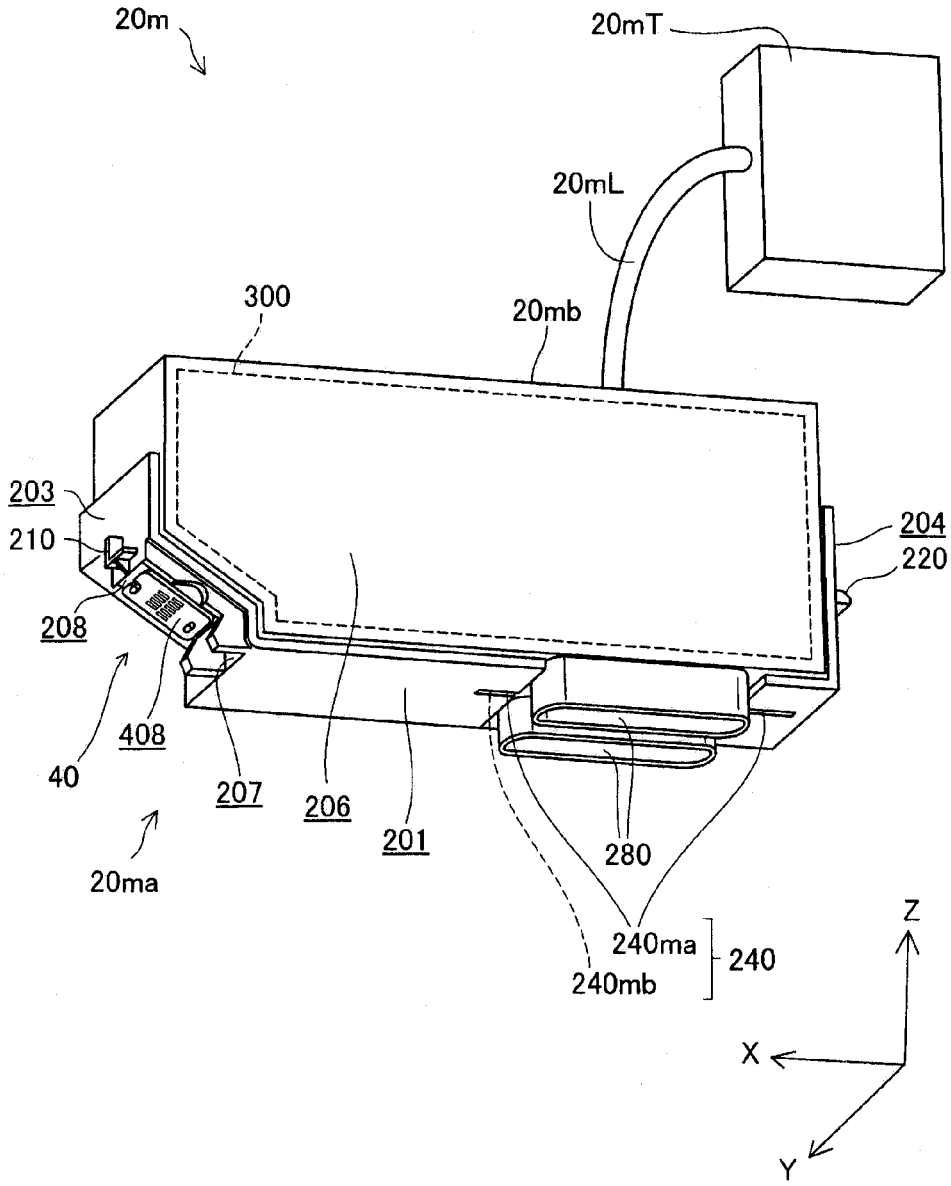
FIG. 37 is a perspective diagram illustrating a configuration of a cartridge which uses an adapter.

FIG. 37 is a perspective diagram illustrating a configuration of a cartridge 20*m* which uses an adapter. The cartridge 20*m* is provided with an adaptor 20*ma*, a containing member 20*mb*, an external tank 20*m*T, and a tube 20*m*L. The adaptor 20*ma* of the cartridge 20*m*, including the modified examples, have configuration similar to the adaptor 20*ka* in FIG. 34. The containing member 20*mb* of the cartridge 20*m*, including the modified examples, have configuration similar to and the containing member 20*kb* in FIG. 34 except that the tube 20*m*L is connected to the ink containing section 300.

The external tank 20*m*T of the cartridge 20*m* contains a printing material (ink) in an inner portion thereof. In the present embodiment, the external tank 20*m*T is disposed on the outside of the printer 50 shown in FIG. 1. The printing material of the external tank 20*m*T is supplied to the ink containing section 300 of the containing member 20*mb* via the tube 20*m*L. In a case where there is no longer any printing material in the external tank 20*m*T, it is possible to exchange the external tank 20*m*T with a new external tank 20*m*T or replenish a printing material in the external tank 20*m*T. When performing exchanging of the external tank 20*m*T or replenishing of a printing material, it is possible to reuse the adaptor 20*ma* and the containing member 20*mb*. The cartridge 20*m* in FIG. 37 is compatible with the cartridge 20 of the first embodiment shown in FIG. 7. That is, the configuration of the ink containing section inside the containing member 20*mb* is similar to the cartridge 20 of the first embodiment. Here, in other embodiments or other modified examples, a configuration where a printing material can be supplied from the external tank may be adopted as in the cartridge 20*m* of FIG. 37.

E-5. Modified Example of Circuit Substrate and Terminal Formation

In the embodiment described above, the circuit substrate 40 is provided in the cartridge 20, but in other embodiments, the circuit substrate 40 does not need to be provided in the cartridge 20. That is, the cartridge side terminals 430 may be directly formed on the eighth surface 208. In this case, the cartridge side inclined surface 408 is a portion of the eighth surface 208.

In addition, at least a portion of the circuit configuration formed on the circuit substrate 40 may be provided on a surface other than the surface of the eighth surface 208. For example, the circuit configuration including the cartridge side terminals 430 formed on the circuit substrate 40 may be provided on a flexible printing substrate with an area which is larger than that of the circuit substrate 40, the cartridge side terminals 430 are arranged on the eighth surface by folding over the flexible printing substrate, and other configurations may be disposed on the fifth surface 205 which is adjacent to the eighth surface. In addition, the arrangement of the cartridge side terminals and the device side terminals do not need to be in two rows and may be one row or may be three or more rows.

E-6. Modified Example of Holder

Figure 38:
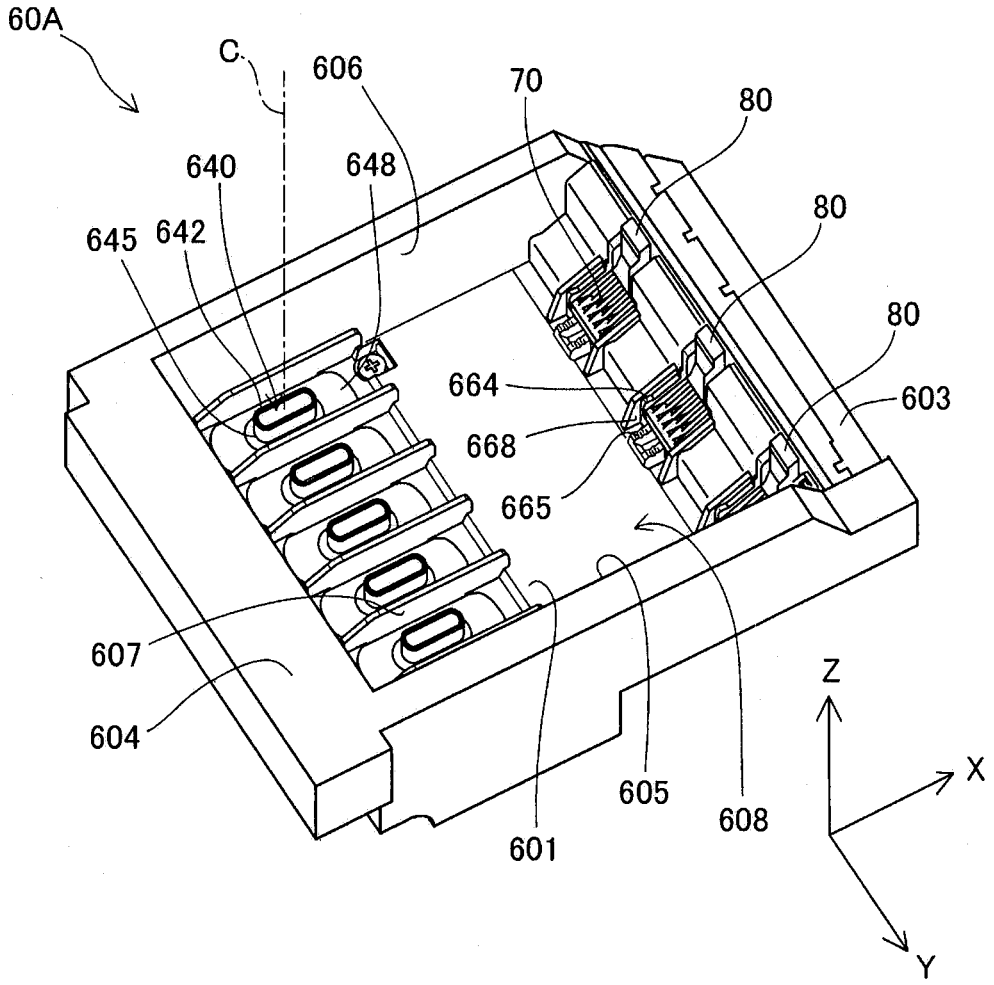
FIG. 38 is a perspective diagram illustrating a configuration of a holder in a modified example.

FIG. 38 is an explanatory diagram illustrating a configuration of a holder 60A in a modified example. The holder 60A is similar to the holder 60 of the first embodiment except that the slot SL where the terminal platform 70 and the lever 80 are provided and the slot SL where the terminal platform 70 and the lever 80 are omitted are arranged alternately. The holder 60A is configured by six slots SL in the same manner as the holder 60 of the first embodiment, and one of the ink supply pipes 640 is provided for each of the slots SL.

The holder 60A is configured so that it is possible to mount the cartridge 20 (FIG. 7) of the first embodiment and the cartridge 21 (FIG. 29 to FIG. 31) of the second embodiment. In the holder 60A, it is not possible to mount the cartridge 20S (FIG. 24) of the first embodiment in the slot SL where the terminal platform 70 and the lever 80 are omitted in the holder 60A.

The holder 60A in FIG. 38 is one example of the holder, and a configuration may be applied to holders of other embodiments or other modified examples, in which at least either one of the terminal platform 70 and the lever 80 which are not necessary with relation to the cartridge is omitted as in the holder 60A in FIG. 38. In addition, from the same point of view, a configuration may be applied to holders of other embodiments or other modified examples, in which the supply pipe side fastening section 620 which is not necessary with relation to the cartridge is omitted.

E-7. Modified Example of Internal Pressure Adjusting Mechanism and Negative Pressure Generating Member In the embodiments described above, the internal pressure of the ink containing section 300 is adjusted by a combination of the valve mechanism (the valve members 322, 324, and the elastic member 326) for introducing air into the ink containing section 300 at a predetermined timing and the negative pressure generating member (the plate member 325 and the elastic member 328). However, the configurations of the internal pressure adjusting mechanism and the negative pressure generating member are not limited to this embodiment. For example, the internal pressure of the ink containing section may be adjusted by placing a negative pressure generating member made of a continuous porous member as disclosed in Unexamined Japanese Patent Application Publication No. 10-95129 inside the ink containing section 300 instead of valve mechanism and the negative pressure generating member as explained in the above embodiments. Also, a valve for opening and closing an air flow path as disclosed in Unexamined Japanese Patent Application Publication No. 2005-170027 may be employed instead of the valve mechanism as explained in the above embodiments.

F. Fifth Embodiment

Figure 39:
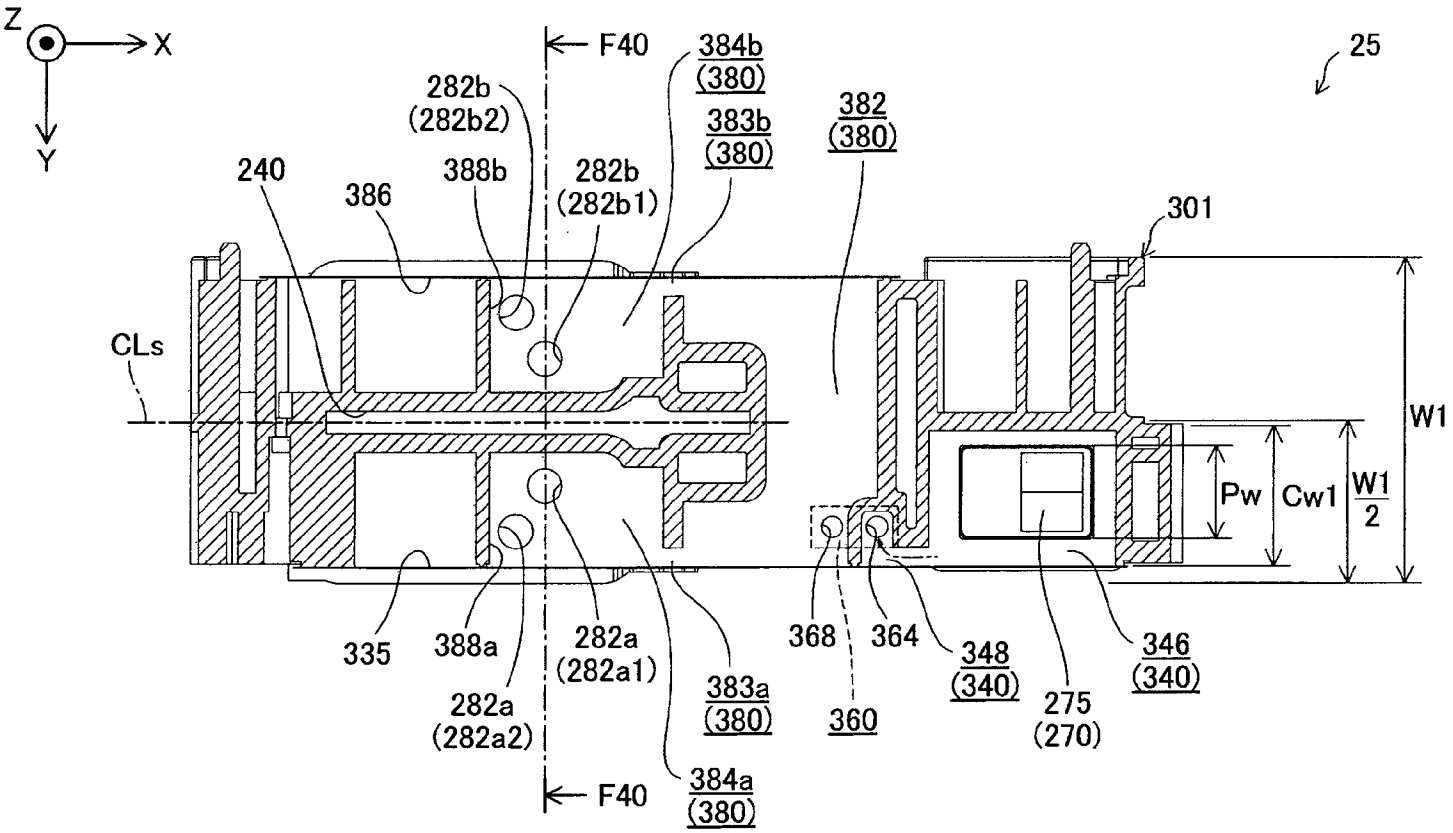
FIG. 39 is a cross-sectional diagram illustrating a configuration of a cartridge according to a fifth embodiment.
Figure 40:
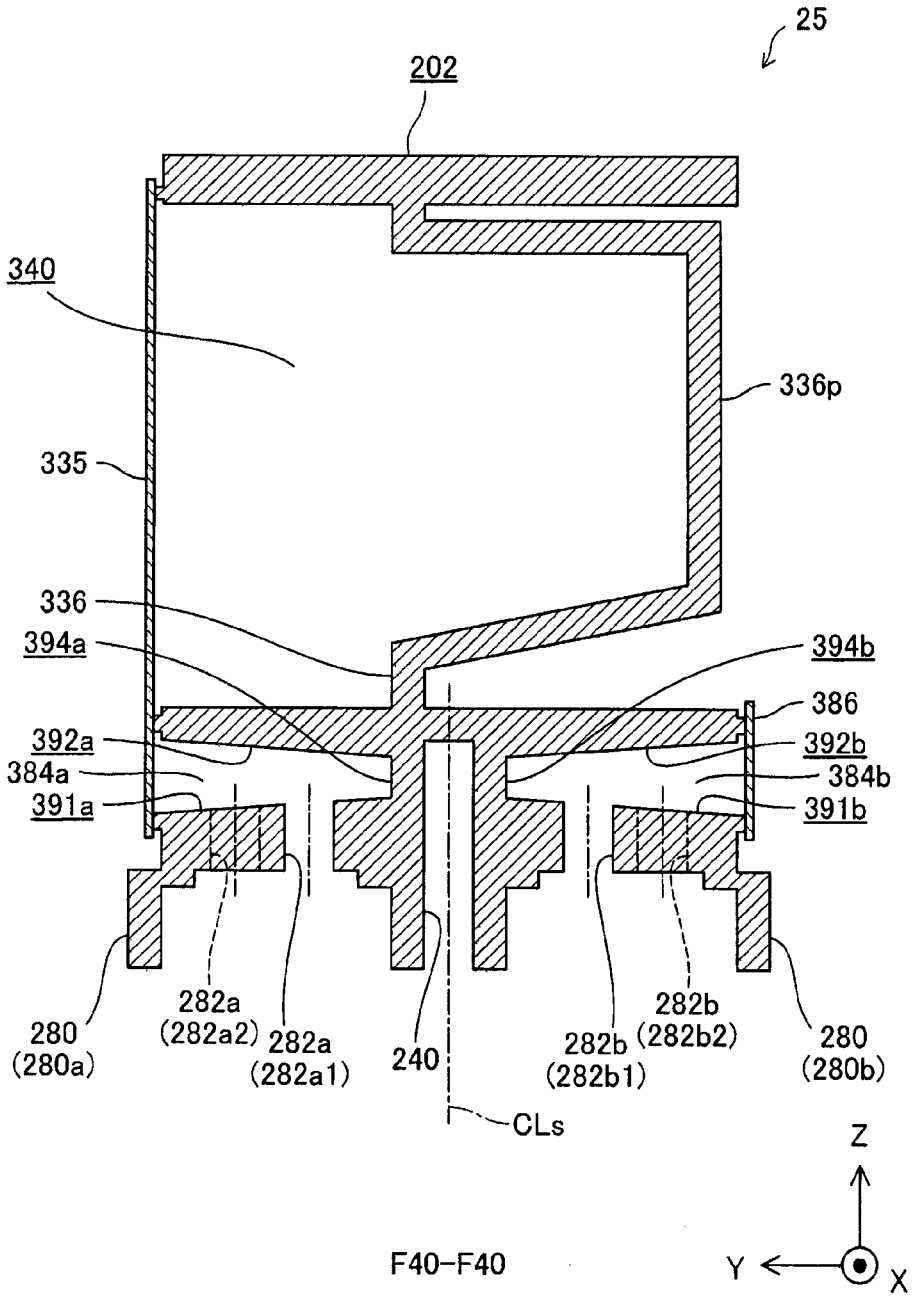
FIG. 40 is an enlarged cross-sectional diagram illustrating a configuration of a cartridge according to a fifth embodiment.

FIG. 39 is a cross-sectional diagram illustrating a configuration of a cartridge 25 according to a fifth embodiment. FIG. 40 is an enlarged cross-sectional diagram illustrating the configuration of the cartridge 25 according to the fifth embodiment. The fifth embodiment is similar to the first embodiment except that the cartridge 25 in which the plurality of ink flow paths 282 are provided for one ink supply port 280 is used. Configurations similar to the first embodiment, including modified examples, can be applied to the fifth embodiment. In the explanation of the fifth embodiment, the same reference numerals will be given with regard to the configurations which are similar to the first embodiment, and the description thereof will be omitted.

The cartridge 25 of the fifth embodiment is similar to the cartridge 20 of the first embodiment except that the plurality of ink flow paths 282 are provided for one ink supply port 280. FIG. 39 illustrates a cross-sectional shape of the cartridge 25 cut in a position corresponding to the arrow F20-F20 in FIG. 17 explained with respect to the first embodiment. FIG. 40 illustrates an enlarged cross-sectional shape of the cartridge 25 cut in the arrow F40-F40 in FIG. 39. In FIG. 40, illustrations of the leakage preventing member 284 and the plate member 325 are omitted.

Similarly to the cartridge 20 of the first embodiment, the cartridge 25 of the fifth embodiment has the main ink chamber 340 and the sub ink chamber 380. Similarly to the first embodiment, the sub ink chamber 380 of the fifth embodiment has the region 382, the region 383*a*, the region 383*b*, the region 384*a*, and the region 384*b*. The region 382 of the sub ink chamber 380 serves as the upstream side reservoir chamber, and reserves ink from the main ink chamber 340.

The region 383*a* of the sub ink chamber 380 serves as the first flow path which is communicated with the region 382. The region 383*a* is configured to distribute the ink in the region 382 to the ink supply port 280*a* as the first printing material supply port. In the present embodiment, the region 383*a* is communicated with the region 384*a* on the film member 335 side (that is, the +Y axial direction side).

The region 384*a* of the sub ink chamber 380 serves as the first downstream side reservoir chamber which is communicated with the region 383*a*. The region 384*a* reserves the ink from the region 383*a*. The ink flow path 282*a* is formed in the region 384*a*. The ink flow path 282*a* serves as the first communicating hole which communicates the region 384*a* and the ink supply port 280*a*, and supplies the ink in the region 384*a* to the ink supply port 280*a*.

The region 383*b* of the sub ink chamber 380 serves as the second flow path which is communicated with the region 382. The region 383*b* is configured to distribute the ink in the region 382 to the ink supply port 280*b* as the second printing material supply port. In the present embodiment, the region 383*b* is communicated with the region 384*b* on the film member 386 side (that is, the −Y axial direction side).

The region 384*b* of the sub ink chamber 380 serves as the second downstream side reservoir chamber which is communicated with the region 383*b*. The region 384*b* reserves the ink from the region 383*b*. The ink flow path 282*b* is formed in the region 384*b*. The ink flow path 282*b* serves as the second communicating hole which communicates the region 384*b* and the ink supply port 280*b*, and supplies the ink in the region 384*b* to the ink supply port 280*b*.

As shown in FIG. 39, in the fifth embodiment, similarly to the first embodiment, the region 383*a*, the region 384*a*, and the ink flow path 282*a*, and the region 383*b*, the region 384*b*, and the ink flow path 282*b* are arranged in a plane symmetrical manner with respect to the groove section 240. That is, the region 383*a* is plane symmetrical with respect to the region 383*b*, the region 384*a* is plane symmetrical with respect to the region 384*b*, and the ink flow path 282*a* is plane symmetrical with respect to the ink flow path 282*b*. In the present embodiment, the region 383*a*, the region 384*a*, and the ink flow path 282*a*, and the region 383*b*, the region 384*b*, and the ink flow path 282*b* are arranged in a plane symmetrical manner with a center plane CLs as a symmetrical plane which passes through the center of the groove section 240 in the Y axial direction and is parallel to the Z axis and the X axis.

In the fifth embodiment, the ink flow path 282*a* and the ink flow path 282*b* are plural, respectively. In the present embodiment, the two ink flow paths 282*a* and the two ink flow paths 282*b* are provided. In other embodiments, however, the three ink flow paths 282*a* and the three ink flow paths 282*b* may be provided. As described above, the plurality of ink flow paths 282*a* and the plurality of ink flow paths 282*b* are arranged in a plane symmetrical manner with the center plane CLs of the groove section 240 as the symmetrical plane. In the present embodiment, each of the ink flow paths 282*a* and 282*b* is a through hole which has a circular cross-section along the Z axis.

In the explanation of the present embodiment, a reference numeral "282*a*1" is used in cases indicating the ink flow path which serves as the upstream side communicating hole provided on the +X axial direction side (on the region 382 side) out of the two ink flow paths 282*a*, and a reference numeral "282*a*2" is used in cases indicating the ink flow path which serves as the downstream side communicating hole provided on the −X axial direction side (on the partition section 388*a* side).

In the explanation of the present embodiment, a reference numeral "282*b*1" is used in cases indicating the ink flow path which serves as the upstream side communicating hole provided on the +X axial direction side (on the region 382 side) out of the two ink flow paths 282*b*, and a reference numeral "282*b*2" is used in cases indicating the ink flow path which serves as the downstream side communicating hole provided on the −X axial direction side (on the partition section 388*b* side).

As shown in FIG. 40, the region 384*a* which serves as the first downstream side reservoir chamber is constructed of a lower wall surface 391*a*, an upper wall surface 392*a*, a side wall surface 394*a*, and the film member 335. In the present embodiment, the lower wall surface 391*a*, the upper wall surface 392*a*, and the side wall surface 394*a* are part of the main body member 301.

The lower wall surface 391*a* defines the −Z axial direction side of the region 384*a*. As shown in FIG. 40, the lower wall surface 391*a* is positioned more on the +Z axial direction side in the −Y axial direction side than in the +Y axial direction side. In other words, the lower wall surface 391*a* is inclined toward the +Z axial direction on the groove section 240 side.

In the lower wall surface 391*a*, the ink flow path 282*a*1 and the ink flow path 282*a*2 are provided. In the present embodiment, as shown in FIG. 40, the ink flow path (the upstream side communicating hole) 282*a*1 is positioned on the −Y axial direction side (that is, the groove section 240 side) with respect to the ink flow path (the downstream side communicating hole) 282*a*2. In other words, the ink flow path (the downstream side communicating hole) 282*a*2 is positioned on the +Y axial direction side (that is, away from the groove section 240) with respect to the ink flow path (the upstream side communicating hole) 282*a*1.

The upper wall surface 392*a* defines the +Z axial direction side of the region 384*a*. As shown in FIG. 40, the upper wall surface 392*a* is positioned more on the −Z axial direction side in the −Y axial direction side than in the +Y axial direction side. In other words, the upper wall surface 392*a* is inclined toward the −Z axial direction on the groove section 240 side. Therefore, air mixed into the ink in the region 384*a* easily remains on the +Y axial direction side (that is, on the film member 335 side) in the upper wall surface 392*a*.

The side wall surface 394*a* defines the −Y axial direction side of the region 384*a*. In the present embodiment, the side wall surface 394*a* separates the groove section 240 and the region 384*a*, and defines the groove section 240 in the region 384*a*.

As shown in FIG. 40, the region 384*b* which serves as the second downstream side reservoir chamber is constructed of a lower wall surface 391*b*, an upper wall surface 392*b*, a side wall surface 394*b*, and the film member 386. In the present embodiment, the lower wall surface 391*b*, the upper wall surface 392*b*, and the side wall surface 394*b* are part of the main body member 301.

The lower wall surface 391*b* defines the −Z axial direction side of the region 384*b*. In the lower wall surface 391*b*, the ink flow path 282*b*1 and the ink flow path 282*b*2 are provided. As shown in FIG. 40, the lower wall surface 391*b* is positioned more on the +Z axial direction side in the +Y axial direction side than in the −Y axial direction side. In other words, the lower wall surface 391*b* is inclined toward the +Z axial direction on the groove section 240 side.

In the lower wall surface 391*b*, the ink flow path 282*b*1 and the ink flow path 282*b*2 are provided. In the present embodiment, as shown in FIG. 40, the ink flow path (the upstream side communicating hole) 282*b*1 is positioned on the +Y axial direction side (that is, the groove section 240) with respect to the ink flow path (the downstream side communicating hole) 282*b*2. In other words, the ink flow path (the downstream side communicating hole) 282*b*2 is positioned on the −Y axial direction side (that is, away from the groove section 240 side) with respect to the ink flow path (the upstream side communicating hole) 282*b*1.

The upper wall surface 392*b* defines the +Z axial direction side of the region 384*b*. As shown in FIG. 40, the upper wall surface 392*b* is positioned more on the −Z axial direction side in the +Y axial direction side than in the −Y axial direction side. In other words, the upper wall surface 392*ba* is inclined toward the −Z axial direction on the groove section 240 side. Therefore, air mixed into the ink in the region 384*b* easily remains on the −Y axial direction side (that is, on the film member 386 side) in the upper wall surface 392*b*.

The side wall surface 394*b* defines the +Y axial direction side of the region 384*b*. In the present embodiment, the side wall surface 394*b* separates the groove section 240 and the region 384*b*, and defines the groove section 240 in the region 384*b*.

According to the fifth embodiment described above, similarly to the first embodiment, it is possible to reduce the cost of the cartridge 25 which has two ink supply ports 280. In addition to this, it is possible to achieve effects similar to the first embodiment, and in a case of applying a modified example, it is possible to achieve effects similar to a case of applying a modified example to the first embodiment.

In the fifth embodiments described above, similarly to the first embodiment, the region 383*a*, the region 384*a*, and the ink flow path 282*a*, and the region 383*b*, the region 384*b*, and the ink flow path 282*b* are arranged in a plane symmetrical manner with respect to the groove section 240. Therefore, it is possible to match the state of ink flowing toward the ink supply port 280*a* and the state of ink flowing toward the ink supply port 280*b*. It is thus possible to supply ink from ink supply port 280*a* and the ink supply port 280*b* on similar conditions.

Also, the ink flow path 282*a* and the ink flow path 282*b* are plural, respectively. Therefore, even in a case where distribution of ink becomes impossible in one of the ink flow paths 282, it is possible to secure distribution of ink by another one of the ink flow paths 282.

Also, the upper wall surfaces 392*a* and 392*b* on the groove section 240 side are inclined in the −Z axial direction, and the ink flow paths (the upstream side communicating holes) 282*a*1 and 282*b*1 are positioned on the groove section 240 side with respect to the ink flow paths (the downstream side communicating holes) 282*a*2 and 282*b*2. Accordingly, there is a tendency that a relatively large amount of air is mixed into the ink in a position closer to the region (the upstream side reservoir chamber) 382 in the regions (the downstream side reservoir chambers) 384*a* and 384*b*, and such air easily remains on the opposite side of the groove section 240 side in the upper wall surfaces 392*a* and 392*b*. Therefore, it is possible to prevent air from flowing into the ink flow paths (the upstream side communicating holes) 282*a*1 and 282*b*1 by securing the distance between air remaining in the upper wall surfaces 392*a* and 392*b* and the ink flow paths (the upstream side communicating holes) 282*a*1 and 282*b*1.

Also, the lower wall surfaces 391*a* and 391*b* on the groove section 240 side are inclined in the +Z axial direction, and the ink flow paths (the downstream side communicating holes) 282*a*2 and 282*b*2 are positioned away from the groove section 240 with respect to the ink flow paths (the upstream side communicating holes) 282*a*1 and 282*b*1. Therefore, it is possible to supply ink, which remains on the opposite side of the groove section 240 side in the lower wall surfaces 391*a* and 391*b*, to the ink supply ports 280 through the lower wall surfaces 391*a* and 391*b*.

Also, the region (the first flow path) 383*a* is communicated with the region (the downstream side reservoir chamber) 384*a* on the film member 335 side, and the region (the second flow path) 383*b* is communicated with the region (the downstream side reservoir chamber) 384*b* on the film member 386 side. The ink flow paths (the upstream side communicating holes) 282*a*1 and 282*b*1 are positioned on the groove section 240 side with respect to the ink flow paths (the downstream side communicating holes) 282*a*2 and 282*b*2. Therefore, it is possible to prevent air from flowing into ink flow paths (the upstream side communicating holes) 282*a*1 and 282*b*1 by securing the distribution distance of ink which flows from the region (the first flow path) 383*a* to the ink flow path (the upstream side communicating hole) 282*a*1 and the distribution distance of ink which flows from the region (the second flow path) 383*b* to the ink flow path (the upstream side communicating hole) 282*b*1 so as to gain time to remove air from the ink.

F. Other Modified Examples

The present invention is not limited to the embodiments, applied examples, or modified examples described above and it is possible to implement the present invention with various configurations in a scope which does not depart from the gist thereof. For example, it is possible to appropriately perform replacing or combining of the technical characteristics in the embodiments, applied examples, and modified examples which correspond to the technical characteristics in each of the aspects described in the section of the Disclosure of the Invention in order to solve a portion or all of the problems described above or to achieve a portion or all of the effects described above. In addition, it is possible to appropriately omit technical characteristics if described as not being essential in the specifications.

For example, instead of the storage device, another electronic device may be mounted in the cartridge. In addition, it is not necessary for each type of member in the embodiment described above to each be configured as independent members and a plurality of the members may be configured as an integrated member as required. In addition, an integrated member in the embodiment described above may be configured by combining a plurality of members.

The present invention is not limited to an ink jet printer or an ink cartridge thereof and it is possible to also apply the present invention to an arbitrary liquid ejection device which ejects a liquid other than ink and a liquid containing container thereof. For example, it is possible to apply the present invention to the following various types of liquid ejection devices and liquid containing containers thereof.

- Image recording devices such as a facsimile device
- Colorant material ejection devices which are used in manufacturing color filters which are used in image display devices such as liquid crystal displays
- Electrode material ejection devices which are used in forming electrodes such as in organic EL (Electro Luminescent) displays and field emission displays (FED)
- Liquid ejection devices which eject a liquid which includes a bioorganic material which is used in manufacturing biochips
- Sample ejection devices as precision pipettes
- Lubricating oil ejection devices
- Resin liquid ejection devices
- Liquid ejection devices which eject lubricating oil in a pin-point manner in precision machinery such as clocks and cameras
- Liquid ejection devices which eject a transparent resin liquid such as an ultraviolet curing resin liquid onto a substrate in order to form a small semispherical lens (an optical lens) which is used in optical communication elements or the like
- Liquid ejection devices which eject an acid or alkali etching liquid in order to carry out etching of a substrate or the like
- Other arbitrary liquid ejection devices which are provided with a liquid ejection head which discharges liquid droplets in small amounts.

Here, "liquid droplet" refers to a state of a liquid which is discharged from the liquid ejection device and includes liquid bodies with particle shapes and liquid bodies with teardrop shapes as well as liquid bodies which draw out a trail with a thread shape. In addition, it is sufficient if the "liquid" referred to here is a material which is able to be ejected from the liquid ejection device. For example, it is sufficient if the "liquid" is in a state where a substance is in a liquid phase, and materials in a liquid state such as materials with a liquid state where the viscosity is high or low and materials with a liquid state such as sols, gel water, other inorganic solvents, organic solvents, solutions, liquid resins, and liquid metals (metal fusion liquids) are included as "liquids". In addition, not only liquids as one state of a substance but where particles of a functional material which are formed as a solid material such as a pigment or metal particles are dissolved, dispersed, or mixed in a solvent are included as "liquids". In addition, ink as described in the embodiments described above, liquid crystals, or the like are given as representative examples of the liquid. Here, various types of liquid compositions such as typical water-based inks, oil-based inks, shell inks, and hot melt inks are included as ink.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A cartridge configured and arranged to be mounted on a printer that has a first ink supply pipe and a second ink supply pipe, the cartridge comprising:

a main ink chamber configured and arranged to contain a printing material;

a first printing material supply port configured and arranged to be contacted to the first ink supply pipe in a first direction to supply the printing material from the main ink chamber to the first ink supply pipe;

a second printing material supply port configured and arranged to be contacted to the second ink supply pipe in the first direction to supply the printing material from the main ink chamber to the second ink supply pipe; and a branch communicating section arranged between the main ink chamber and the first and second printing material supply ports in a supplying direction in which the printing material is supplied from the main ink chamber to the first and second printing material supply ports, the branch communicating section being configured and arranged to branch a flow of the printing material from the main ink chamber into the first and second printing material supply ports respectively, and communicate the main ink chamber and the first and second printing material supply ports to distribute the printing material from the main ink chamber to the first and second printing material supply ports respectively, the branch communicating section including a wall extending in a second direction perpendicular to the first direction so as to block flow of the printing material in a third direction perpendicular to the first and second directions, and including two supplying areas such that the printing material flows through the two supplying areas in the third direction, the two supplying areas being arranged apart from each other in the second direction at the same position in the third direction and having the same width in the second direction.

2. The cartridge according to claim 1, further comprising a backflow preventing section communicating the main ink chamber and the branch communicating section to prevent backflow of the printing material from the branch communicating section to the main ink chamber.

3. The cartridge according to claim 1, further comprising:

a wall section on which the first and second printing material supply ports are provided to protrude in a −Z axial direction; and a groove section provided between the first and second printing material supply ports to be recessed to a +Z axial direction side with respect to the wall section, with the +Z axial direction being opposite to the −Z axial direction along the third direction, wherein the branch communicating section includes an upstream side reservoir chamber configured and arranged to reserve the printing material from the main ink chamber, a first flow path communicated with the upstream side reservoir chamber and including one of the suplying areas, and configured and arranged to distribute the printing material in the upstream side reservoir chamber to the first printing material supply port, a first downstream side reservoir chamber communicated with the first flow path and configured and arranged to reserve the printing material from the first flow path, a first communicating hole communicating the first downstream side reservoir chamber and the first printing material supply port to supply the printing material in the first downstream side reservoir chamber to the first printing material supply port, a second flow path communicated with the upstream side reservoir chamber and including the other of the supplying areas, and configured and arranged to distribute the printing material in the upstream side reservoir chamber to the second printing material supply port different from the first printing material supply port, a second downstream side reservoir chamber communicated with the second flow path, and configured and arranged to reserve the printing material from the second flow path, and a second communicating hole communicating the second downstream side reservoir chamber and the second printing material supply port to supply the printing material in the second downstream side reservoir chamber to the second printing material supply port, and wherein the first flow path, the first downstream side reservoir chamber, the first communicating hole, the second flow path, the second downstream side reservoir chamber, and the second communicating hole are arranged in a plane symmetrical manner with respect to the groove section.

4. The cartridge according to claim 3, wherein each of the first communicating hole and the second communicating hole includes a plurality of holes.

5. The cartridge according to claim 4, wherein the −Z axial direction is a gravity direction in which gravity is directed, each of the first downstream side reservoir chamber and the second downstream side reservoir chamber includes an upper wall surface which defines the +Z axial direction and a lower wall surface which defines the −Z axial direction side, each of the first communicating hole and the second communicating hole includes a downstream side communicating hole provided in the lower wall surface, and an upstream side communicating hole provided in the lower wall surface and positioned on the upstream side reservoir chamber side with respect to the downstream side communicating hole, the upper wall surface on the groove section side is inclined in the −Z axial direction, and the upstream side communicating hole is positioned on the groove section side with respect to the downstream side communicating hole.

6. The cartridge according to claim 4, wherein the −Z axial direction is a gravity direction in which gravity is directed, each of the first downstream side reservoir chamber and the second downstream side reservoir chamber includes a lower wall surface which defines the −Z axial direction side, each of the first communicating hole and the second communicating hole includes a downstream side communicating hole provided in the lower wall surface, and an upstream side communicating hole provided in the lower wall surface and positioned on the upstream side reservoir chamber side with respect to the downstream side communicating hole, the lower wall surface on the groove section side is inclined in the +Z axial direction, and the downstream side communicating hole is positioned away from the groove section with respect to the upstream side communicating hole.

7. The cartridge according to claim 4, wherein the first flow path is communicated with the first downstream side reservoir chamber on the opposite side of the groove section, the second flow path is communicated with the second downstream side reservoir chamber on the opposite side of the groove section, each of the first downstream side reservoir chamber and the second downstream side reservoir chamber includes a lower wall surface which defines the −Z axial direction side, each of the first communicating hole and the second communicating hole includes a downstream side communicating hole provided in the lower wall surface, and an upstream side communicating hole provided in the lower wall surface and positioned on the upstream side reservoir chamber side with respect to the downstream side communicating hole, and the upstream side communicating hole is positioned on the groove section side with respect to the downstream side communicating hole.

8. The cartridge according to claim 1, further comprising:

a detection region configured as a part of the main ink chamber to detect the printing material in the main ink chamber, the branch communicating section communicating the main ink chamber and the first and second printing material supply ports.

9. A cartridge configured and arranged to be mounted on a printer that has a first ink supply pipe and a second ink supply pipe, the cartridge comprising:

a main ink chamber configured and arranged to contain a printing material;

a first printing material supply port configured and arranged to be contacted to the first ink supply pipe in a first direction to supply the printing material from the main ink chamber to the first ink supply pipe;

a second printing material supply port configured and arranged to be contacted to the second ink supply pipe in the first direction to supply the printing material from the main ink chamber to the second ink supply pipe;

a sub ink chamber configured and arranged to contain the printing material and arranged between the main ink chamber and the first and second printing material supply ports in a supplying direction in which the printing material is supplied from the main ink chamber to the first and second printing material supply ports;

the sub ink chamber having a wall extending in a second direction perpendicular to the first direction so as to block flow of the printing material in a third direction perpendicular to the first and second directions, and two supplying areas such that the printing material flows through the two supplying areas in the third direction, the two supplying areas being arranged apart from each other in the second direction at the same position in the third direction and having the same width in the second direction, a first region and a second region, the first region communicating the main ink chamber through one of the supplying areas and communicating the first printing material supply port to supply the printing material from the main ink chamber to the first printing material supply port, and the second region communicating the main ink chamber through the other of the supplying areas and communicating the second printing material supply port to supply the printing material from the main ink chamber to the second printing material supply port.

10. The cartridge according to claim 9, further comprising:

a first leakage preventing member provided in the first printing material supply port; and a second leakage preventing member provided in the second printing material supply port.

11. The cartridge according to claim 10, wherein the first leakage preventing member includes a first porous member and the second leakage preventing member includes a second porous member.

12. A cartridge configured and arranged to be mounted on a printer that has a first ink supply pipe and a second ink supply pipe, the cartridge comprising:

a main ink chamber configured and arranged to contain a printing material;

a first printing material supply port configured and arranged to be contacted to the first ink supply pipe to supply the printing material from the main ink chamber to the first ink supply pipe;

a second printing material supply port configured and arranged to be contacted to the second ink supply pipe to supply the printing material from the main ink chamber to the second ink supply pipe;

a branch communicating section arranged between the main ink chamber and the first and second printing material supply ports in a supplying direction in which the printing material is supplied from the main ink chamber to the first and second printing material supply ports, the branch communicating section being configured and arranged to branch a flow of the printing material from the main ink chamber into the first and second printing material supply ports respectively, and communicate the main ink chamber and the first and second printing material supply ports to distribute the printing material from the main ink chamber to the first and second printing material supply ports respectively; p1 a wall section on which the first and second printing material supply ports are provided to protrude in a −Z axial direction; and a groove section provided between the first and second printing material supply ports to be recessed to a +Z axial direction side with respect to the wall section, with the +Z axial direction being opposite to the −Z axial direction along a Z axial direction, the branch communicating section including an upstream side reservoir chamber configured and arranged to reserve the printing material from the main ink chamber, a first flow path communicated with the upstream side reservoir chamber, and configured and arranged to distribute the printing material in the upstream side reservoir chamber to the first printing material supply port, a first downstream side reservoir chamber communicated with the first flow path and configured and arranged to reserve the printing material from the first flow path, a first communicating hole communicating the first downstream side reservoir chamber and the first printing material supply port to supply the printing material in the first downstream side reservoir chamber to the first printing material supply port, a second flow path communicated with the upstream side reservoir chamber, and configured and arranged to distribute the printing material in the upstream side reservoir chamber to the second printing material supply port different from the first printing material supply port, a second downstream side reservoir chamber communicated with the second flow path, and configured and arranged to reserve the printing material from the second flow path, and 'a second communicating hole communicating the second downstream side reservoir chamber and the second printing material supply port to supply the printing material in the second downstream side reservoir chamber to the second printing material supply port, the first flow path, the first downstream side reservoir chamber, the first communicating hole, the second flow path, the second downstream side reservoir chamber, and the second communicating hole being arranged in a plane symmetrical manner with respect to the groove section.

13. A cartridge configured and arranged to be mounted on a printer that has a first ink supply pipe and a second ink supply pipe, the cartridge comprising:

a main ink chamber configured and arranged to contain a printing material;

a first printing material supply port configured and arranged to be contacted to the first ink supply pipe to supply the printing material from the main ink chamber to the first ink supply pipe;

a second printing material supply port configured and arranged to be contacted to the second ink supply pipe to supply the printing material from the main ink chamber to the second ink supply pipe;

a branch communicating section arranged between the main ink chamber and the first and second printing material supply ports in a supplying direction in which the printing material is supplied from the main ink chamber to the first and second printing material supply ports, the branch communicating section being configured and arranged to branch a flow of the printing material from the main ink chamber into the first and second printing material supply ports respectively, and communicate the main ink chamber and the first and second printing material supply ports to distribute the printing material from the main ink chamber to the first and second printing material supply ports respectively; and a wall section on which the first and second printing material supply ports are provided to protrude in a −Z axial direction along a Z axial direction, the branch communicating section including an upstream side reservoir chamber configured and arranged to reserve the printing material from the main ink chamber, a first downstream side reservoir chamber communicated with the upstream side reservoir chamber and arranged to reserve the printing material from the first flow path, a first communicating hole communicating the first downstream side reservoir chamber and the first printing material supply port to supply the printing material in the first downstream side reservoir chamber to the first printing material supply port, a second downstream side reservoir chamber communicated with the upstream side reservoir chamber, and arranged to reserve the printing material from the second flow path, and a second communicating hole communicating the second downstream side reservoir chamber and the second printing material supply port to supply the printing material in the second downstream side reservoir chamber to the second printing material supply port, the first downstream side reservoir chamber and the first communicating hole, and the second downstream side reservoir chamber and the second communicating hole being arranged in a plane symmetrical manner as viewed in the third direction.

14. A cartridge configured and arranged to be mounted on a printer that has a first ink supply pipe and a second ink supply pipe, the cartridge comprising:

a printing material containing section configured and arranged to contain a printing material;

a first printing material supply port configured and arranged to be contacted to the first ink supply pipe to supply the printing material from the printing material containing section to the first ink supply pipe;

a second printing material supply port configured and arranged to be contacted to the second ink supply pipe to supply the printing material from the printing material containing section to the second ink supply pipe;

a branch communicating section branching a flow of the printing material into the first and second printing material supply ports respectively, and communicating the printing material containing section and the first and second printing material supply ports to distribute the printing material to the first and second printing material supply ports respectively, a wall section on which the first and second printing material supply ports are provided to protrude in a −Z axial direction; and a groove section provided between the first and second printing material supply ports to be recessed to a +Z axial direction side with respect to the wall section, with the +Z axial direction being opposite to the -z axial direction, the branch communicating section including an upstream side reservoir chamber configured and arranged to reserve the printing material from the printing material containing section, a first flow path communicated with the upstream side reservoir chamber, and configured and arranged to distribute the printing material in the upstream side reservoir chamber to the first printing material supply port, a first downstream side reservoir chamber communicated with the first flow path and configured and arranged to reserve the printing material from the first flow path, a first communicating hole communicating the first downstream side reservoir chamber and the first printing material supply port to supply the printing material in the first downstream side reservoir chamber to the first printing material supply port, a second flow path communicated with the upstream side reservoir chamber, and configured and arranged to distribute the printing material in the upstream side reservoir chamber to the second printing material supply port different from the first printing material supply port, a second downstream side reservoir chamber communicated with the second flow path, and configured and arranged to reserve the printing material from the second flow path, and a second communicating hole communicating the second downstream side reservoir chamber and the second printing material supply port to supply the printing material in the second downstream side reservoir chamber to the second printing material supply port, the first flow path, the first downstream side reservoir chamber, the first communicating hole, the second flow path, the second downstream side reservoir chamber, and the second communicating hole being arranged in a plane symmetrical manner with respect to the groove section.

* * * * *